US009755311B2

(12) United States Patent
Zhou et al.

(10) Patent No.: US 9,755,311 B2
(45) Date of Patent: Sep. 5, 2017

(54) CIRCULARLY POLARIZED PATCH ANTENNAS, ANTENNA ARRAYS, AND DEVICES INCLUDING SUCH ANTENNAS AND ARRAYS

(71) Applicant: Samsung Electronics Co., LTD, Suwon-si, Gyeonggi-do (KR)

(72) Inventors: Hongyu Zhou, Richardson, TX (US); Farshid Aryanfar, Allen, TX (US)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 539 days.

(21) Appl. No.: 13/838,469

(22) Filed: Mar. 15, 2013

(65) Prior Publication Data

US 2013/0321214 A1 Dec. 5, 2013

Related U.S. Application Data

(60) Provisional application No. 61/652,759, filed on May 29, 2012, provisional application No. 61/657,524, filed on Jun. 8, 2012.

(51) Int. Cl.
*H01Q 9/04* (2006.01)
*H01Q 21/00* (2006.01)

(52) U.S. Cl.
CPC ..... *H01Q 9/0407* (2013.01); *H01Q 9/045* (2013.01); *H01Q 9/0428* (2013.01); *H01Q 21/0006* (2013.01)

(58) Field of Classification Search
CPC .... H01Q 21/00; H01Q 21/006; H01Q 9/0407; H01Q 9/0428; H01Q 9/045
(Continued)

(56) References Cited

U.S. PATENT DOCUMENTS 3,995,277 A * 11/1976 Olyphant, Jr. ..... H01Q 13/206 343/846
4,180,817 A * 12/1979 Sanford ..... H01Q 13/206 342/375

(Continued)

FOREIGN PATENT DOCUMENTS

CN 1674357 A 9/2005
CN 201191649 Y 2/2009

(Continued)

OTHER PUBLICATIONS

International Search Report dated Sep. 27, 2013 in connection with International Patent Application No. PCT/KR2013/004656, 3 pages.

(Continued)

*Primary Examiner* — Dameon E Levi
*Assistant Examiner* — Jennifer F Hu

(57) ABSTRACT

For use in a wireless network, an apparatus for use in a wireless network includes an antenna having (i) a first patch element with two opposite corners truncated and (ii) a first microstrip line connected to a first side of the first patch element and configured to feed the first patch element. The first microstrip line forms an angle of substantially 45° with the first side of the first patch element. The antenna could also include (i) a second patch element with two opposite corners truncated and (ii) a second microstrip line connected to a side of the second patch element. The second microstrip line could form an angle of substantially 45° with the side of the second patch element. The patch elements could be series-coupled and form an antenna array. One patch element could represent a host patch element, and another patch element could represent a parasitic patch element.

18 Claims, 51 Drawing Sheets

(58) Field of Classification Search
USPC ..... 343/893
See application file for complete search history.

(56) References Cited

U.S. PATENT DOCUMENTS

| | | | | |
|---|---|---|---|---|
| 4,899,163 | A * | 2/1990 | Daniel | G01S 13/60 343/700 MS |
| 4,980,693 | A * | 12/1990 | Wong | H01Q 9/0428 343/700 MS |
| 5,712,644 | A | 1/1998 | Kolak | |
| 6,285,323 | B1 * | 9/2001 | Frank | H01Q 21/0006 343/700 MS |
| 6,424,298 | B1 * | 7/2002 | Nishikawa | H01Q 21/0037 343/700 MS |
| 7,138,950 | B2 | 11/2006 | Fukushima et al. | |
| 7,212,163 | B2 * | 5/2007 | Huang | H01Q 19/026 343/700 MS |
| D617,318 | S * | 6/2010 | Tsai | D14/230 |
| 8,072,384 | B2 | 12/2011 | Morrow | |
| 8,432,314 | B2 | 4/2013 | Mao et al. | |
| 8,604,981 | B2 * | 12/2013 | Ehlen | H01Q 21/0087 343/700 MS |
| 2005/0200531 | A1 * | 9/2005 | Huang | H01Q 19/026 343/700 MS |
| 2006/0238307 | A1 * | 10/2006 | Bauer | G06K 7/0008 340/10.1 |
| 2007/0004363 | A1 * | 1/2007 | Kusaka | H01Q 1/007 455/269 |
| 2010/0171666 | A1 | 7/2010 | Mizutani et al. | |
| 2010/0177012 | A1 * | 7/2010 | Morrow | H01Q 21/0025 343/893 |
| 2011/0095958 | A1 | 4/2011 | Mao et al. | |
| 2012/0256795 | A1 * | 10/2012 | Tajima | G01S 7/032 343/700 MS |

FOREIGN PATENT DOCUMENTS

| | | | |
|---|---|---|---|
| CN | 101771196 | | 7/2010 |
| CN | 101771196 | A | 7/2010 |
| CN | 101820097 | A | 9/2010 |
| JP | 2005012743 | A | 1/2005 |
| KR | 20090046590 | A | 5/2009 |
| TW | 201115838 | A | 5/2011 |
| TW | 201115838 | A1 | 5/2011 |

OTHER PUBLICATIONS

Written Opinion of International Searching Authority dated Sep. 27, 2013 in connection with International Patent Application No. PCT/KR2013/004656, 7 pages.

First Chinese Office Action dated Aug. 27, 2015 in connection with Chinese Patent Application No. 2013800278078; 19 pages.

Second Office Action dated Apr. 5, 2016 in connection with Chinese Patent Application No. 201380027807.8; 15 pages.

Chinese Patent Office, "Third Office Action," Chinese Application No. CN201380027807.8, Oct. 28, 2016, 18 pages, publisher CPO, Examination Department: Communications Invention Examination Department, Shanghai, China.

* cited by examiner

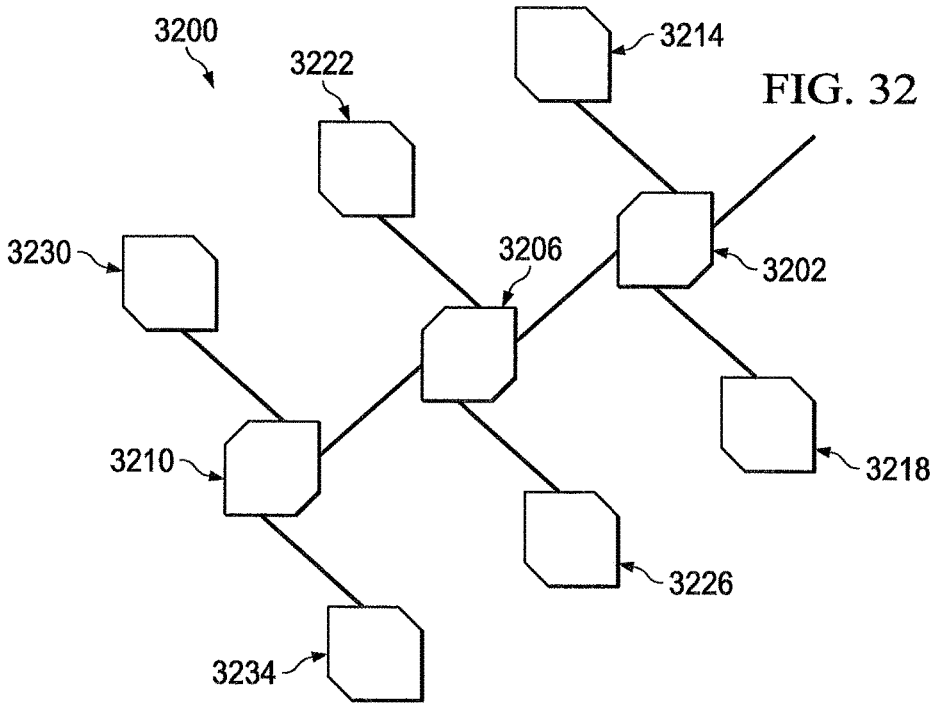
FIG. 32
FIG. 33
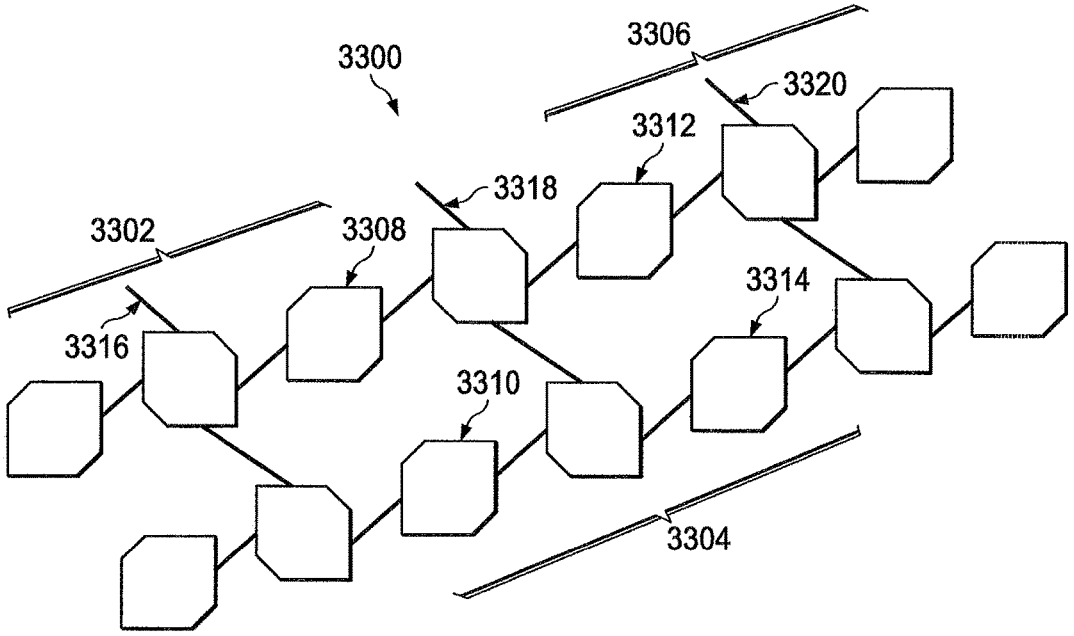

CIRCULARLY POLARIZED PATCH ANTENNAS, ANTENNA ARRAYS, AND DEVICES INCLUDING SUCH ANTENNAS AND ARRAYS

CROSS-REFERENCE TO RELATED APPLICATIONS AND PRIORITY CLAIM

This application claims priority under 35 U.S.C. §119(e) to the following U.S. provisional patent applications:

U.S. Provisional Patent Application No. 61/652,759 filed on May 29, 2012; and

U.S. Provisional Patent Application No. 61/657,524 filed on Jun. 8, 2012.

Both of these provisional patent applications are hereby incorporated into this disclosure as if fully set forth herein.

TECHNICAL FIELD

This disclosure relates generally to wireless communications. More specifically, this disclosure relates to circularly polarized patch antennas, antenna arrays, and devices including such antennas and arrays.

BACKGROUND

Patch antennas are routinely used in various devices to transmit and receive wireless signals. Patch antennas typically include a flat rectangular "patch" of conductive material that is separated from a larger conductive "ground plane." Patch antennas often have low profiles and low cost, and patch antennas are highly compatible with printed circuit board (PCB) manufacturing techniques. For these and other reasons, patch antennas have been used for decades in both commercial and military applications.

SUMMARY

This disclosure provides circularly polarized patch antennas, antenna arrays, and devices including such antennas and arrays.

In a first embodiment, an apparatus for use in a wireless network includes an antenna having (i) a first patch element with two opposite corners truncated and (ii) a first microstrip line connected to a first side of the first patch element and configured to feed the first patch element. The first microstrip line forms an angle of substantially 45° with the first side of the first patch element.

In a second embodiment, a system includes an antenna having (i) a first patch element with two opposite corners truncated and (ii) a first microstrip line connected to a first side of the first patch element and configured to feed the first patch element. The system also includes a transceiver configured to communicate wirelessly via the antenna. The first microstrip line forms an angle of substantially 45° with the first side of the first patch element.

In a third embodiment, a method includes transmitting outgoing wireless signals and/or receiving incoming wireless signals using an antenna. The antenna includes (i) a first patch element with two opposite corners truncated and (ii) a first microstrip line connected to a first side of the first patch element and configured to feed the first patch element. The first microstrip line forms an angle of substantially 45° with the first side of the first patch element.

Other technical features may be readily apparent to one skilled in the art from the following figures, descriptions, and claims.

Before undertaking the DETAILED DESCRIPTION below, it may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The term "controller" means any device, system, or part thereof that controls at least one operation. A controller may be implemented in hardware or in a combination of hardware and firmware and/or software. It should be noted that the functionality associated with any particular controller may be centralized or distributed, whether locally or remotely. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C. Definitions for certain other words and phrases are provided throughout this patent document, and those of ordinary skill in the art should understand that in many if not most instances, such definitions apply to prior as well as future uses of such defined words and phrases.

BRIEF DESCRIPTION OF THE DRAWINGS

For a more complete understanding of this disclosure, reference is now made to the following description, taken in conjunction with the accompanying drawings, in which:

FIGS. 4 through 41 illustrate example circularly polarized patch antennas and antenna arrays using angled feed lines according to this disclosure.

DETAILED DESCRIPTION

Figure 1:
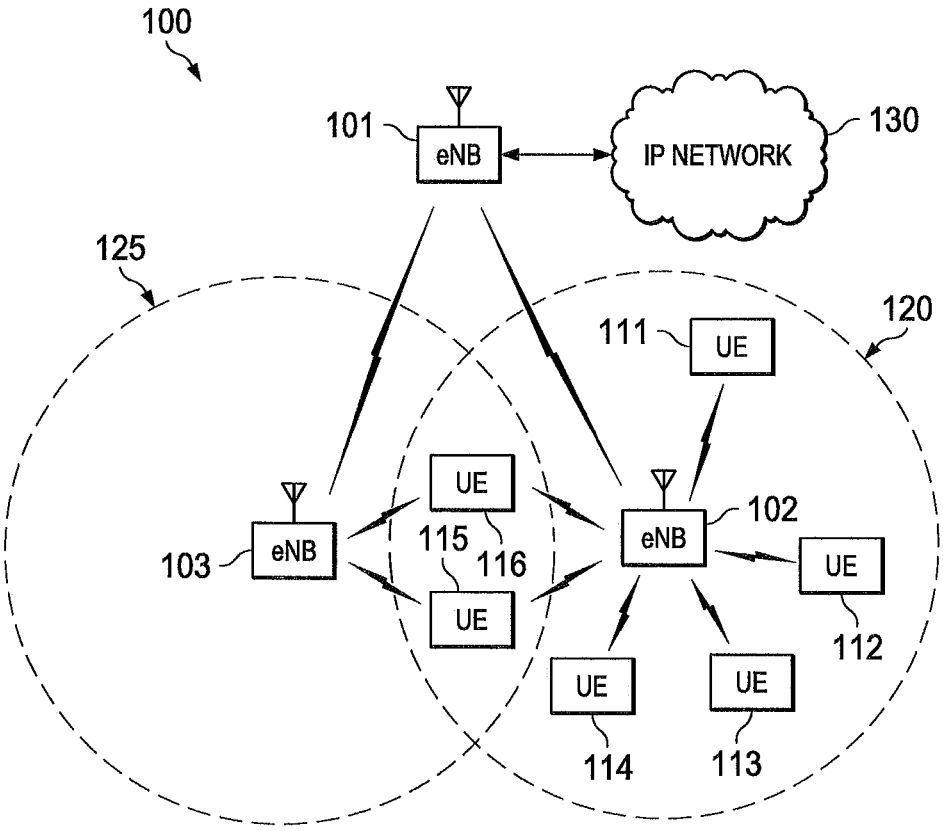
FIG. 1 illustrates an example wireless network according to this disclosure.
Figure 56:
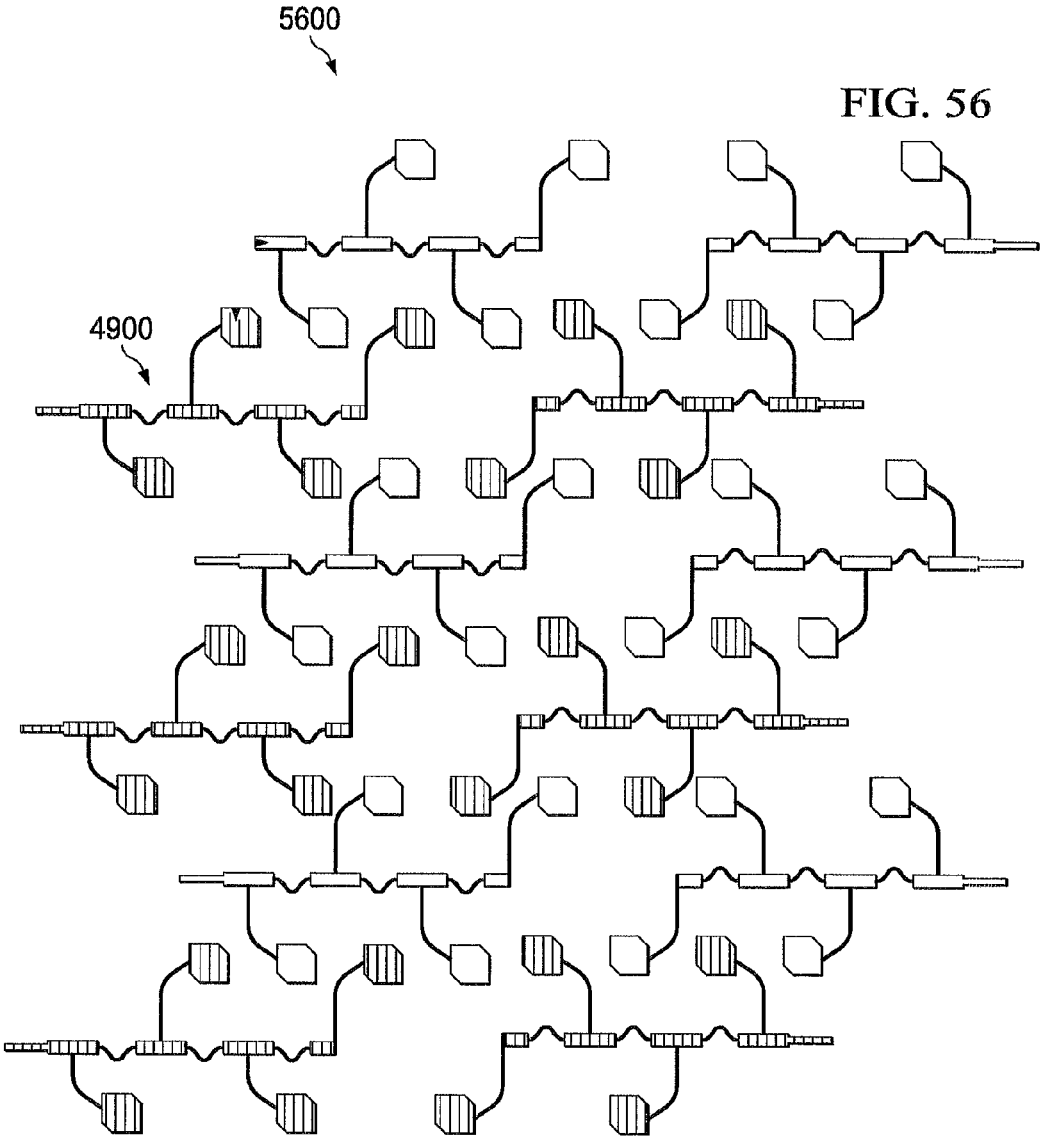

FIGS. 1 through 56, discussed below, and the various embodiments used to describe the principles of the present invention in this patent document are by way of illustration only and should not be construed in any way to limit the scope of the invention. Those skilled in the art will understand that the principles of the invention may be implemented in any type of suitably arranged device or system.

FIG. 1 illustrates an example wireless network 100 according to this disclosure. As shown in FIG. 1, the wireless network 100 includes an eNodeB (eNB) 101, an eNB 102, and an eNB 103. The eNB 101 communicates with the eNB 102 and eNB 103. The eNB 101 also communicates with an Internet Protocol (IP) network 130, such as the Internet, a proprietary IP network, or other data network. The eNB 102 and the eNB 103 are able to access the network 130 via the eNB 101 in this example.

The eNB 102 provides wireless broadband access to the network 130 (via the eNB 101) to user equipment (UE) within a coverage area 120 of the eNB 102. The UEs here include UE 111, which may be located in a small business; UE 112, which may be located in an enterprise; UE 113, which may be located in a WiFi hotspot; UE 114, which may be located in a first residence; UE 115, which may be located in a second residence; and UE 116, which may be a mobile device (such as a cell phone, wireless laptop computer, or wireless personal digital assistant). Each of the UEs 111-116 may represent a mobile device or a stationary device. The eNB 103 provides wireless broadband access to the network 130 (via the eNB 101) to UEs within a coverage area 125 of the eNB 103. The UEs here include the UE 115 and the UE 116. In some embodiments, one or more of the eNBs 101-103 may communicate with each other and with the UEs 111-116 using LTE or LTE-A techniques.

Dotted lines show the approximate extents of the coverage areas 120 and 125, which are shown as approximately circular for illustration and explanation only. The coverage areas 120 and 125 may have other shapes, including irregular shapes, depending upon factors like the configurations of the eNBs and variations in radio environments associated with natural and man-made obstructions.

Depending on the network type, other well-known terms may be used instead of "eNodeB" or "eNB" for each of the components 101-103, such as "base station" or "access point." For the sake of convenience, the terms "eNodeB" and "eNB" are used here to refer to each of the network infrastructure components that provides wireless access to remote wireless equipment. Also, depending on the network type, other well-known terms may be used instead of "user equipment" or "UE" for each of the components 111-116, such as "mobile station" (MS), "subscriber station" (SS), "remote terminal" (RT), "wireless terminal" (WT), and "user device." For the sake of convenience, the terms "user equipment" and "UE" are used here to refer to remote wireless equipment that wirelessly accesses an eNB, whether the UE is a mobile device (such as a cell phone) or is normally considered a stationary device (such as a desktop computer or vending machine).

As described in more detail below, each eNB 101-103 and/or each UE 111-116 could include at least one circular polarization (CP) patch antenna. A single patch antenna could be used, or multiple patch antennas (such as in an array) could be used. These patch antennas can support wideband, single layer, single feed, high efficiency antenna solutions. These patch antennas are also highly suitable for low-cost millimeter-wave (MMW) phase scanning arrays. Redundant feeding networks can be completely removed (although this is not required), and an entire antenna or array could be manufactured with single-layer printed circuit board (PCB) fabrication technology. Compared with conventional CP patch antenna solutions, the antennas and arrays described below are more practical for commercial products or other products, such as those products where phase-scanning is desired or required.

Although FIG. 1 illustrates one example of a wireless network 100, various changes may be made to FIG. 1. For example, the network 100 could include any number of eNBs and any number of UEs in any suitable arrangement. Also, the eNB 101 could communicate directly with any number of UEs and provide those UEs with wireless broadband access to the network 130. Further, the eNB 101 could provide access to other or additional external networks, such as an external telephone network. In addition, the makeup and arrangement of the wireless network 100 is for illustration only. The antennas and antenna arrays described below could be used in any other suitable device or system that engages in wireless communications.

Figure 2:
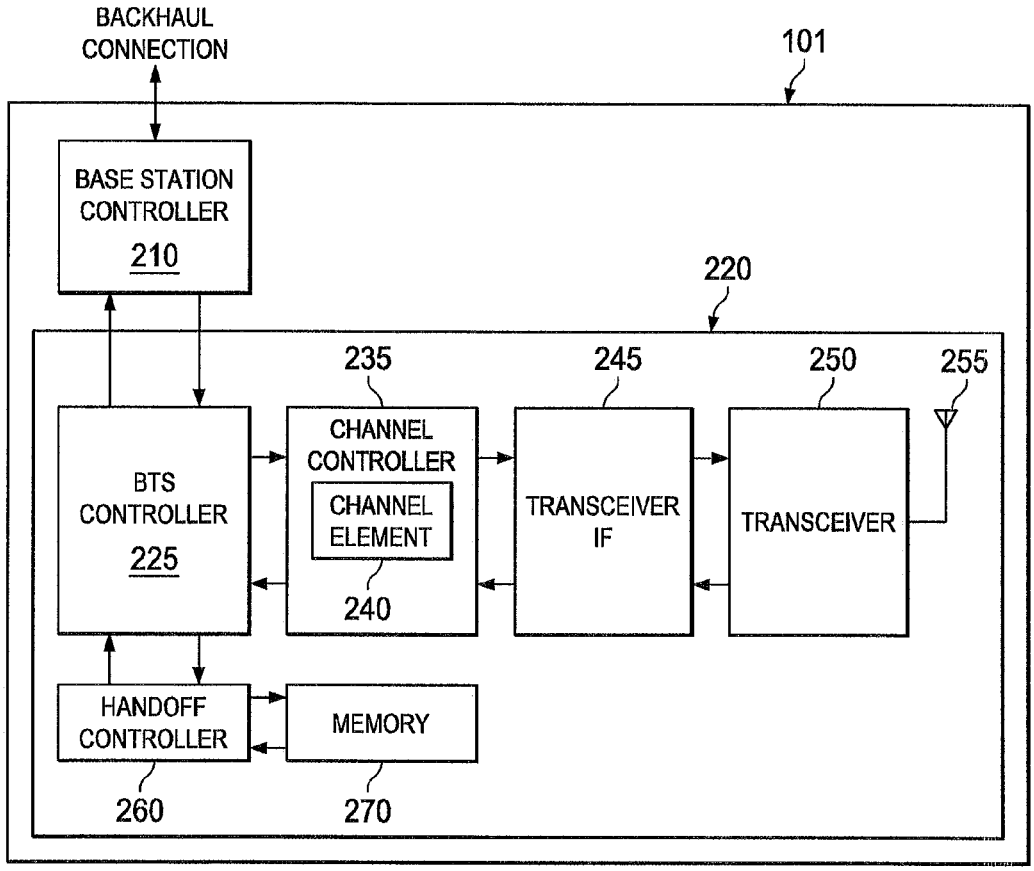
FIG. 2 illustrates an example eNodeB according to this disclosure.

FIG. 2 illustrates an example eNodeB 101 according to this disclosure. The same or similar structure could be used in the eNBs 102-103 of FIG. 1. As shown in FIG. 2, the eNB 101 includes a base station controller (BSC) 210 and one or more base transceiver subsystems (BTSs) 220. The BSC 210 manages the resources of the eNB 101, including the BTSs 220. Each BTS 220 includes a BTS controller 225, a channel controller 235, a transceiver interface (IF) 245, an RF transceiver 250, and an antenna array 255. The channel controller 235 includes a plurality of channel elements 240. Each BTS 220 may also include a handoff controller 260 and a memory 270, although these components could reside outside of a BTS 220.

The BTS controller 225 includes processing circuitry and memory capable of executing an operating program that communicates with the BSC 210 and controls the overall operation of the BTS 220. Under normal conditions, the BTS controller 225 directs the operation of the channel controller 235, where the channel elements 240 perform bi-directional communications in forward channels and reverse channels. The transceiver IF 245 transfers bi-directional channel signals between the channel controller 240 and the RF transceiver 250. The RF transceiver 250 (which could represent integrated or separate transmitter and receiver units) transmits and receives wireless signals via the antenna array 255. The antenna array 255 transmits forward channel signals from the RF transceiver 250 to UEs in the coverage area of the eNB 101. The antenna array 255 also sends to the transceiver 250 reverse channel signals received from the UEs in the coverage area of the eNB 101.

As described below, the antenna array 255 of the eNB 101 includes at least one CP patch antenna. Among other things, the antenna array 255 can support the use of MMW antennas, including scanning antennas. Moreover, the antenna array 255 could be manufactured using standard PCB fabrication techniques.

Although FIG. 2 illustrates one example of an eNB 101, various changes may be made to FIG. 2. For example, various components in FIG. 2 could be combined, further subdivided, or omitted and additional components could be added according to particular needs. Also, while FIG. 2 illustrates the eNB 101 operating as a base station, eNBs could be configured to operate as other types of devices (such as an access point).

Figure 3:
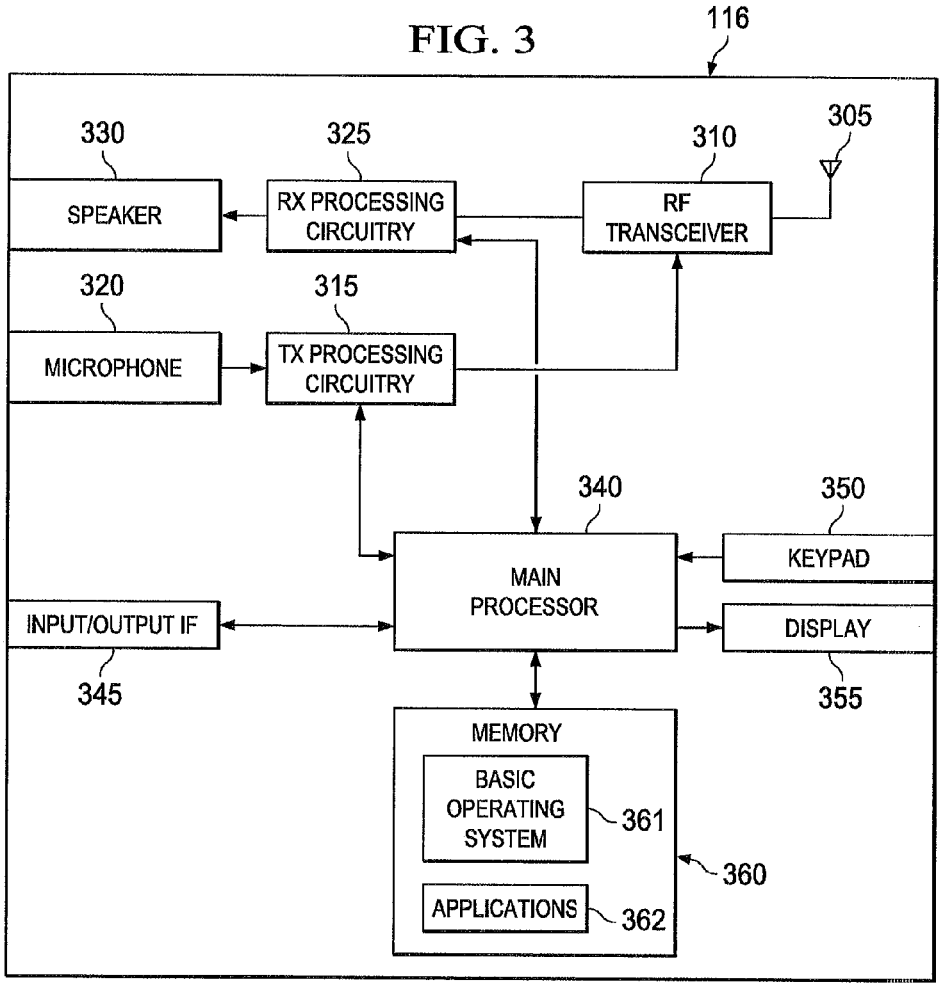
FIG. 3 illustrates an example user equipment according to this disclosure.

FIG. 3 illustrates an example UE 116 according to this disclosure. The same or similar structure could be used in the UEs 111-116 of FIG. 1. As shown in FIG. 3, the UE 116 includes an antenna 305, an RF transceiver 310, transmit (TX) processing circuitry 315, a microphone 320, and receive (RX) processing circuitry 325. The UE 116 also includes a speaker 330, a main processor 340, an input/output (I/O) interface 345, a keypad 350, a display 355, and a memory 360. The memory 360 includes a basic operating system (OS) program 361 and one or more applications 362. The applications 362 can support various functions, such as voice communications, web browsing, productivity applications, and games.

The RF transceiver 310 receives, from the antenna 305, an incoming RF signal transmitted by an eNB. The RF transceiver 310 down-converts the incoming RF signal to generate an intermediate frequency (IF) signal or a baseband signal. The IF or baseband signal is sent to the RX processing circuitry 325, which generates a processed baseband signal (such as by filtering, decoding, and/or digitizing the baseband or IF signal). The RX processing circuitry 325 can transmit the processed baseband signal to, for example, the speaker 330 (such as for voice data) or to the main processor 340 for further processing (such as for web browsing data).

The TX processing circuitry 315 receives analog or digital voice data from the microphone 320 or other outgoing baseband data (such as web, e-mail, or interactive video game data) from the main processor 340. The TX processing circuitry 315 encodes, multiplexes, and/or digitizes the outgoing baseband data to generate a processed baseband or IF signal. The RF transceiver 310 receives the outgoing processed baseband or IF signal from the TX processing circuitry 315 and up-converts the baseband or IF signal to an RF signal that is transmitted via the antenna 305.

The main processor 340 executes the basic OS program 361 in order to control the overall operation of the UE 116. For example, the main processor 340 can control the reception of forward channel signals and the transmission of reverse channel signals by the RF transceiver 310, RX processing circuitry 325, and TX processing circuitry 315 in accordance with well-known principles.

The main processor 340 is also capable of executing other processes and programs, such as the applications 362. The main processor 340 can execute these applications 362 based on various inputs, such as input from the OS program 361, a user, or an eNB. In some embodiments, the main processor 340 is a microprocessor or microcontroller. The memory 360 can include any suitable storage device(s), such as a random access memory (RAM) and a Flash memory or other read-only memory (ROM).

The main processor 340 is coupled to the I/O interface 345. The I/O interface 345 provides the UE 116 with the ability to connect to other devices, such as laptop computers and handheld computers. The I/O interface 345 is the communication path between these accessories and the main processor 340. The main processor 340 is also coupled to the keypad 350 and the display unit 355. The operator of the UE 116 uses the keypad 350 to enter data into the UE 116. The display 355 may be a liquid crystal display capable of rendering text and/or at least limited graphics from web sites. Other embodiments may use other types of displays, such as touchscreen displays that can also receive user input.

As described below, the antenna 305 of the UE 116 includes at least one CP patch antenna. Among other things, the antenna 305 could represent a MMW antenna, including a scanning antenna. Moreover, the antenna 305 could be manufactured using standard PCB fabrication techniques.

Although FIG. 3 illustrates one example of a UE 116, various changes may be made to FIG. 3. For example, various components in FIG. 3 could be combined, further subdivided, or omitted and additional components could be added according to particular needs. Also, while FIG. 3 illustrates the UE 116 operating as a mobile telephone, UEs could be configured to operate as other types of mobile or stationary devices.

FIGS. 4 through 41 illustrate example circularly polarized patch antennas and antenna arrays using angled feed lines according to this disclosure. Various conventional patch antennas that support circular polarization (CP) or dual linear polarization (LP) have been developed over the years. These antennas can be useful in space-based and terrestrial-based applications that rely on CP or dual LP antennas to reduce polarization mismatches caused by unpredictable motion of communication terminals.

Unfortunately, many conventional CP or dual LP antennas exhibit very low impedance bandwidths and very low axial ratio bandwidths. One conventional approach to solving this problem uses a thick air or foam substrate between the conductive patch and the ground plane of an antenna, but this approach is not practical for low-cost mass production. Another conventional approach uses multiple feeds for exciting a single antenna. However, this typically involves using a multi-layer feeding network that increases the size, complexity, and cost of the antenna while reducing antenna efficiency. This approach also typically cannot be used with scanning array antennas. Still other conventional approaches use features such as artificial ground planes, patch slot shaping, and exotically-shaped patches, none of which is practical for low-cost mass production. The various patch antennas and antenna arrays shown in FIGS. 4 through 41 help to overcome these or other problems with conventional patch antennas.

Figure 4:
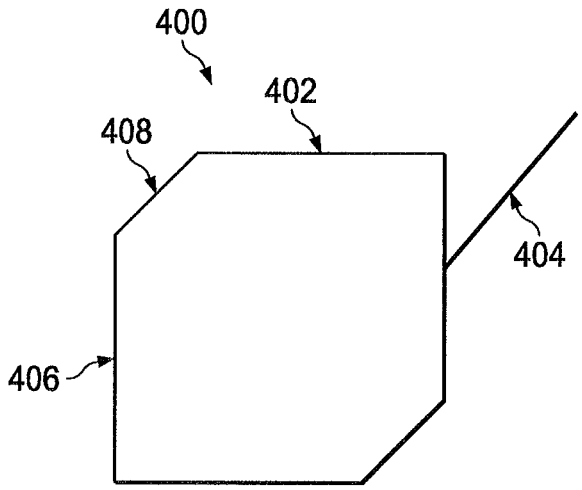

As shown in FIG. 4, a patch antenna 400 includes a patch element 402 and a microstrip line 404. The patch element 402 generally represents a conductive structure that resides over a ground plane (not shown). The patch element 402 represents the portion of the antenna 400 that radiates outgoing wireless signals and receives incoming wireless signals. The microstrip line 404 generally represents a conductive line that feeds electrical signals to the patch element 402 and receives electrical signals from the patch element 402. Note that the term "microstrip" does not imply any particular size limitation (such as one or several micrometers) and merely denotes a small width.

The patch element 402 here is generally square or rectangular with four generally straight edges 406. However, the patch element 402 is truncated, meaning at least one corner 408 of the patch element 402 have been notched or faceted. The patch element 402 is therefore referred to as a "corner truncated" patch.

The patch element 402 and the microstrip line 404 could be formed from any suitable material(s), such as one or more metals or other conductive material(s). Also, the patch element 402 and the microstrip line 404 could be formed in any suitable manner, and the patch element 402 and the microstrip line 404 could be formed during the same fabrication steps or during different fabrication steps. In addition, the patch element 402 and the microstrip line 404 could each have any suitable size and shape, and the notch(es) in the corner(s) 408 of the patch element 402 could have any suitable size and shape.

As shown in FIG. 4, the microstrip line 404 feeds the patch element 402 at a non-perpendicular angle, meaning an angle that is not 90°. For this reason, the microstrip line 404 is said to be "tilted" with respect to the side of the patch element 402. In this example, the microstrip line 404 feeds the patch element 402 at an angle of exact or substantially 45°. Also, the microstrip line 404 connects to the patch element 402 at a point that is "spaced apart" from all corners of the patch element 402, meaning there is a physical separation of the microstrip line's connection point from the corners of the patch element 402. The microstrip line 404 can be tilted toward either end of the edge 406 to which it is connected, and the microstrip line 404 can be connected to any edge 406 of the patch antenna 400 with a truncated corner 408 on its left or right side for different circular polarizations.

Figure 5A:
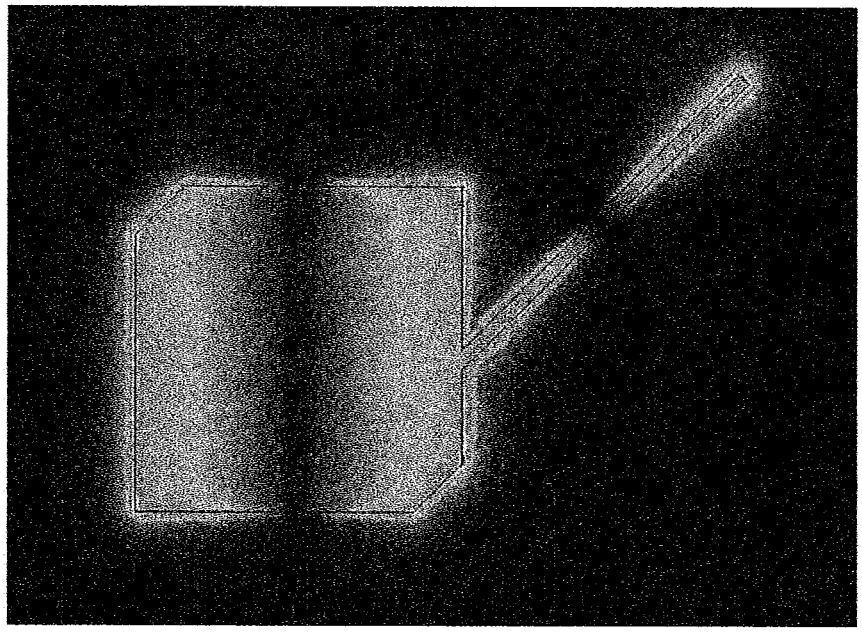
Figure 5:
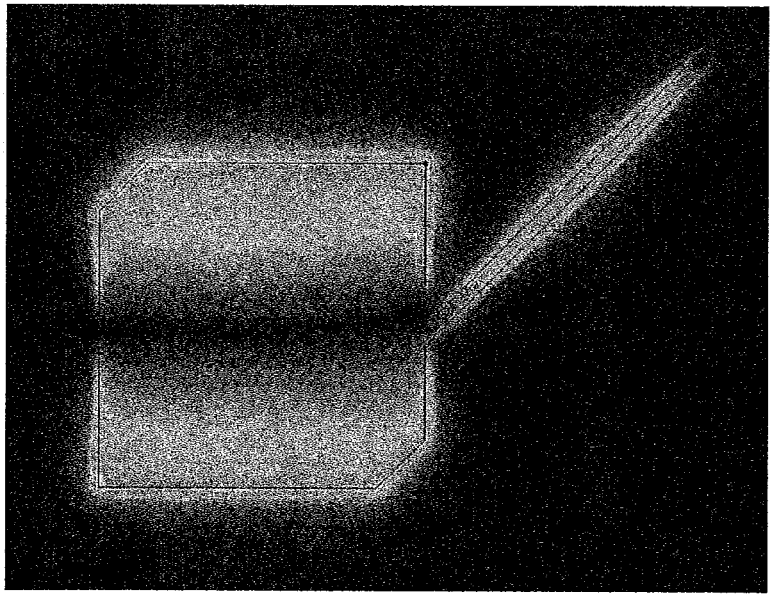

FIGS. 5A and 5B illustrate two radiating states of the patch antenna 400. As can be seen here, the patch antenna 400 is able to radiate with electric fields in multiple directions.

Figure 6:
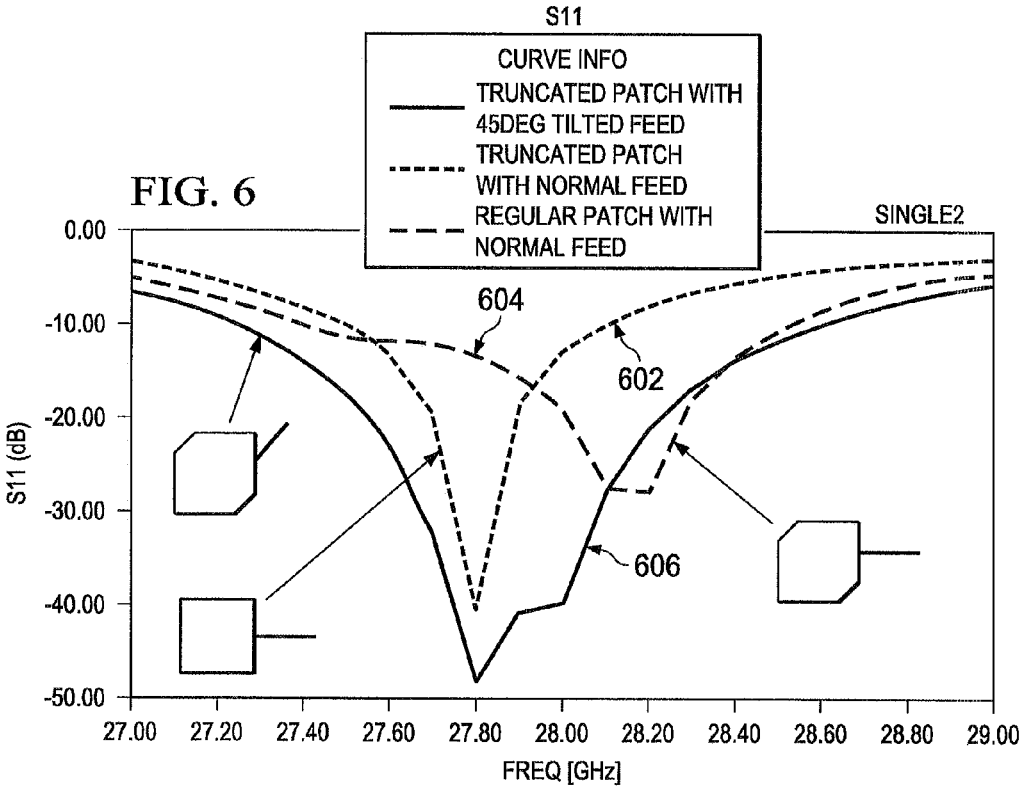

An impedance bandwidth (S11) comparison between the patch antenna 400 and two conventional patch antennas is shown in FIG. 6. In FIG. 6, a line 602 represents the impedance bandwidth of a square patch antenna without corner truncation and a microstrip line feeding the patch at 90°. A line 604 represents the impedance bandwidth of a square patch antenna with corner truncation and a microstrip line feeding the patch at 90°. A line 606 represents the impedance bandwidth of the patch antenna 400. As can be seen here, the patch antenna 400 shows significantly improved bandwidth (1.3 GHz or 4.7% for S11<−10 dB) compared to the bandwidths of the other patch antennas (without corner truncation, 0.5 GHz or 1.8%; with corner truncation, 1.08 GHz or 3.9%). As a result, the patch antenna 400 can achieve larger bandwidths with improved impedance matching. Also, the best matching point of the square patch with corner truncation cannot be centered within its bandwidth without degrading its axial ratio (AR) performance.

Figure 7:
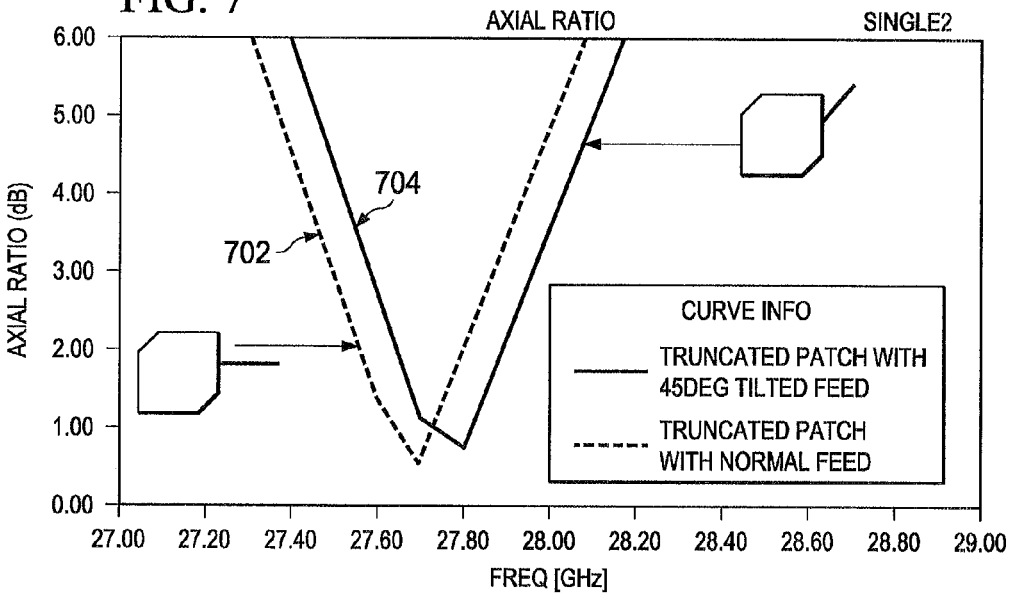

A boresight AR comparison between the patch antenna 400 and a conventional patch antenna is shown in FIG. 7. In FIG. 7, a line 702 represents the axial ratio of a square patch antenna with corner truncation and a microstrip line feeding the patch at 90°. A line 704 represents the axial ratio of the patch antenna 400. Here, the AR bandwidth is very similar for both antennas (0.37 GHz or 1.3%). However, the AR bandwidth of the patch antenna 400 as shown by the line 704 in FIG. 7 is centered around 27.8 GHz, as is its S11 bandwidth as shown by the line 606 in FIG. 6. The corner truncated patch with a 90° feed angle exhibits frequency misalignment between its S11 bandwidth and its AR bandwidth as shown by lines 604 and 702 in FIGS. 6 and 7.

Multiple patch elements can be easily connected via half-wavelength lines to form a series-resonant structure, which can be used as an antenna array. In these embodiments, one patch element is fed along one of its sides, and that patch element can feed another patch element along its opposite side. Either left-hand circular polarization (LHCP) or right-hand circular polarization (RHCP) can be obtained by using corresponding patch elements.

Figure 8:
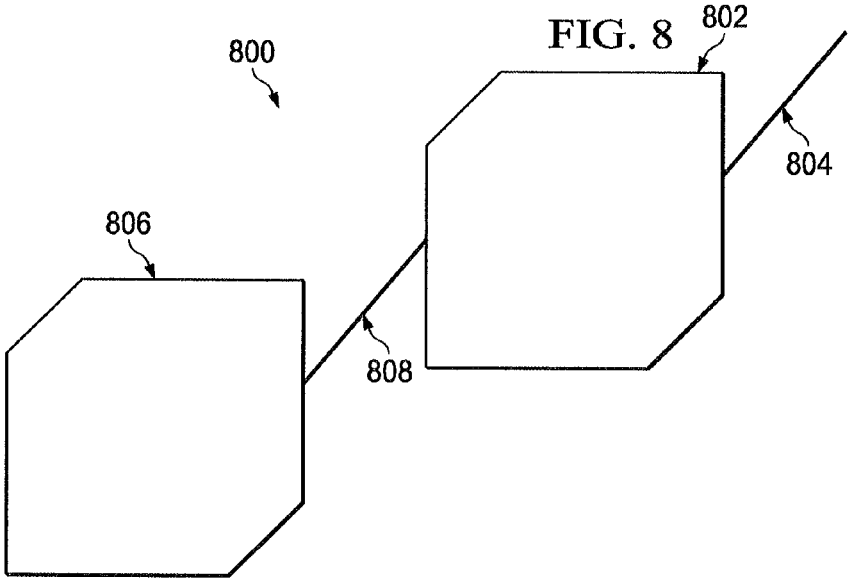

An example of this is shown in FIG. 8, where a patch antenna 800 includes a first patch element 802 and a first microstrip line 804 feeding the first patch element 802. These components 802-804 may be the same as or similar to the corresponding components 402-404 in FIG. 4.

The patch antenna 800 also includes a second patch element 806 coupled to the first patch element 802 by a second microstrip line 808. These components 806-808 may be the same as or similar to the corresponding components 802-804, although the patch elements 802 and 806 could have different sizes or shapes and the microstrip lines 804 and 808 could have different lengths. The microstrip lines 804, 808 here are tilted at exactly or substantially 45° with respect to the patch elements 802, 806 they are feeding.

Figure 9A:
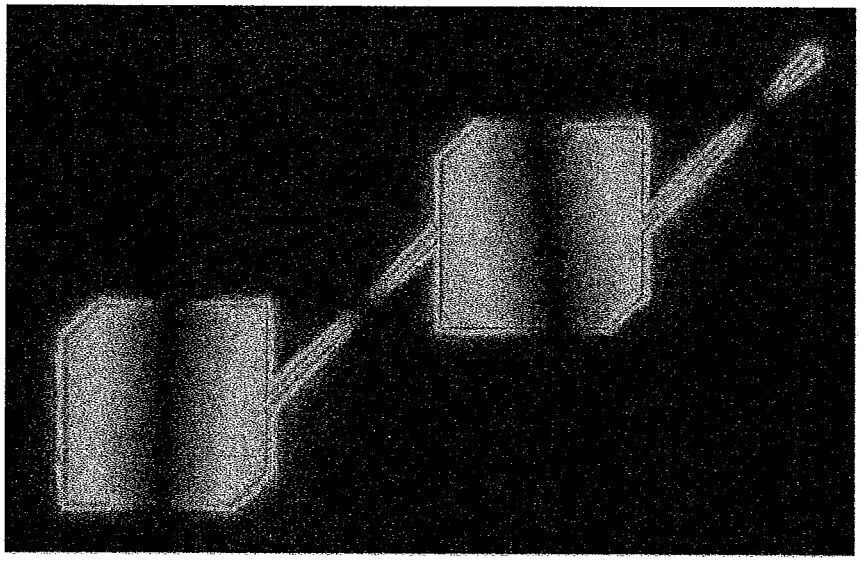
Figure 9B:
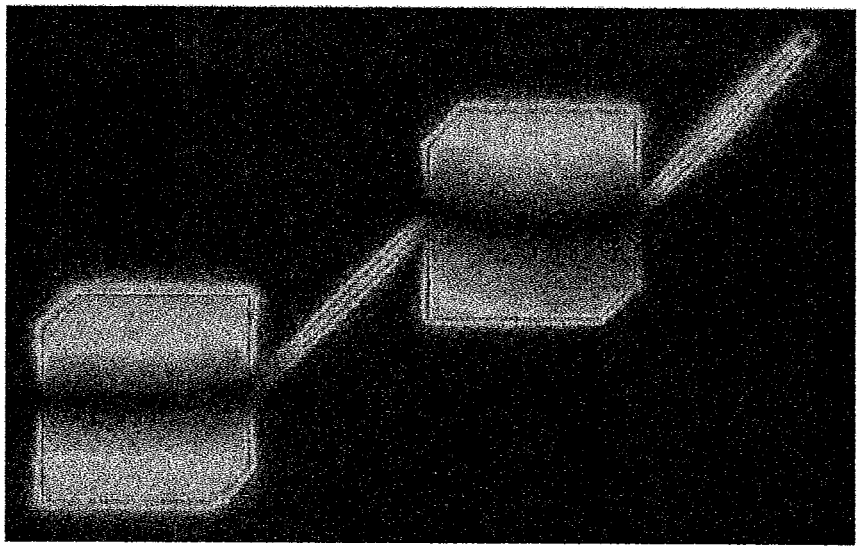

In this configuration, the antenna 800 can be viewed as a two-element series-coupled CP antenna array. FIGS. 9A and 9B illustrate two radiating states of the patch antenna 800. The patch elements 802, 806 resonate in phase via the half-wavelength microstrip line 808, allowing the CP characteristic to remain.

Figure 10:
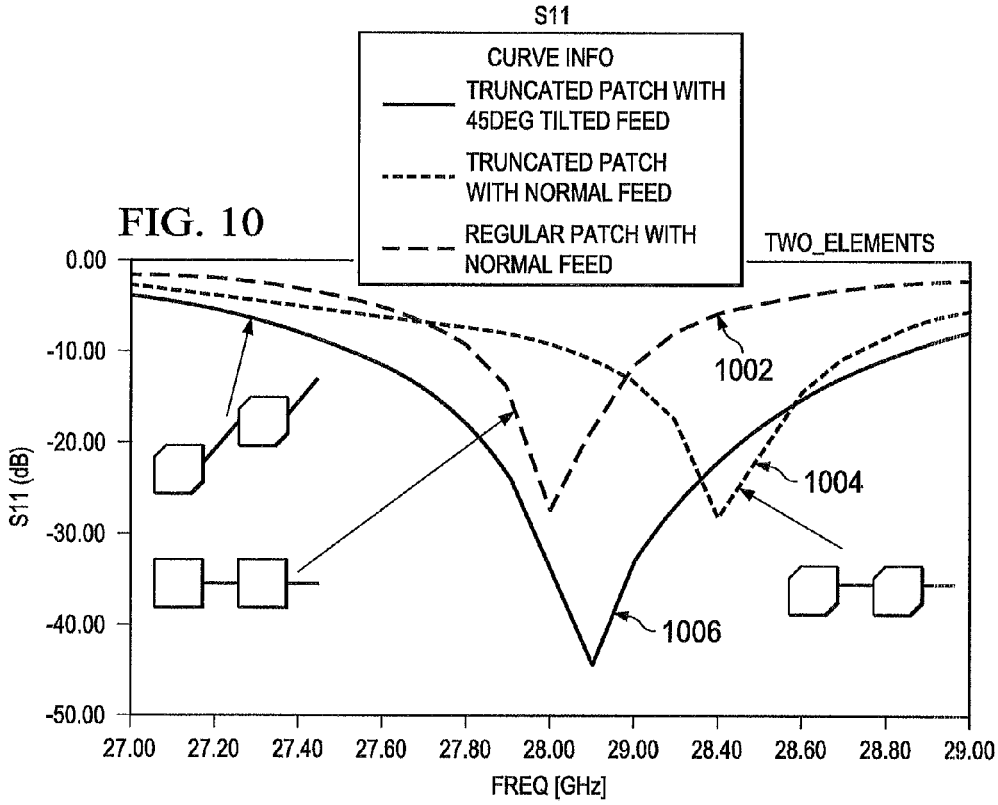

An S11 comparison between the patch antenna 800 and two conventional patch antennas is shown in FIG. 10. In FIG. 10, a line 1002 represents the impedance bandwidth of a series-coupled two-element LP patch array with a 90° feed. A line 1004 represents the impedance bandwidth of a series-coupled two-element CP patch array with a 90° feed. A line 1006 represents the impedance bandwidth of the patch antenna 800. As can be seen in FIG. 10, the patch antenna 800 maintains the bandwidth improvements of the single-element embodiment from FIG. 4 (1.24 GHz or 4.4%). Line 1004 shows that the bandwidth of the 90°-fed corner truncated patch array shrinks significantly (0.6 GHz or 2.1%). Line 1002 shows that the bandwidth of the 90°-fed non-corner truncated patch array still has a very narrow bandwidth (0.39 GHz or 1.4%).

Figure 11:
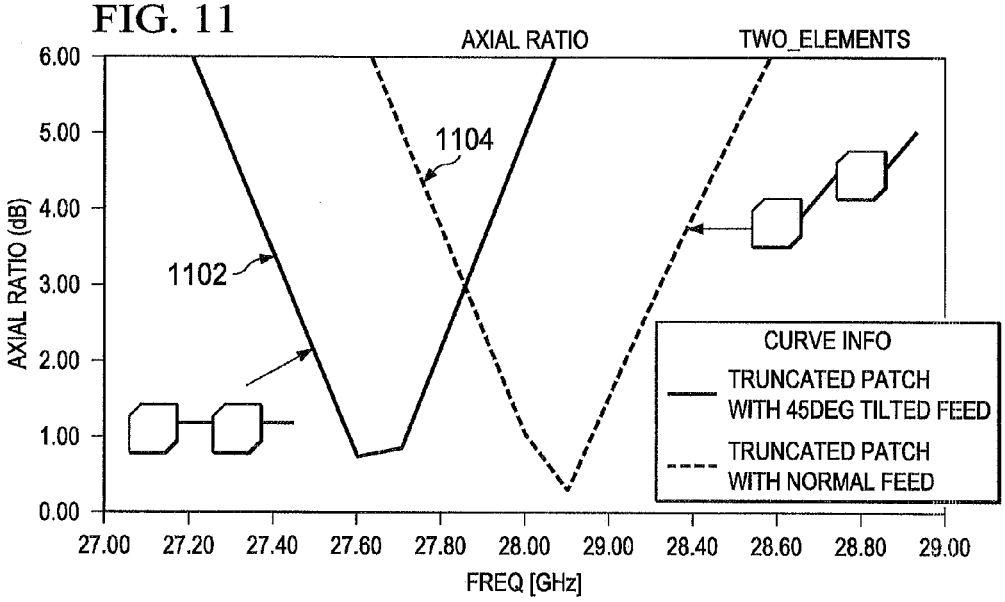

A boresight AR comparison between the patch antenna 800 and a conventional patch antenna is shown in FIG. 11. In FIG. 11, a line 1102 represents the axial ratio of a series-coupled two-element CP patch array with a 90° feed. A line 1104 represents the axial ratio of the patch antenna 800. Compared to the single-element embodiment from FIG. 4, the series-coupled two-element embodiment of FIG. 8 has an improved AR bandwidth (0.46 GHz or 1.6%). The line 1102, however, shows that the series-coupled two-element CP patch array with a 90° feed has a severe misalignment between its impedance bandwidth in FIG. 10 and its AR bandwidth in FIG. 11.

In general, by connecting corner-truncated patch elements using feed lines tilted at substantially 45° for CP radiation, this helps to reduce or eliminate any predominant radiating edges of the patch elements. This provides an antenna with a much more natural CP resonance compared with prior approaches. Moreover, redundant feed lines for connecting patch elements can be replaced with simpler half-wavelength microstrip lines between patch elements, which significantly reduces the antenna size and increases the radiation efficiency of the antenna. This opens up an avenue for creating series-coupled CP patch arrays that are practical and exhibit much wider bandwidths compared to conventional LP counterparts.

Figure 12:
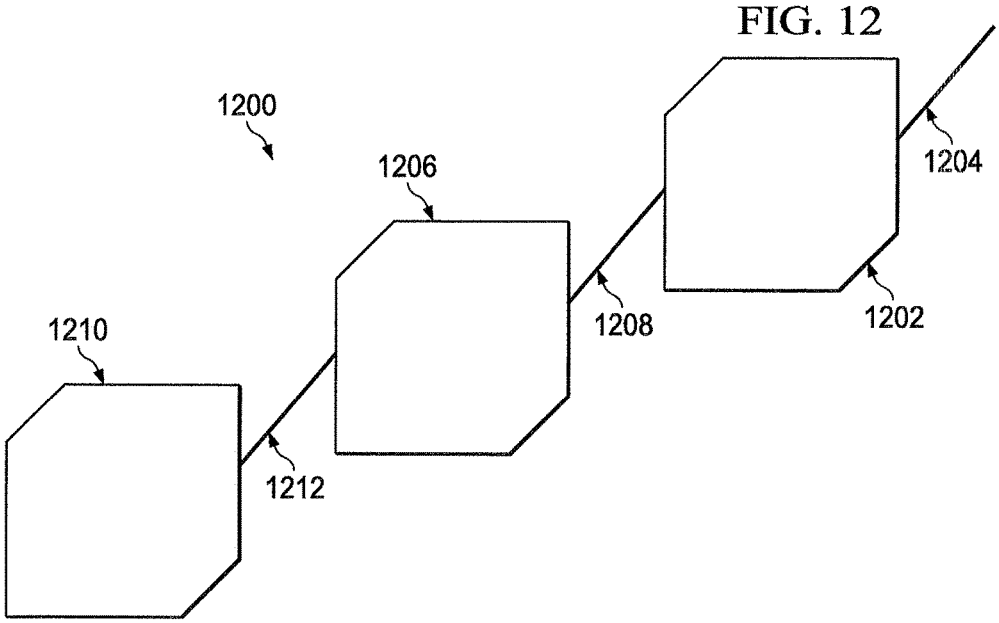

The number of series-coupled patch elements can be increased to any suitable number of elements. For example, as shown in FIG. 12, a patch antenna 1200 includes a first patch element 1202, a first microstrip line 1204, a second patch element 1206, and a second microstrip line 1208. The patch antenna 1200 also includes a third patch element 1210 coupled to the second patch element 1206 by a third microstrip line 1212. The patch elements and microstrip lines here could be the same as or similar to those in FIG. 8. The microstrip lines 1204, 1208, 1212 are tilted at exactly or substantially 45° with respect to the patch elements they are feeding.

Figure 13A:
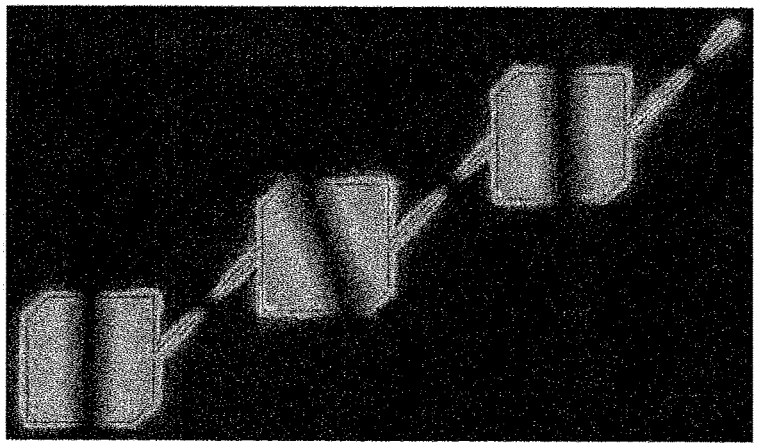
Figure 13B:
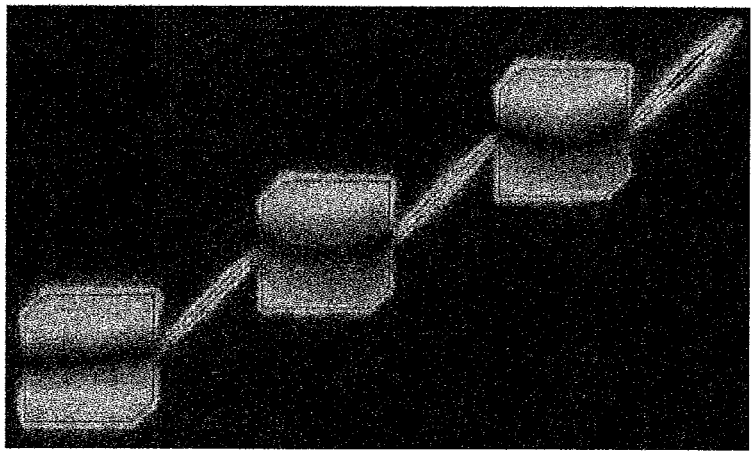

In this configuration, the antenna 1200 could be viewed as a three-element series-coupled CP antenna array. FIGS. 13A and 13B illustrate two radiating states of the patch antenna 1200. The patch elements 1202, 1206, 1210 resonate in phase via the half-wavelength microstrip lines 1208, 1212.

Figure 14:
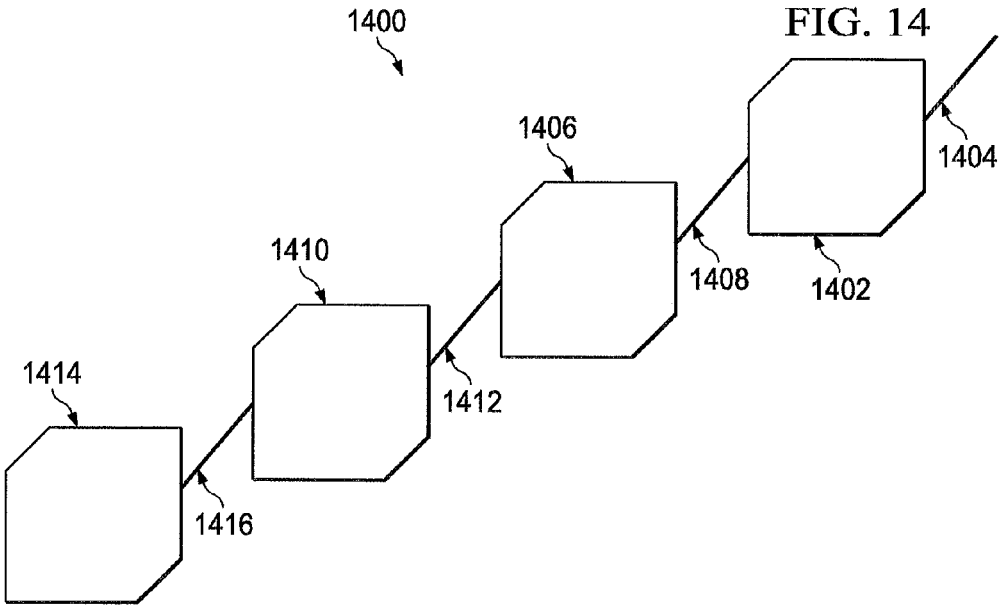

As shown in FIG. 14, a patch antenna 1400 includes components 1402-1412, which can be the same as or similar to the corresponding components in FIG. 12. The patch antenna 1400 also includes a fourth patch element 1414 coupled to the third patch element 1410 by a fourth microstrip line 1416. The microstrip lines 1404, 1408, 1412, 1416 are tilted at exactly or substantially 45° with respect to the patch elements they are feeding.

Figure 15A:
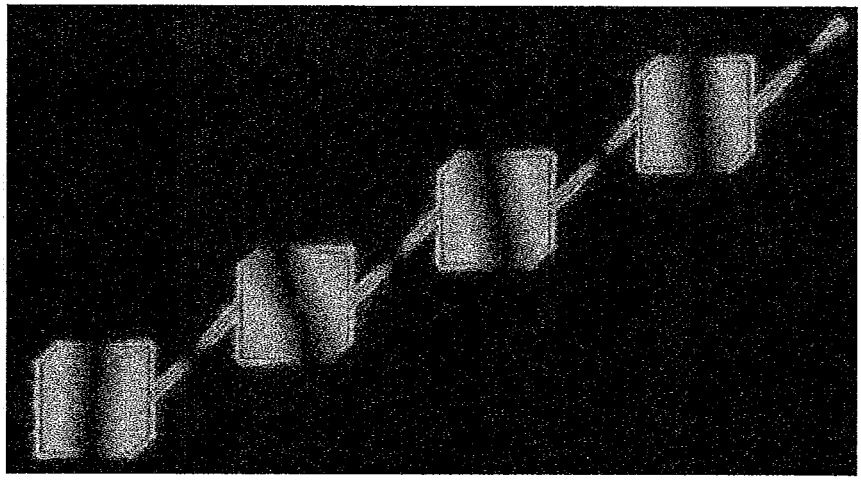
Figure 15B:
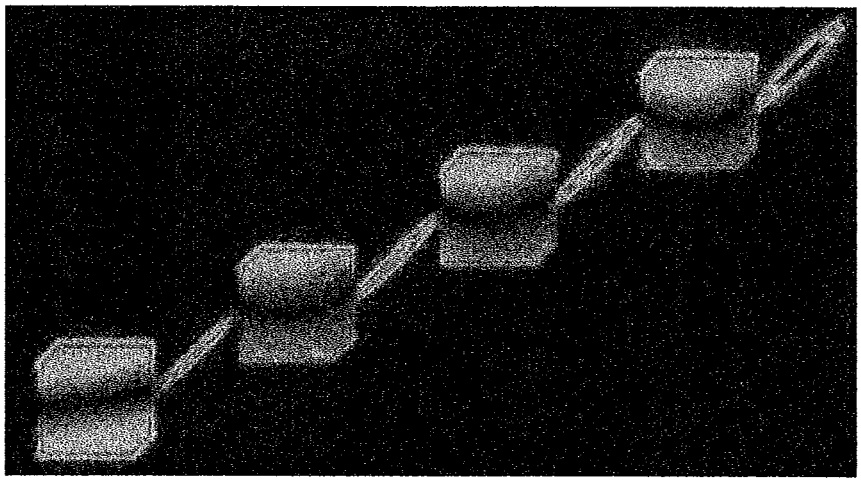

In this configuration, the antenna 1400 could be viewed as a four-element series-coupled CP antenna array. FIGS. 15A and 15B illustrate two radiating states of the patch antenna 1400. The patch elements 1402, 1406, 1410, 1414 resonate in phase via the half-wavelength microstrip lines 1408, 1412, 1416.

Figure 16:
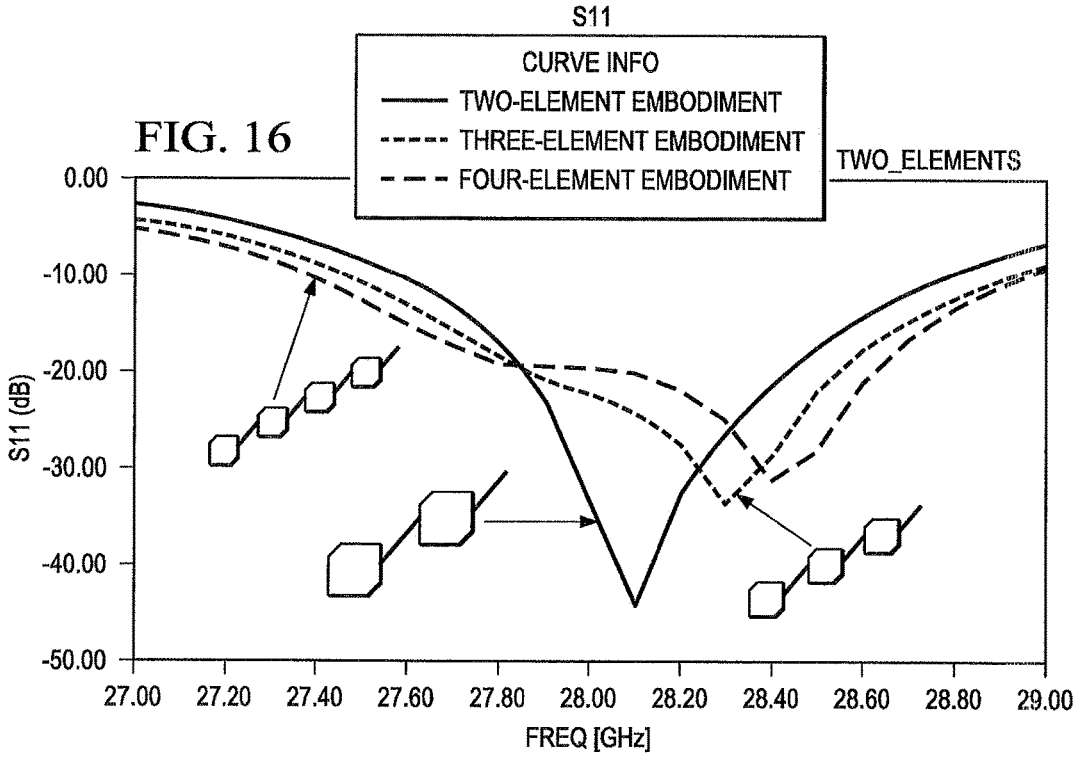
Figure 17:
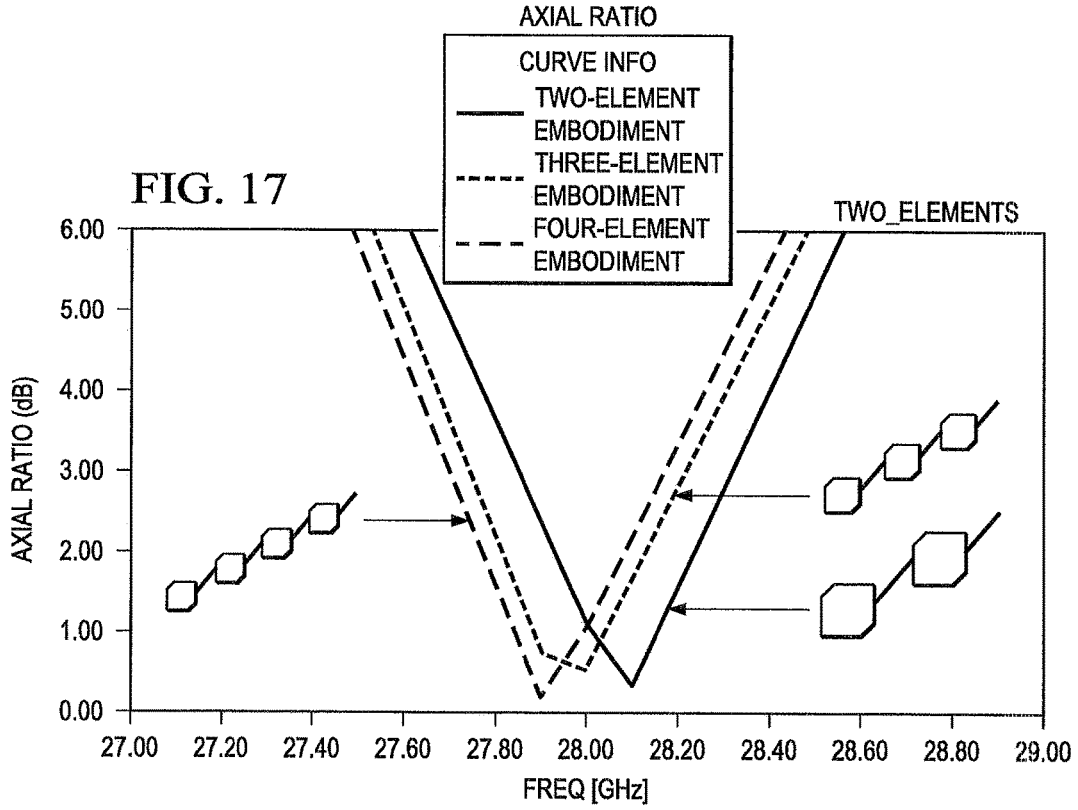
Figure 18A:
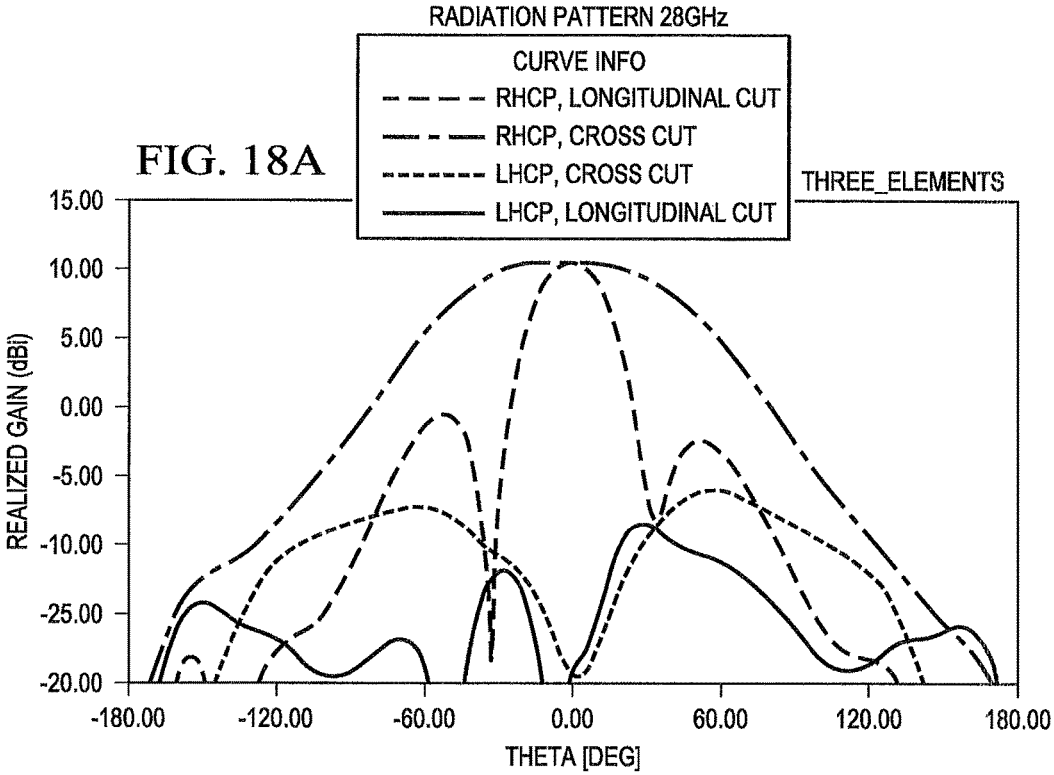
Figure 18B:
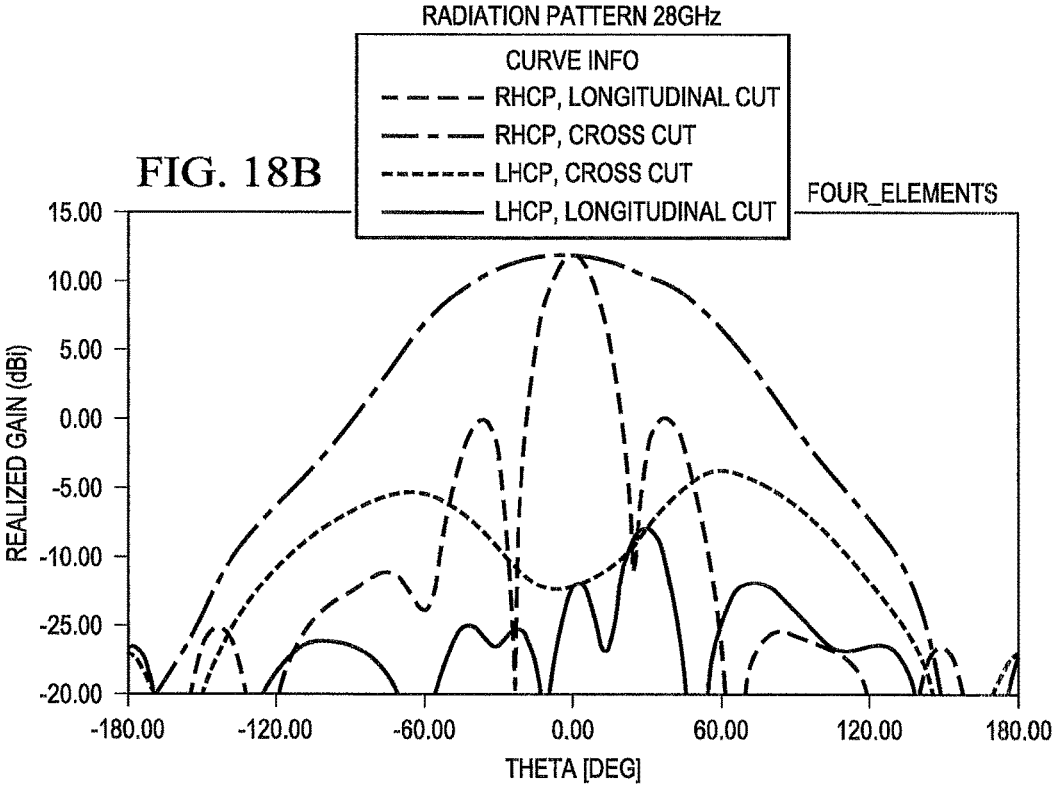

FIG. 16 compares the impedance bandwidths of the patch antennas 800, 1200, 1400, and FIG. 17 compares the AR bandwidths of the patch antennas 800, 1200, 1400. FIG. 18A illustrates the radiation pattern at 28 GHz of the patch antenna 1200, and FIG. 18B illustrates the radiation pattern at 28 GHz of the patch antenna 1400. As can be seen here, the impedance bandwidth of an antenna increases as the number of patch elements in the antenna increases. For the four-element embodiment in FIG. 14, the impedance bandwidth is 1.6 GHz or 5.6%, which is a significant improvement compared with conventional designs on a PCB substrate as thin as 2.4% λ. In contrast, the AR bandwidth remains generally the same as the number of patch elements varies. The CP radiation patterns of the antennas are generally smooth and symmetric, and the antenna gain increases as the number of patch elements increases.

In the patch antennas 800, 1200, 1400, whenever a patch element is coupled to two microstrip lines, those microstrip lines couple to the patch element on opposite sides of the patch element. This allows the patch elements to form a series-coupled array of patch elements, where one patch element feeds a signal to the next patch element. However, it is also possible to create an antenna where a host patch is coupled to a parasitic patch. A parasitic patch element represents a patch element that is flipped in the X or Y plane compared to a host patch element, meaning the truncated corners of the parasitic patch element are opposite the truncated corners of the host patch element.

Figure 19:
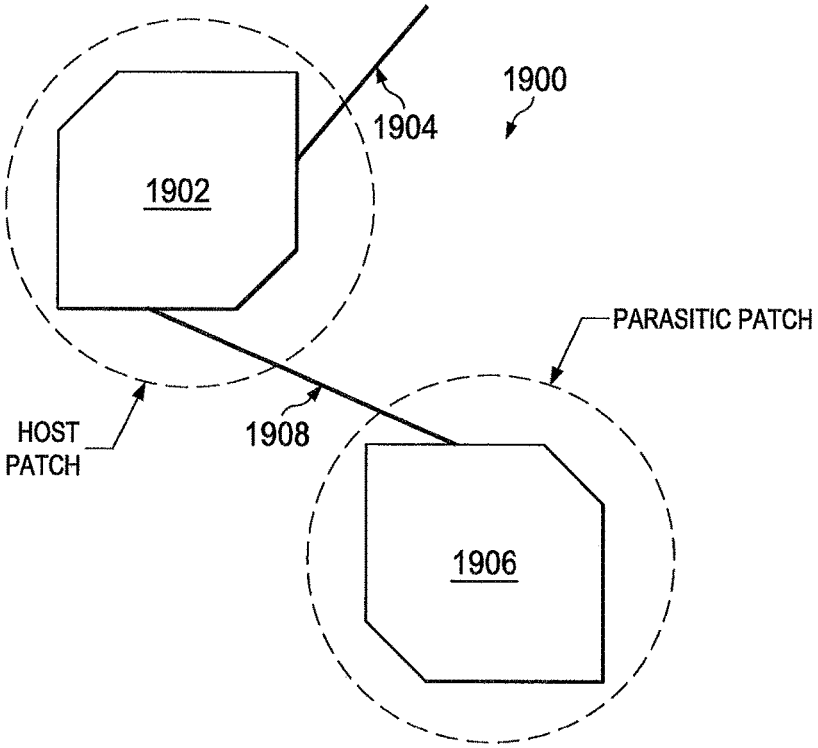

An example of this is shown in FIG. 19, where a patch antenna 1900 includes a host patch element 1902 and a microstrip line 1904 feeding the host patch element 1902. The patch antenna 1900 also includes a parasitic patch element 1906 coupled to the host patch element 1902 by a second microstrip line 1908. The microstrip lines 1904, 1908 here are tilted at exactly or substantially 45° with respect to the patch elements they are feeding, and the microstrip line 1908 is a half-wavelength line.

In this configuration, the microstrip lines 1904 and 1908 couple to the host patch element 1902 along adjacent sides of the host patch element 1902. This creates a parasitic relationship between the host patch element 1902 and the parasitic patch element 1906, rather than a simple series-coupled relationship as in FIGS. 8, 12, and 14.

Figure 20A:
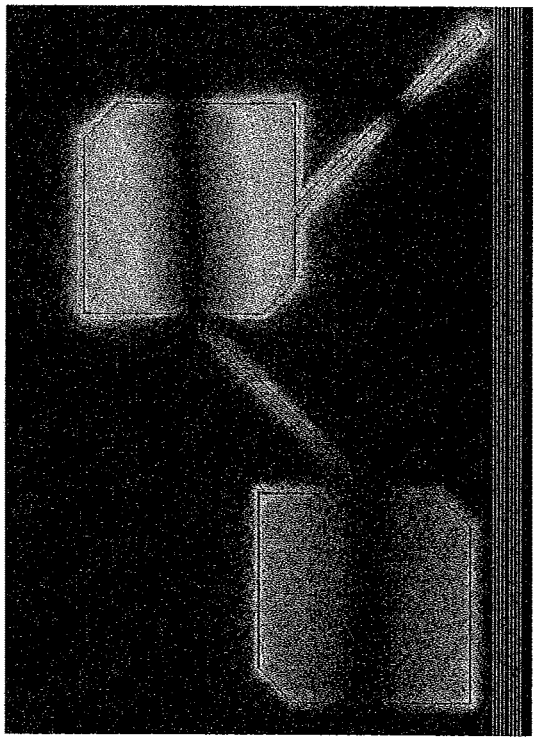
Figure 20B:
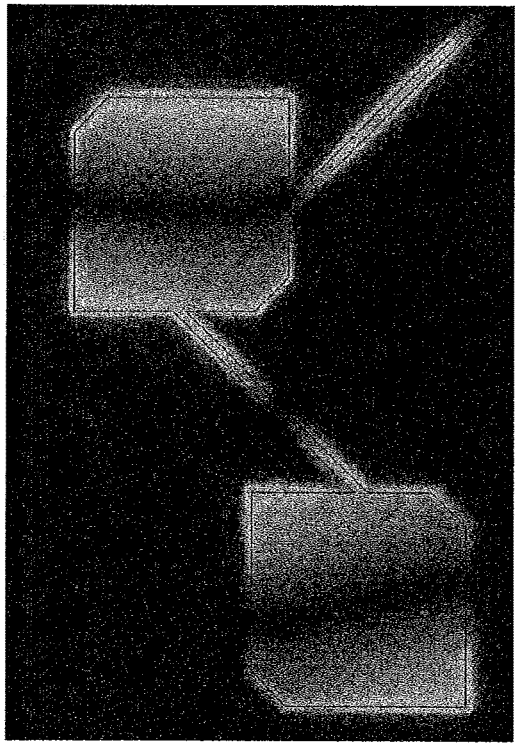

FIGS. 20A and 20B illustrate two radiating states of the patch antenna 1900. As can be seen here, radiation occurs primarily from the host patch element 1902 for part of a duty cycle (FIG. 20A), while radiation is more equally distributed between the host and parasitic patch elements 1902, 1906 for another part of the duty cycle (FIG. 20B).

Figure 21:
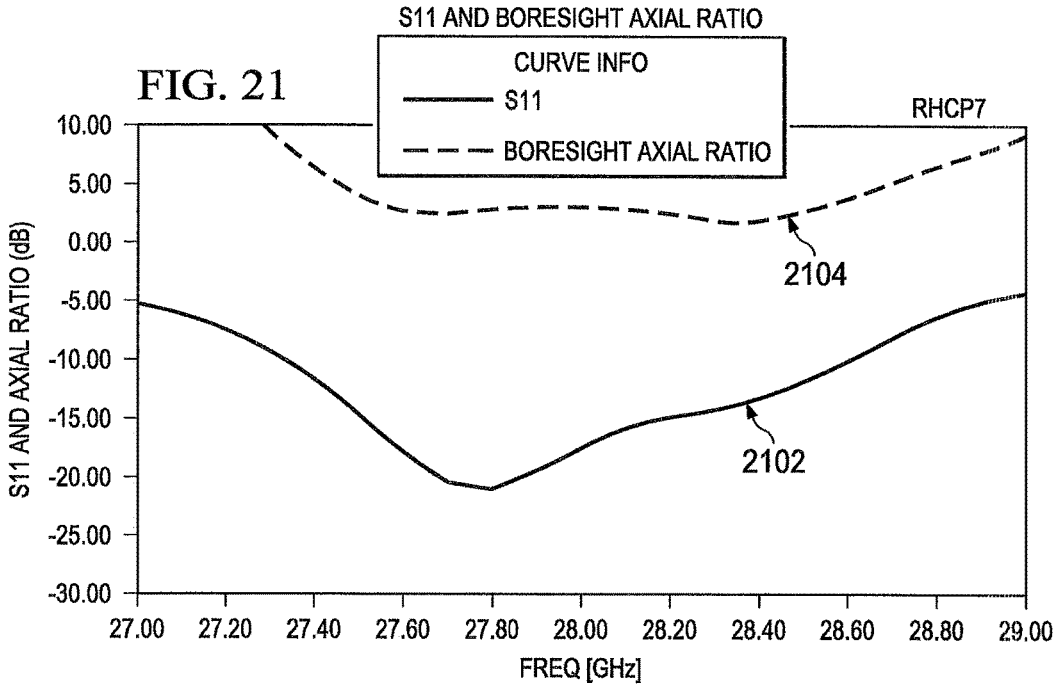
Figure 22:
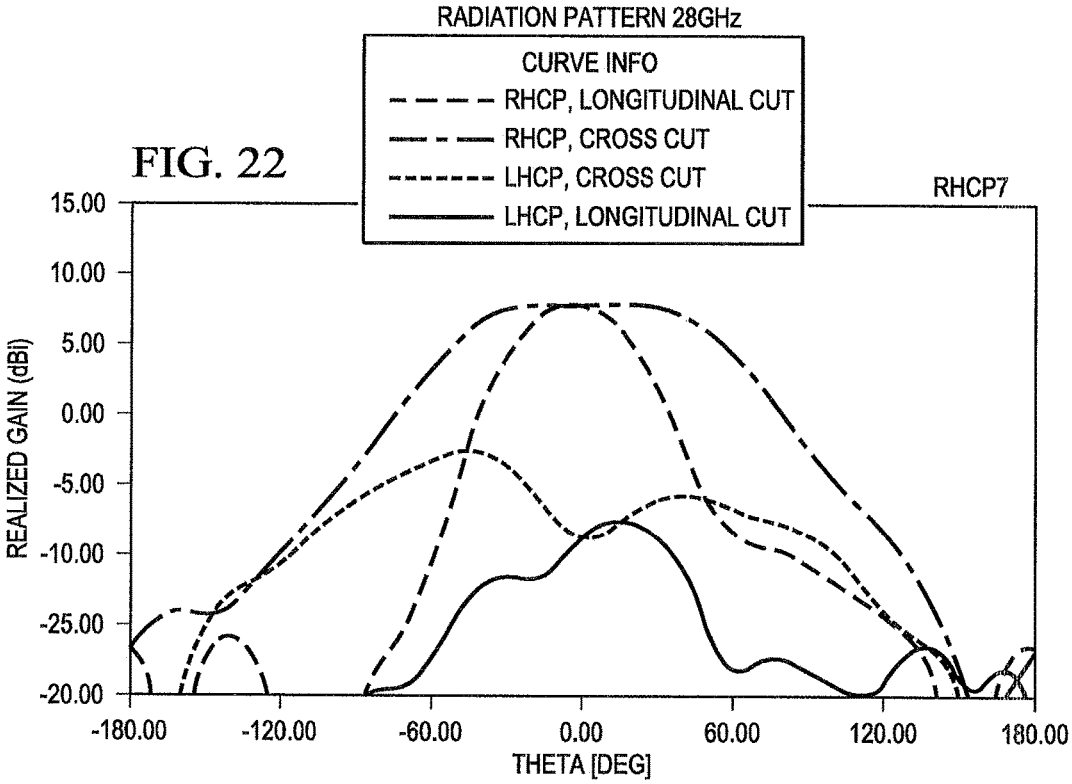

The ability to switch between different radiating states achieves a wider AR bandwidth as shown in FIG. 21, where a line 2102 represents the impedance bandwidth of the antenna 1900 and a line 2104 represents the AR bandwidth of the antenna 1900. As seen here, a 1 GHz or 3.6% AR bandwidth can be obtained, which is a significant improvement over conventional approaches. Using a single-layer 2.4% λ substrate, this AR bandwidth had previously been deemed impossible unless a multi-feed network is employed. Note that for this specific case, the AR performance is not fine-tuned, and a slight AR bandwidth improvement could be expected with better tuning. The radiation pattern of the antenna 1900 at 28 GHZ is shown in FIG. 22.

Figure 23:
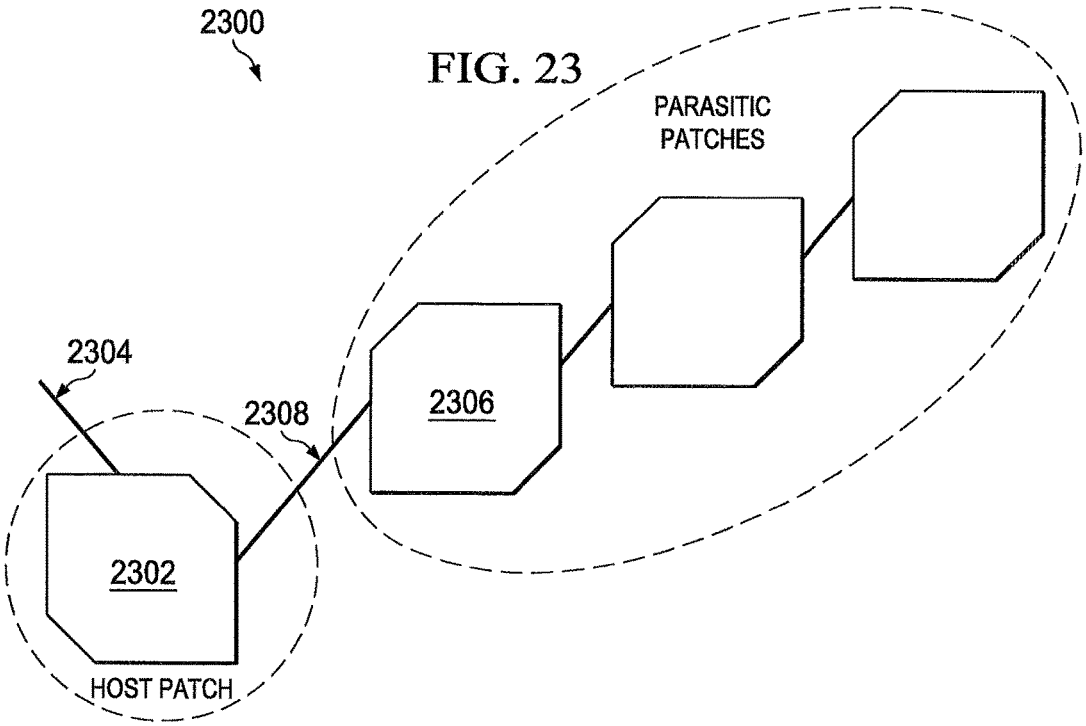

The use of parasitic patch elements can be extended in a number of ways. For example, more than one parasitic patch element can be serially connected to one side of a host patch element to achieve more radiation gain. For example, FIG. 23 illustrates a patch antenna 2300 having a host patch element 2302 that is fed using a microstrip line 2304. The patch antenna 2300 also includes three serially-connected parasitic patch elements 2306, each of which is coupled to the host patch element 2302 or a preceding parasitic patch element 2306 by a microstrip line 2308. The microstrip lines 2304, 2308 here are tilted at exactly or substantially 45° with respect to the patch elements they are feeding.

Figure 24:
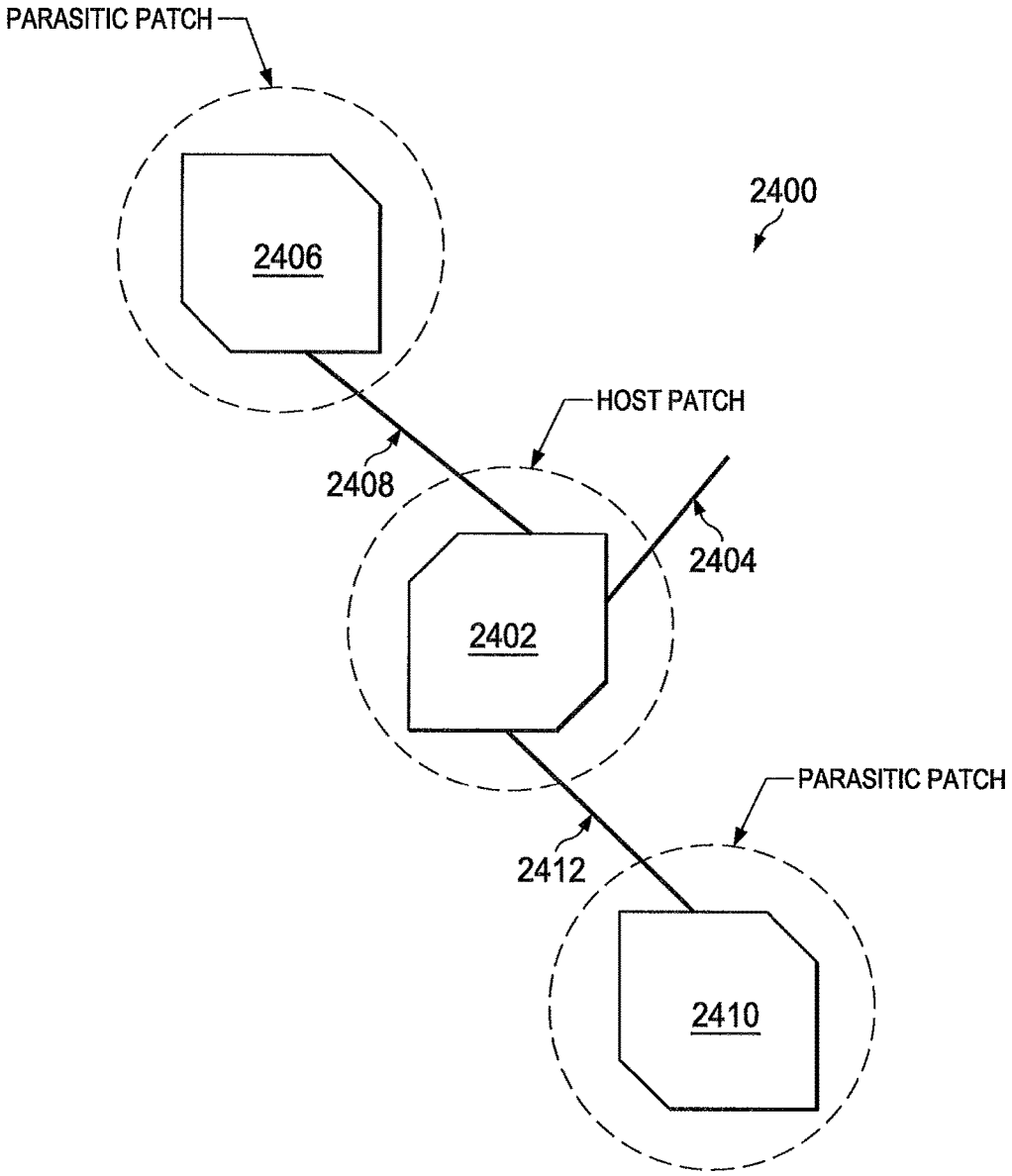

Parasitic patch elements can also be coupled to multiple sides of a host patch element. For example, FIG. 24 illustrates a patch antenna 2400 having a host patch element 2402 fed by a microstrip line 2404. The patch antenna 2400 also has two parasitic patch elements. One parasitic patch element 2406 is coupled to one side of the host patch element 2402 by a microstrip line 2408, and another parasitic patch element 2410 is coupled to another side of the host patch element 2402 by a microstrip line 2412. Again, each microstrip line is a half-wavelength line tilted at exactly or substantially 45° with respect to the patch element it feeds.

Figure 25A:
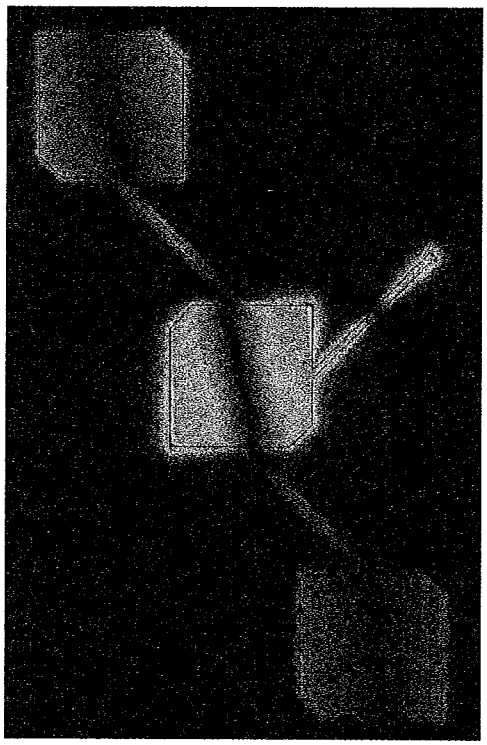
Figure 25B:
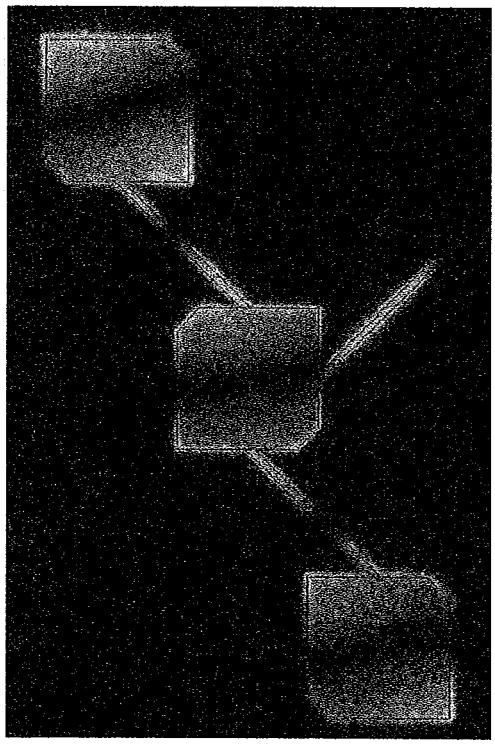

FIGS. 25A and 25B illustrate two radiating states of the antenna 2400. For part of its duty cycle, the host patch element 2402 generates most of the radiation (FIG. 25A). For another part of its duty cycle, the three patch elements 2402, 2406, 2410 radiate almost the same amount of energy (FIG. 25B).

Figure 26:
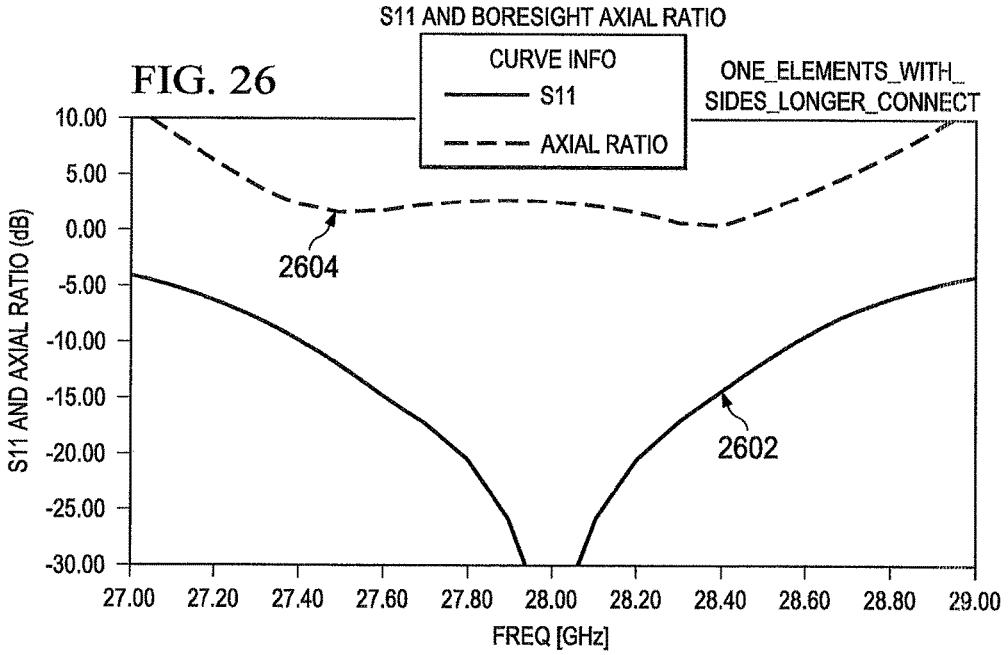
Figure 27:
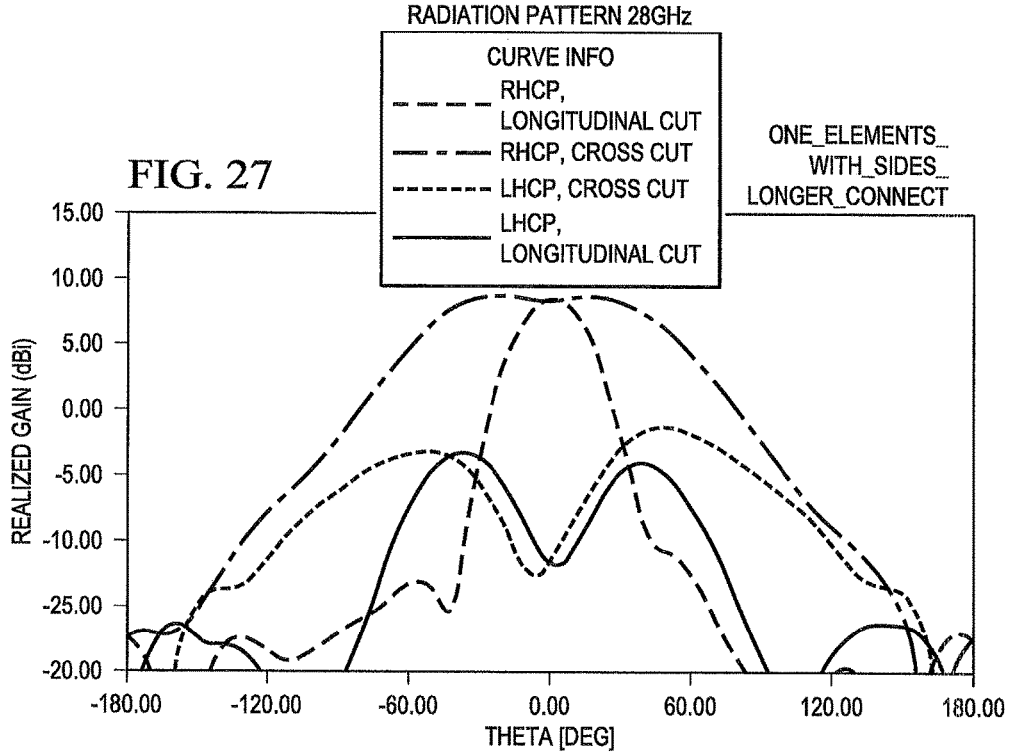

As expected, the antenna 2400 also shows significantly improved AR bandwidth as shown in FIG. 26, where a line 2602 represents the impedance bandwidth of the antenna 2400 and a line 2604 represents the AR bandwidth of the antenna 2400. A 1.23 GHz or 4.4% AR bandwidth is obtained, which is even larger than that of the embodiment shown in FIG. 19. FIG. 27 illustrates the radiation pattern of the antenna 2400 at 28 GHz.

Figure 28:
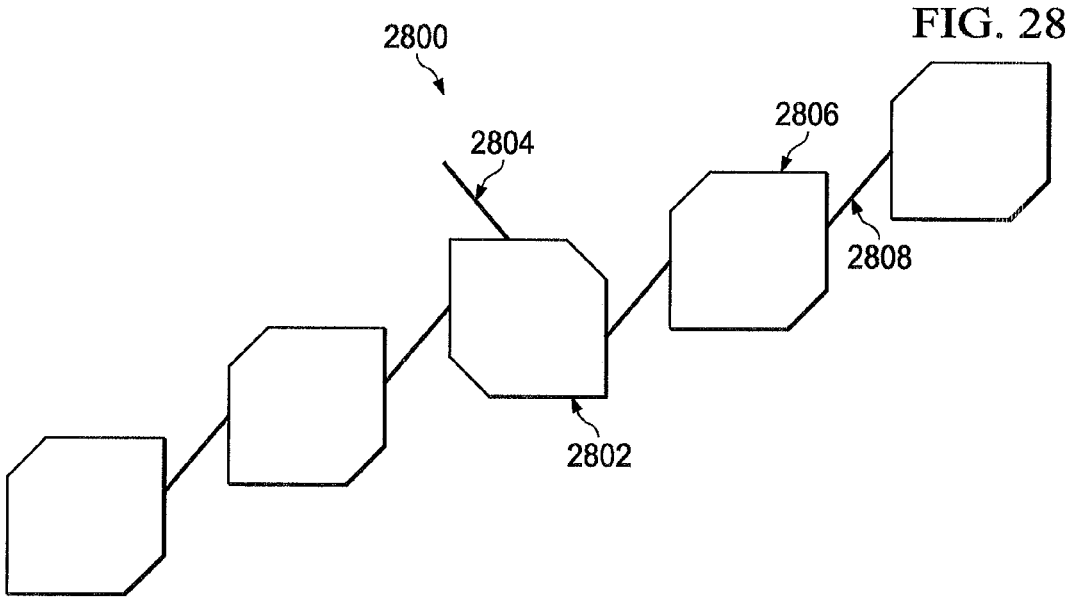

Various combinations of one or more host patch elements and multiple parasitic patch elements are also possible. For example, FIG. 28 illustrates a patch antenna 2800 with one host patch element 2802 fed by a microstrip line 2804. The patch antenna 2800 also includes four parasitic patch elements 2806, two parasitic patch elements 2806 connected serially on two opposing sides of the host patch element 2802. Each parasitic patch element 2806 is fed using a microstrip line 2808.

Figure 29:
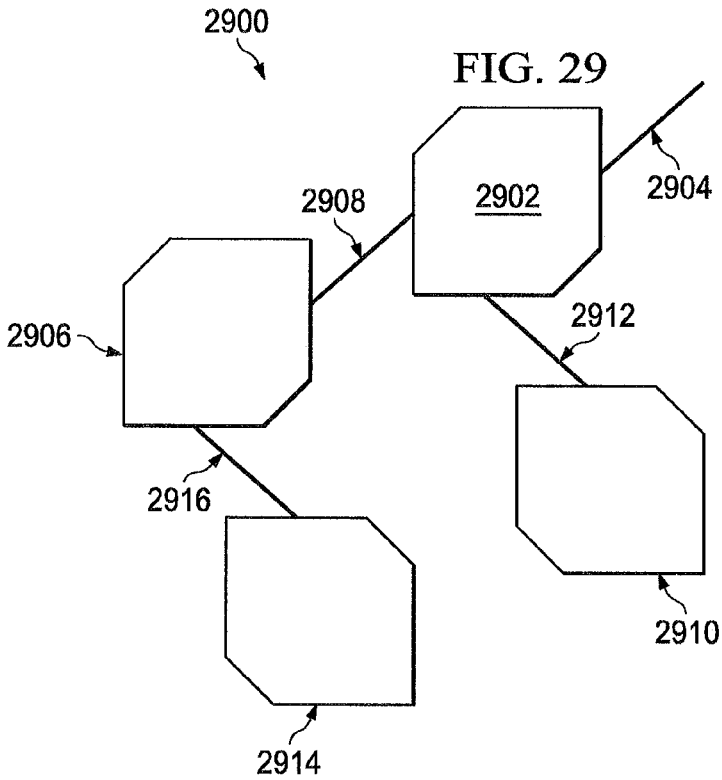

FIG. 29 illustrates a patch antenna 2900 having a first host patch element 2902 fed by a microstrip line 2904. A second host patch element 2906 is coupled in series with the first host patch element 2902 by a microstrip line 2908. The first host patch element 2902 is coupled to a first parasitic patch element 2910 by a microstrip line 2912, and the second host patch element 2906 is coupled to a second parasitic patch element 2914 by a microstrip line 2916.

Figure 30:
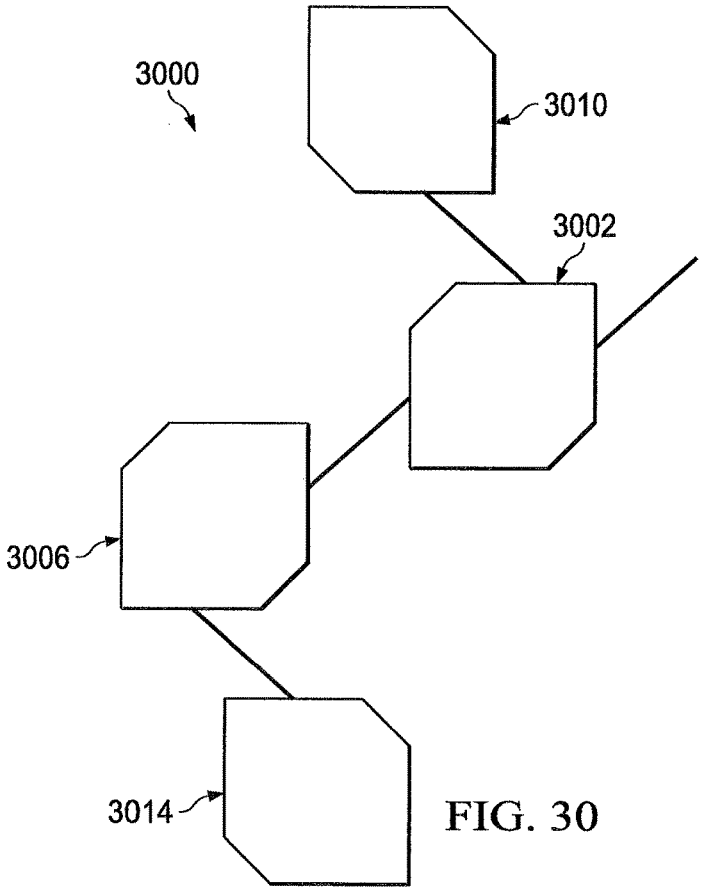

FIG. 30 discloses a similar patch antenna 3000 with two series-coupled host patch elements 3002 and 3006. Each host patch element 3002 and 3006 is coupled to a parasitic patch element 3010 and 3014, respectively. The parasitic patch elements 3010, 3014 here are arranged on opposite sides of the antenna 3000.

Figure 31:
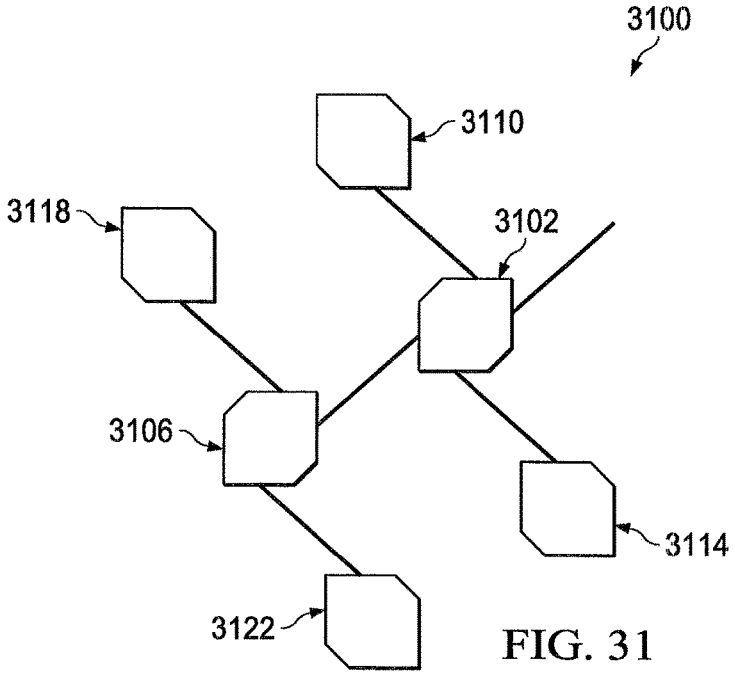

In FIG. 31, an antenna 3100 includes two series-coupled host patch elements 3102 and 3106, each coupled to two parasitic patch elements 3110, 3114 and 3118, 3122, respectively. In FIG. 32, an antenna 3200 includes three series-coupled host patch elements 3202, 3206, 3210, each coupled to two of the parasitic patch elements 3214-3234.

In general, any edge of a patch element (except the edge for feeding that patch element) can be used to connect to another patch element, regardless of whether the other patch element is a host patch element (connected on the side opposite of the feed line) or a parasitic patch element (connected on an adjacent side of the feed line). The figures described above merely represent some of the ways in which host and parasitic patch elements can be combined, and any of these or other structures can be used as sub-arrays for larger antennas.

Figure 34:
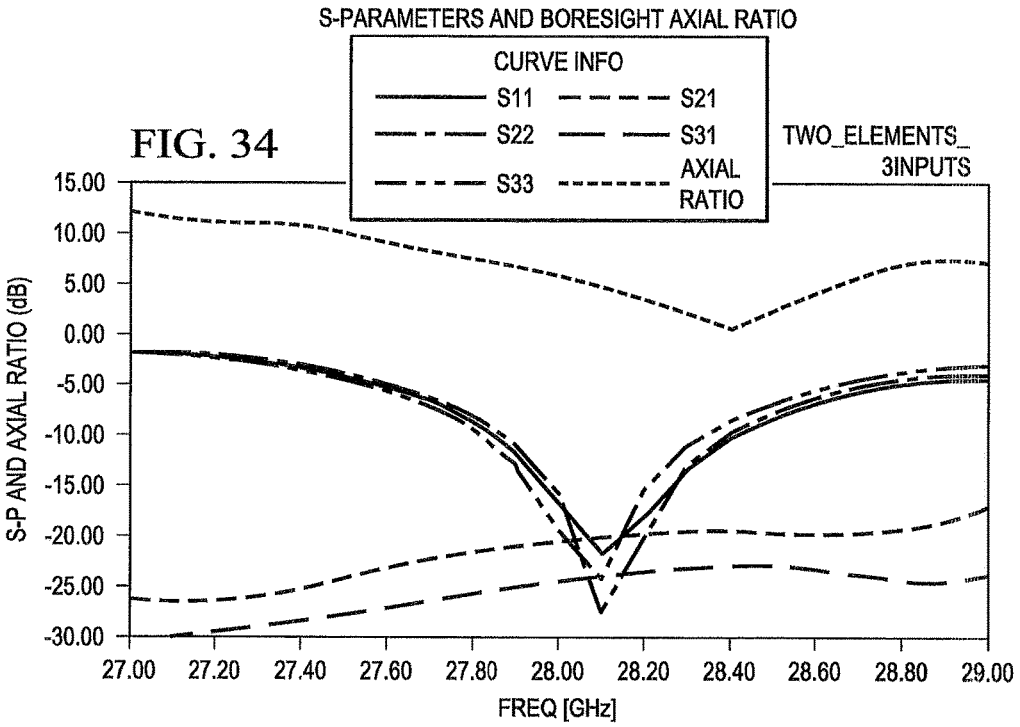
Figure 35:
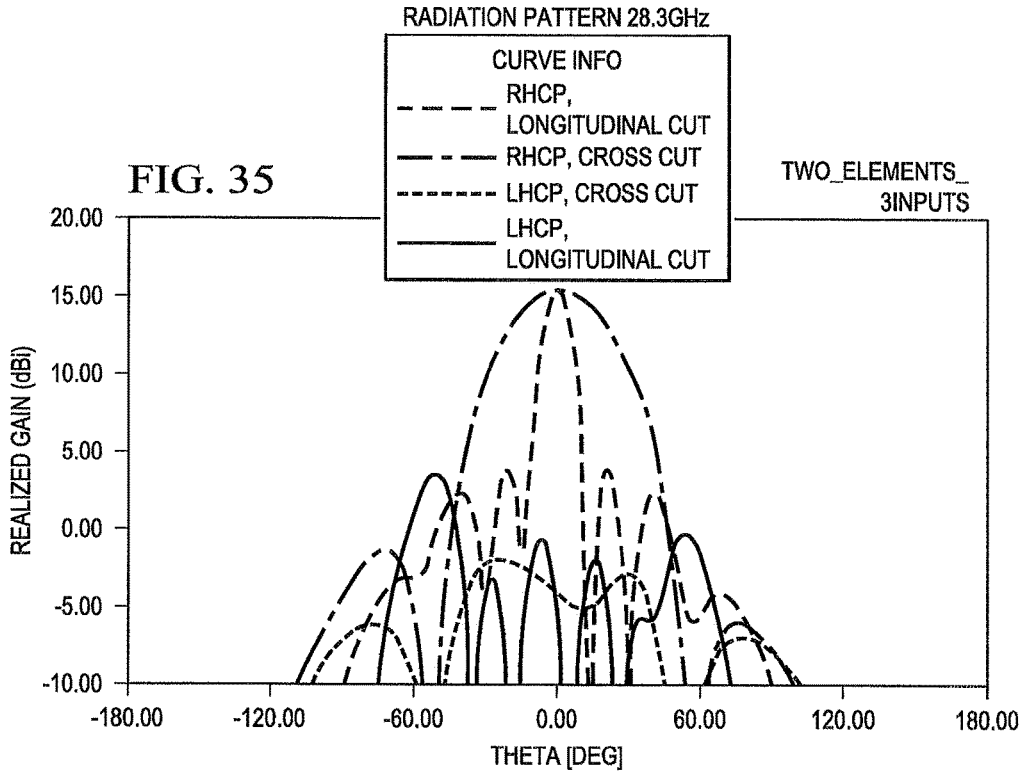

It is also possible to "reuse" elements in an antenna, such as when parasitic patch elements connected to side edges of host patch elements are serially connected to other host patch elements, forming an element-reusable array configuration. An example of this is shown in FIG. 33, where an antenna 3300 includes three subsets 3302-3306 of patch elements. Each subset 3302-3306 includes two serially-coupled host patch elements, and each host patch element is coupled to two parasitic patch elements. As can be seen here, parasitic patch elements 3308-3310 are coupled to host patch elements in subsets 3302-3304. Similarly, parasitic patch elements 3312-3314 are coupled to host patch elements in subsets 3304-3306. In a half-cycle operation, the parasitic patch elements coupled between host patch elements can be used to "lock up" electromagnetic (EM) coupling between input ports 3316-3320. This can render a very small amount of mutual coupling between the input ports 3316-3320 as shown in FIG. 34. However, this specific setup shrinks the impedance and AR bandwidths. The radiation pattern of the antenna 3300 at 28.3 GHz is shown in FIG. 35.

Figure 36:
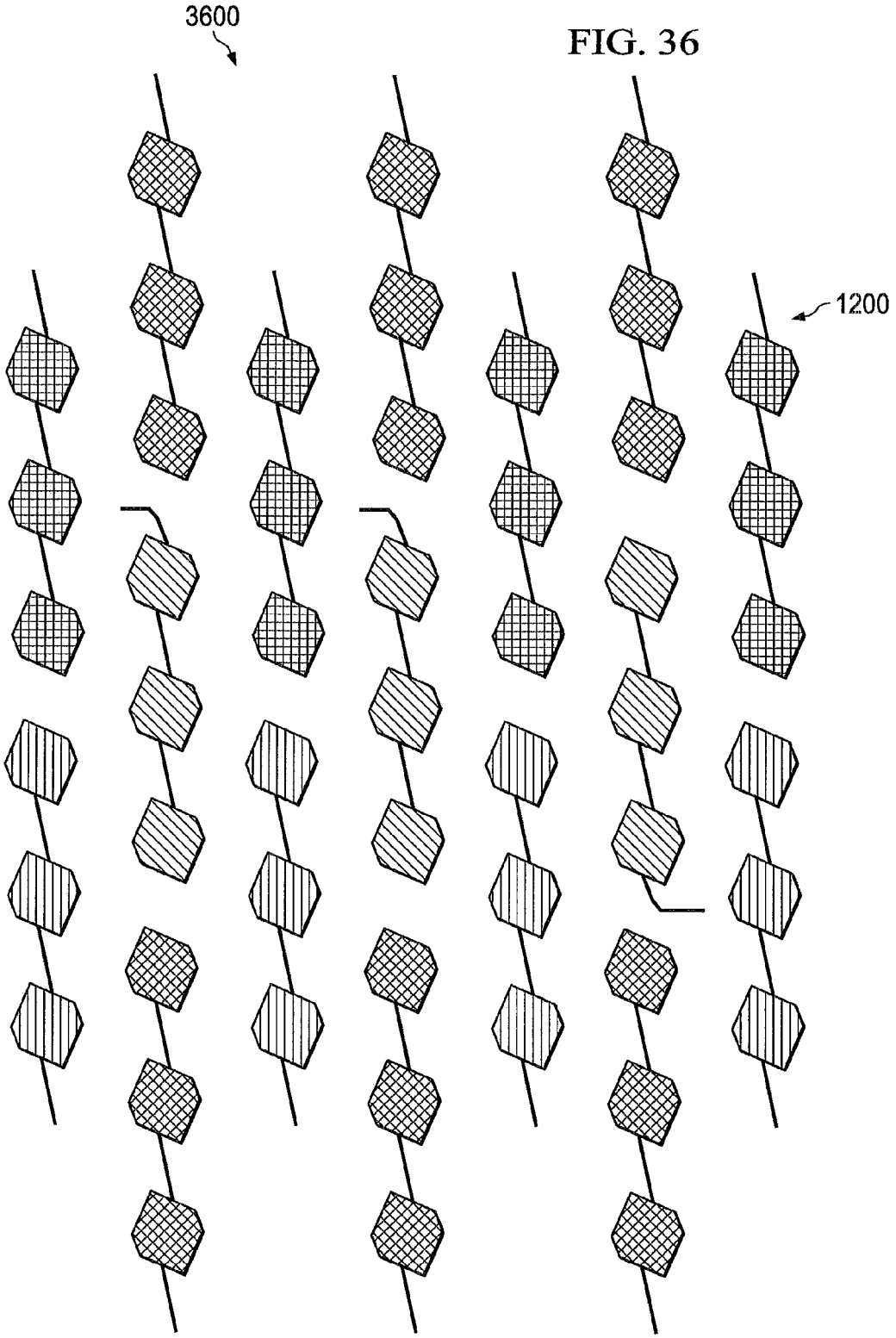

It is also possible to combine the various patch antennas described above into larger antenna arrays. For example, FIG. 36 illustrates a patch antenna array 3600, where the antenna array 3600 includes multiple patch antennas 1200. As described above, each patch antenna 1200 includes three series-coupled patch elements. The patch antennas 1200 here could represent sub-arrays for a phase-scanning array. The patch elements of the various antennas 1200 are arranged in a triangular lattice in FIG. 36, although other configurations (such as rectangular, hexagonal, circular, or linear lattices) could be used.

Figure 37:
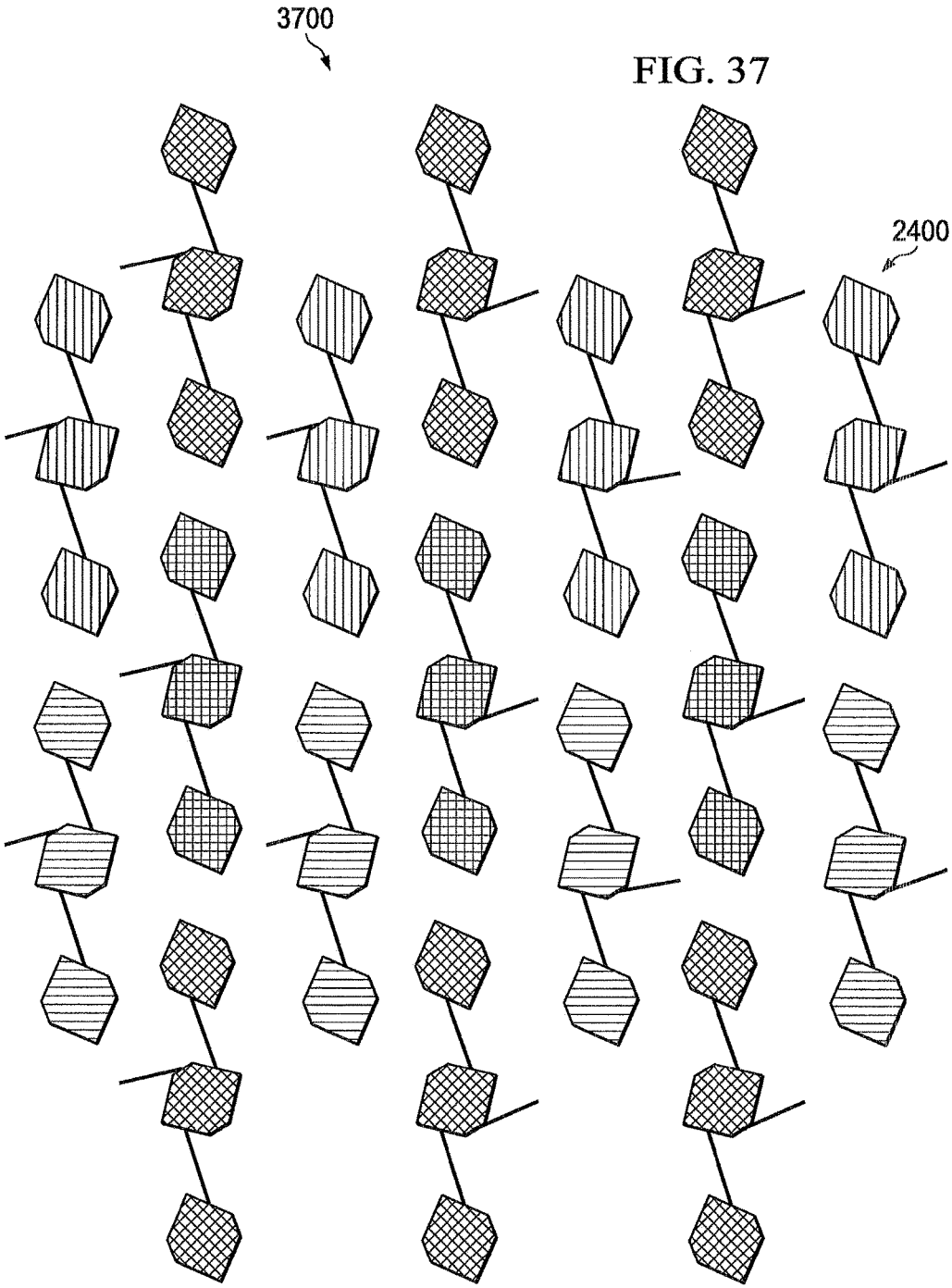

FIG. 37 illustrates another patch antenna array 3700, where the antenna array 3700 includes multiple patch antennas 2400. The antennas 2400 could form sub-arrays for a phase-scanning array. As described above, each patch antenna 2400 includes one host patch element and two parasitic patch elements. The patch elements of the various antennas 2400 are arranged here in a triangular lattice, although other configurations (such as rectangular, hexagonal, circular, or linear lattices) could be used.

Figure 38:
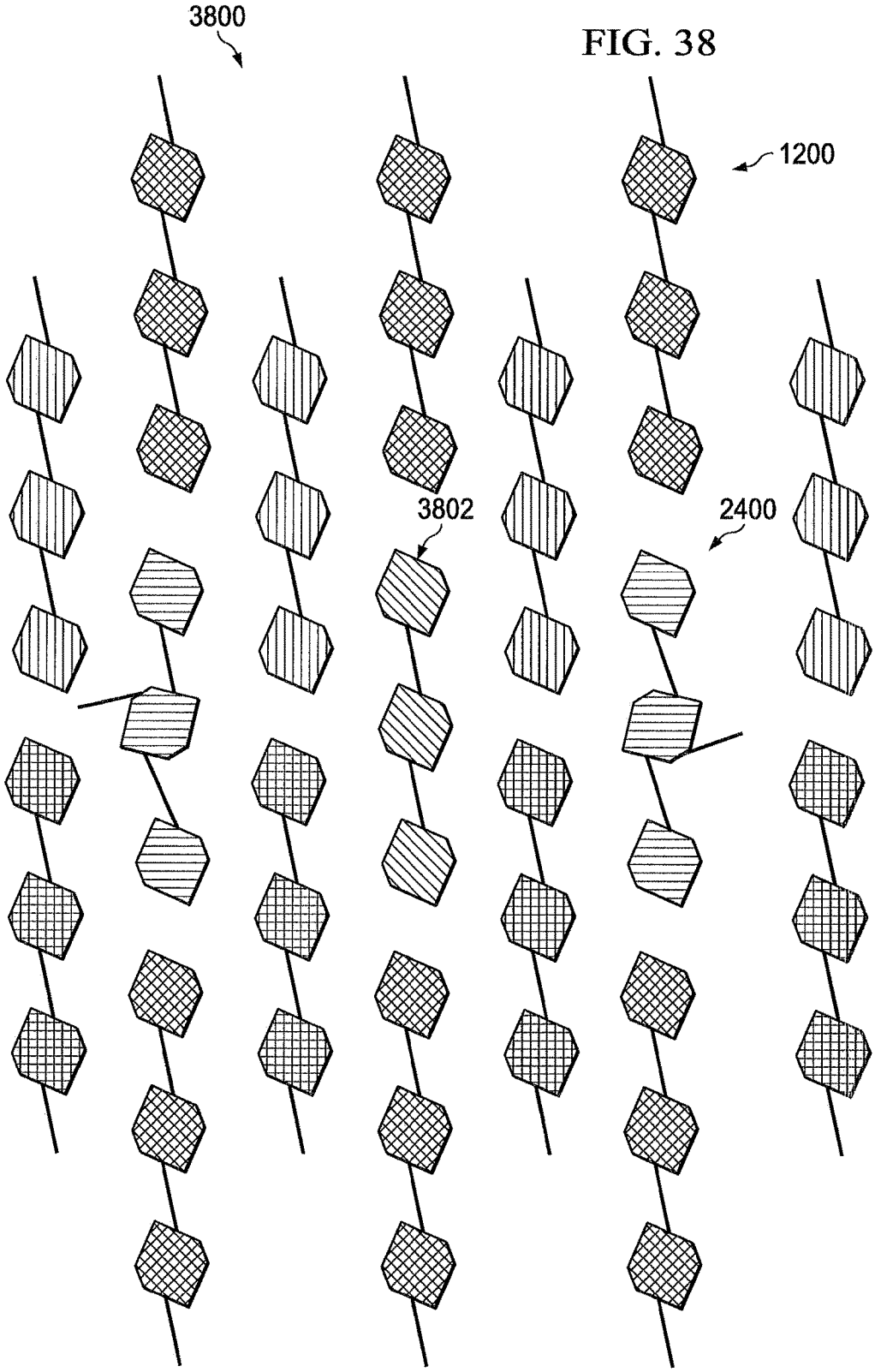

FIG. 38 illustrates a patch antenna array 3800 using both patch antennas 1200 and patch antennas 2400, which could form sub-arrays for a phase-scanning array. The patch elements of the various antennas 1200, 2400 are arranged in a triangular lattice, although other configurations (such as rectangular, hexagonal, circular, or linear lattices) could be used. The patch antenna array 3800 enables easy routing for the various feed lines, as a central sub-array 3802 in FIG. 38 is left open (meaning it is not fed), while feed lines of the remaining sub-arrays can be pulled to the sides of the array directly.

Figure 39:
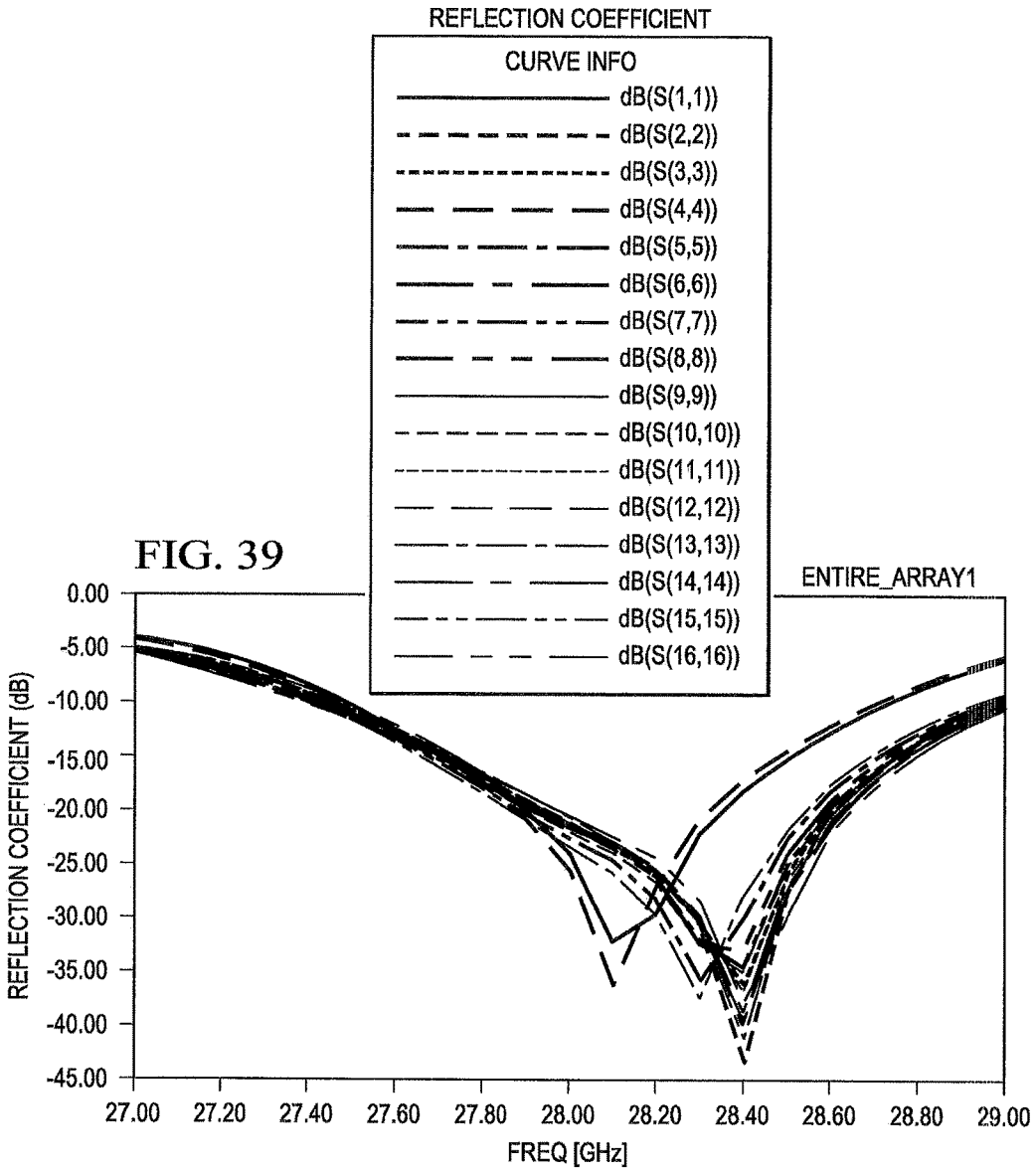
Figure 40A:
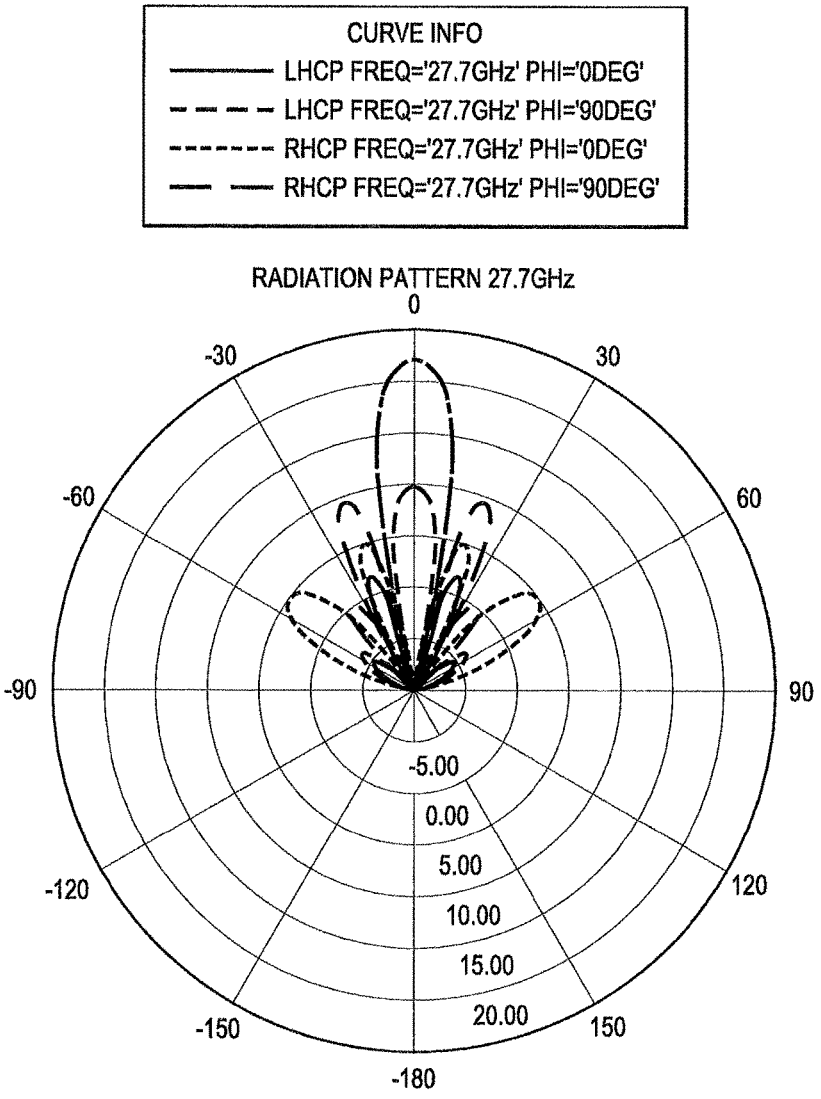
Figure 40B:
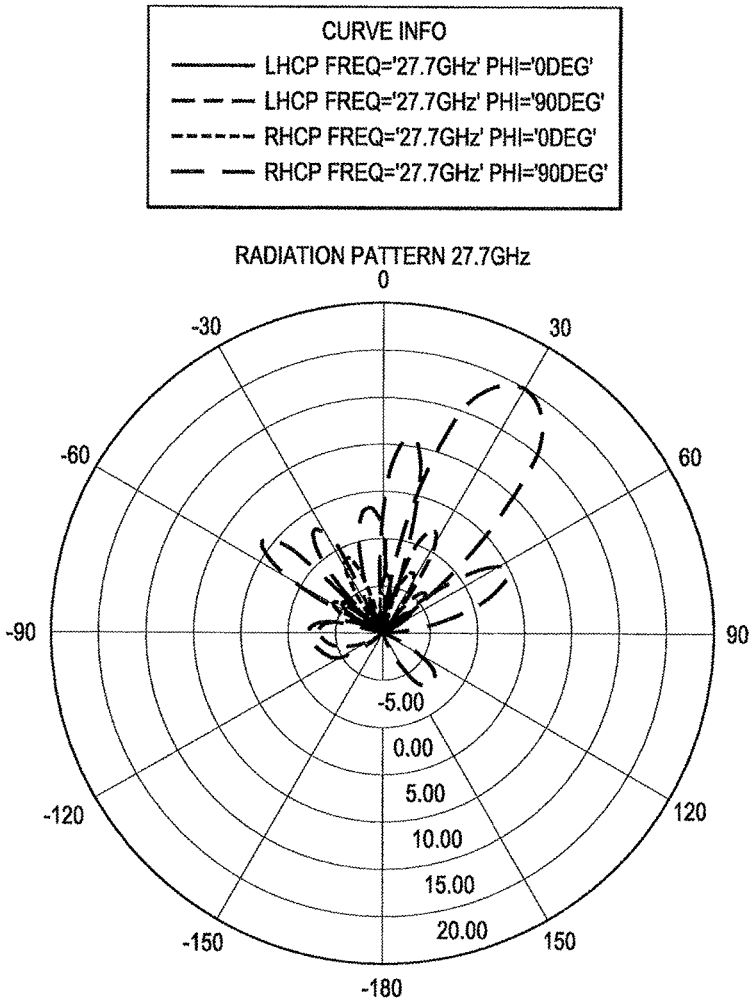
Figure 40C:
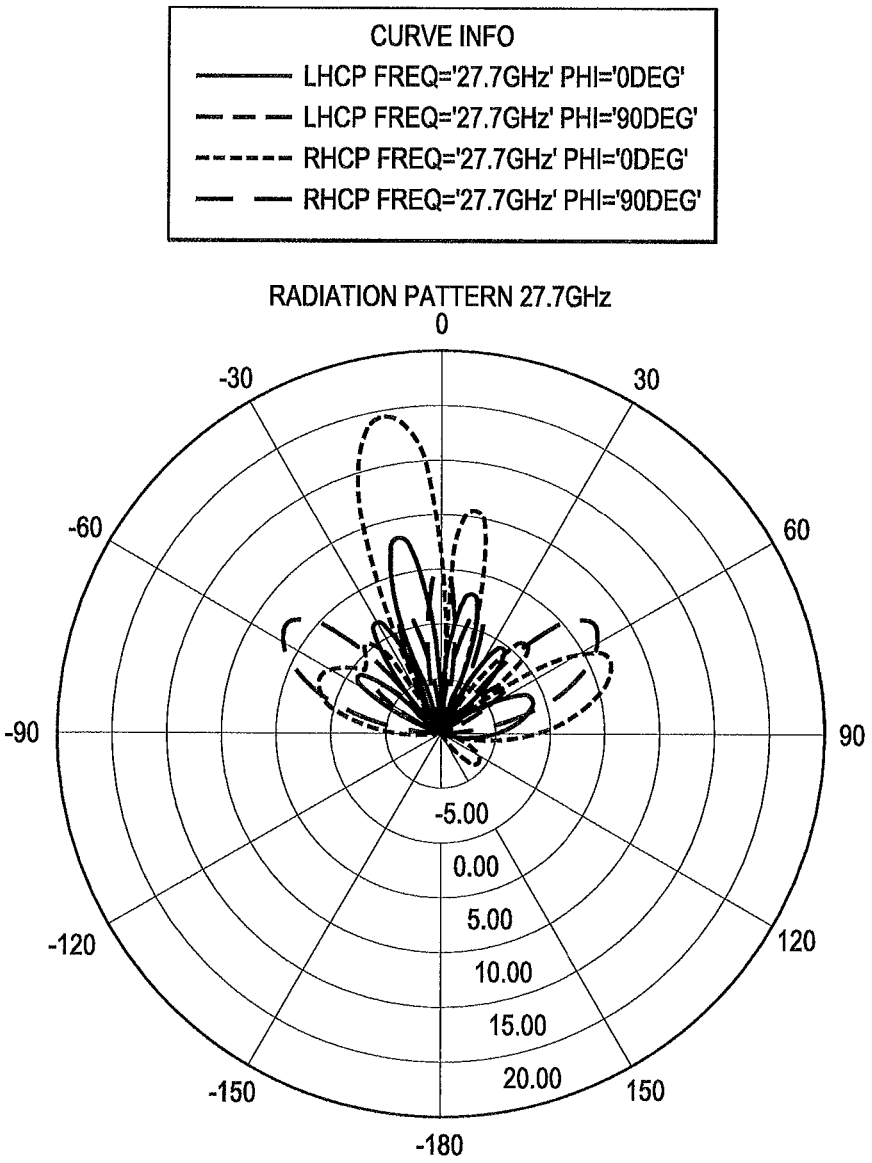
Figure 40D:
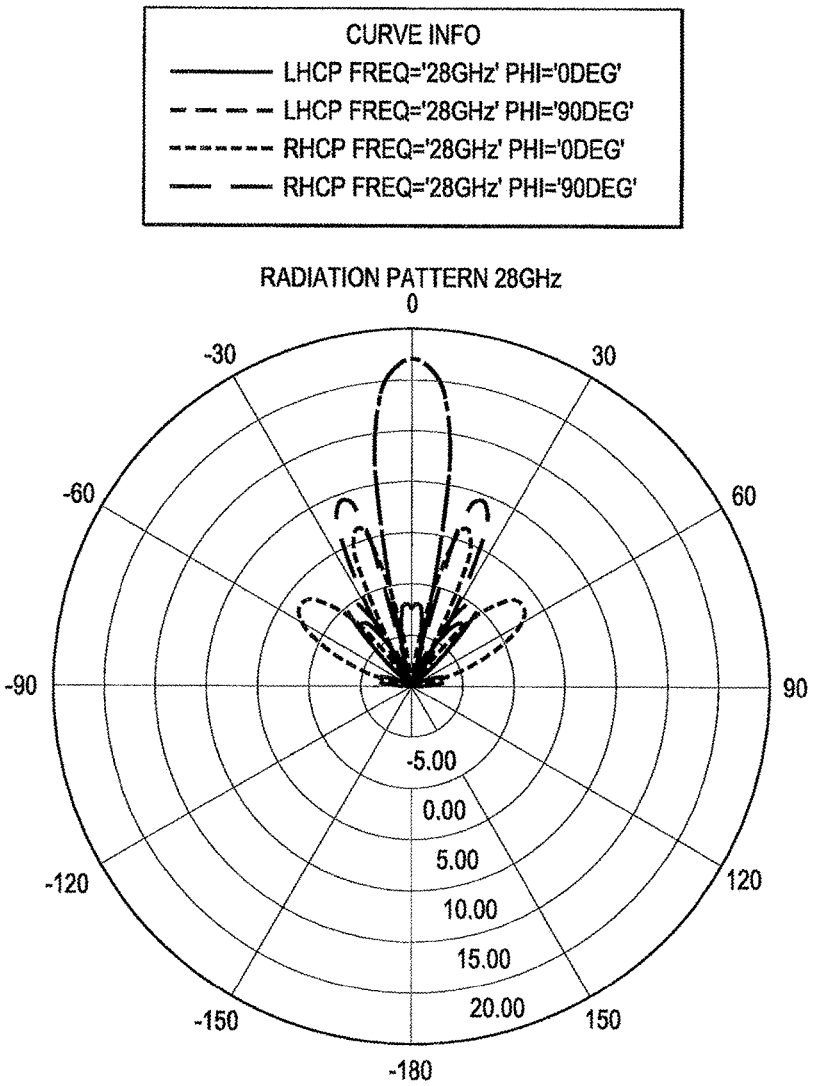
Figure 40E:
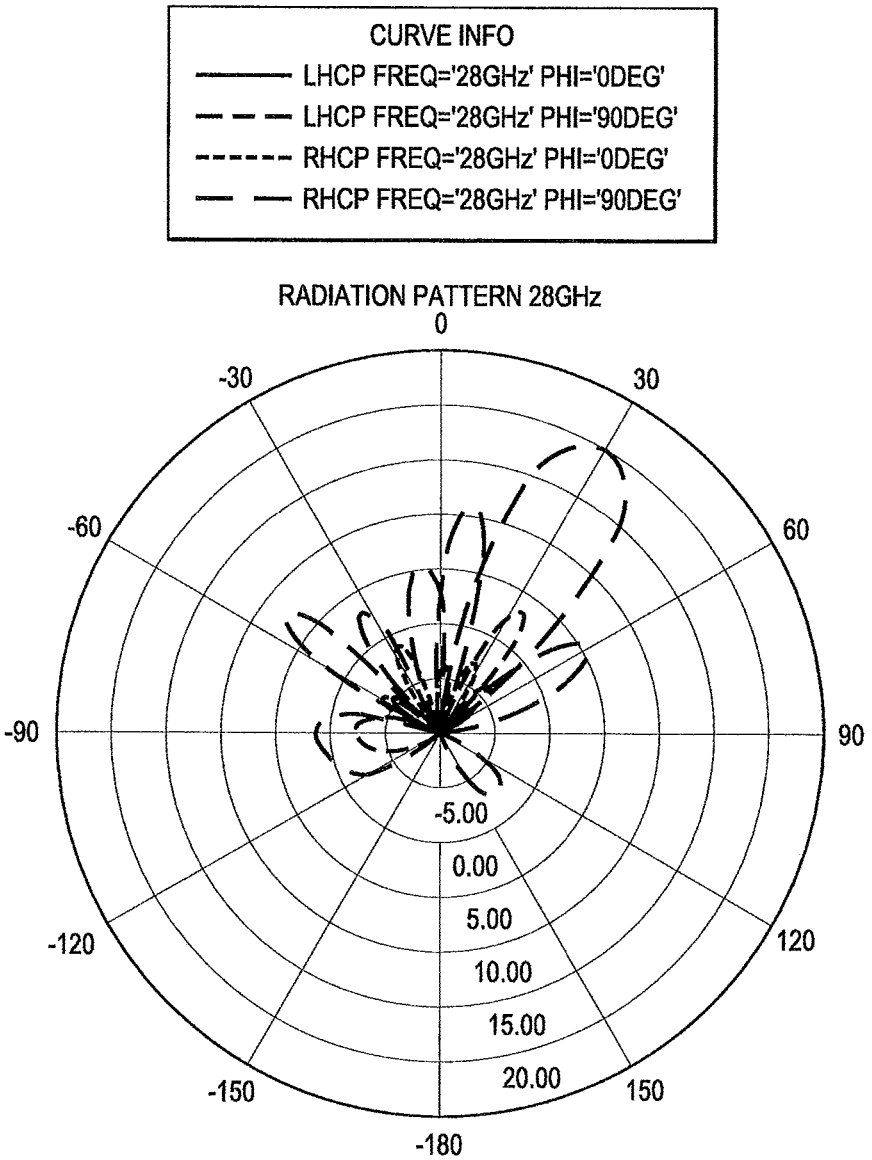
Figure 40F:
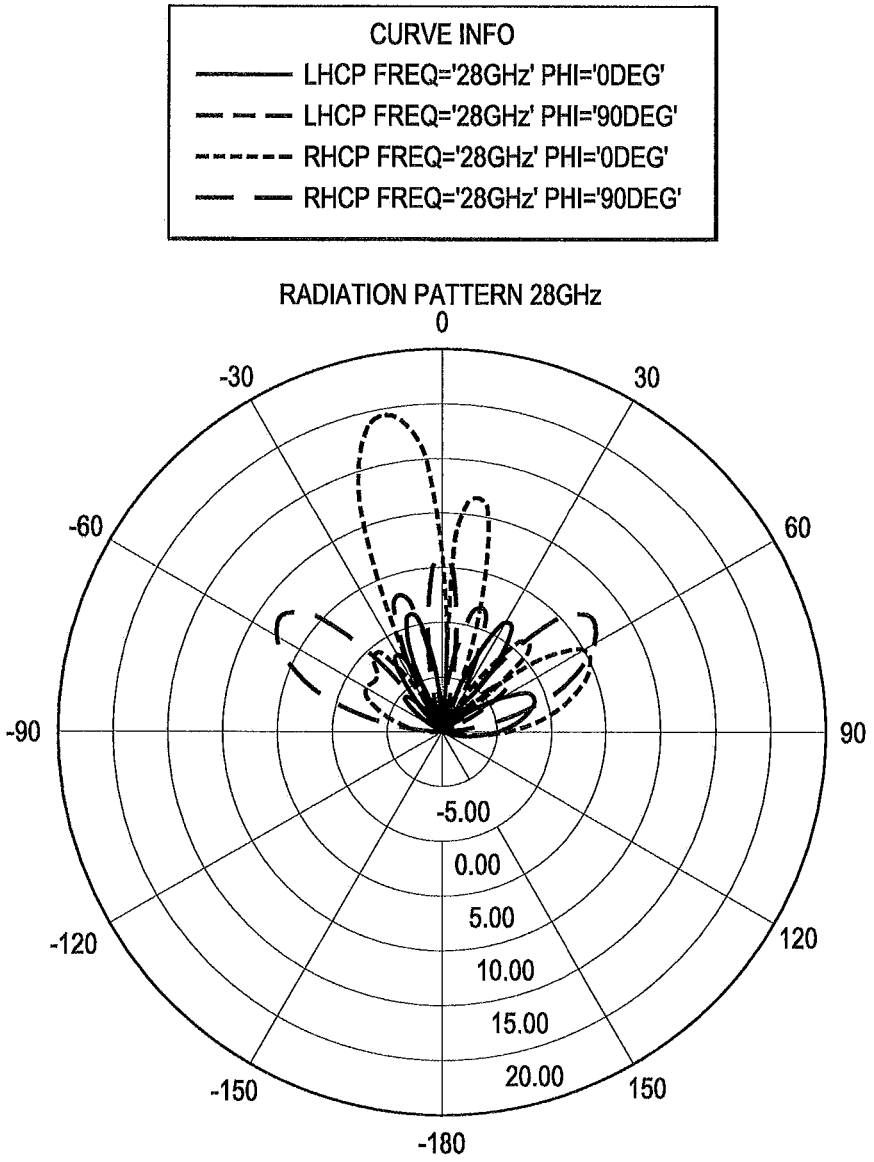
Figure 40G:
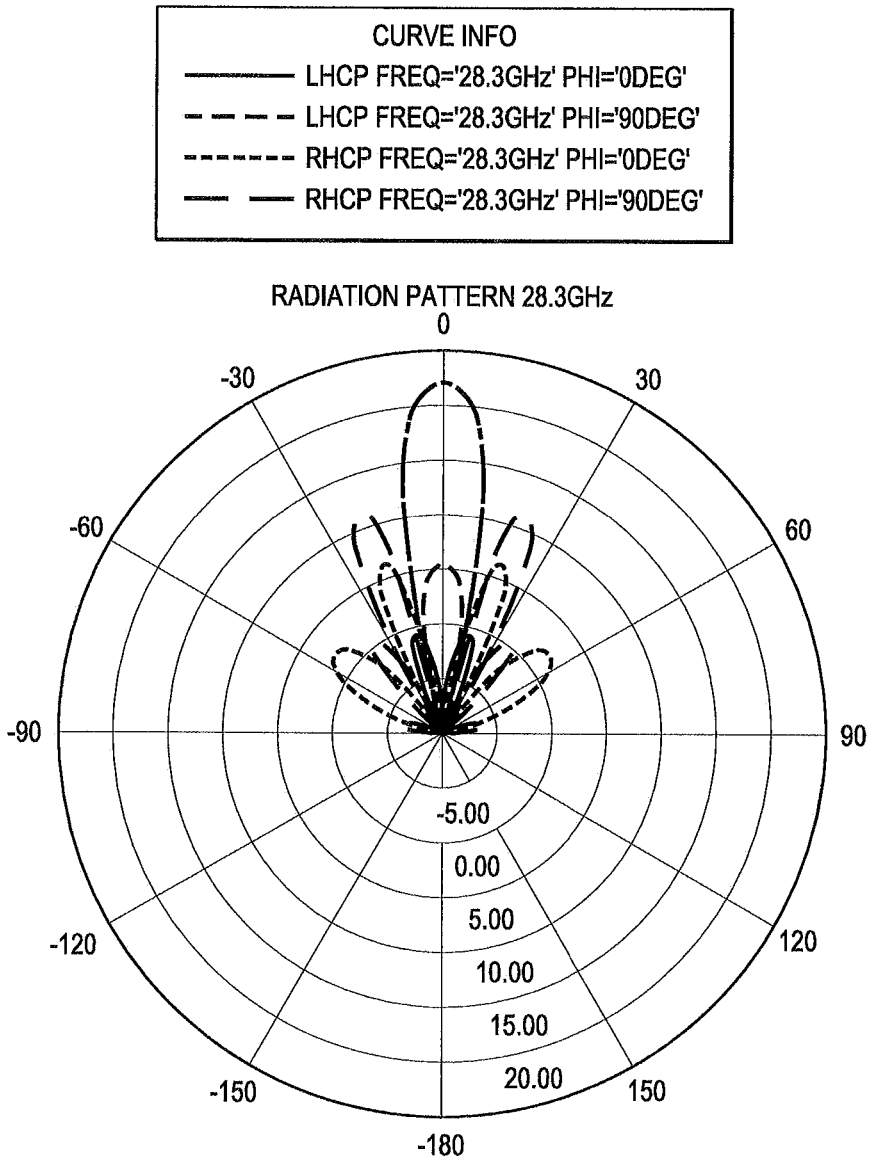
Figure 40H:
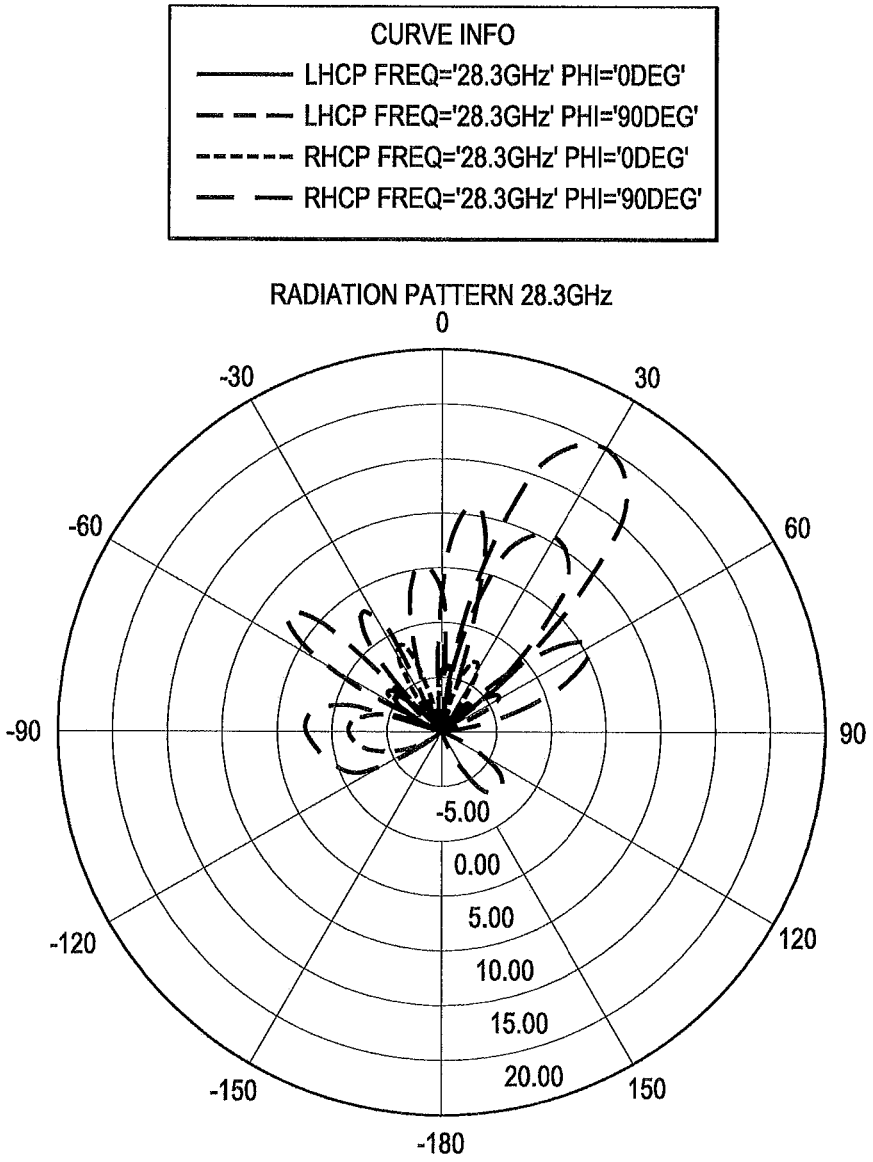
Figure 40I:
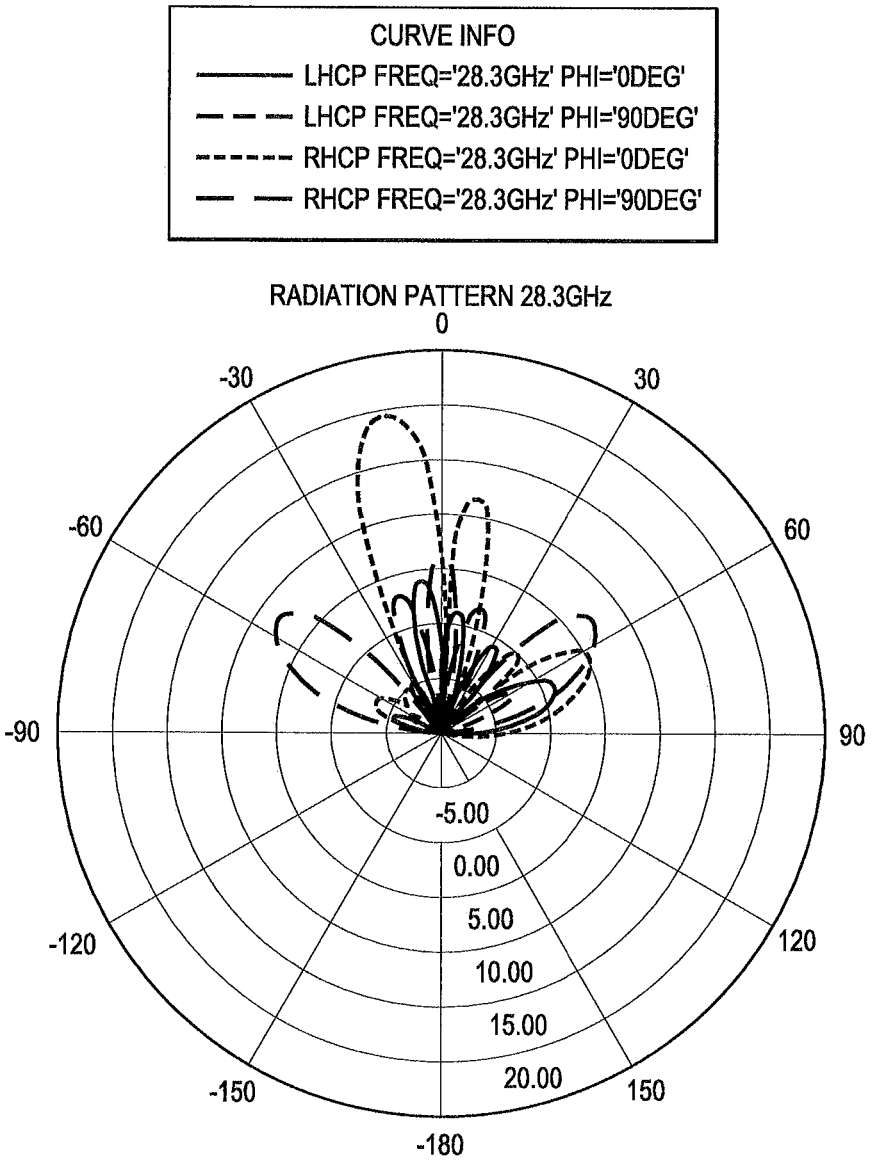
Figure 41:
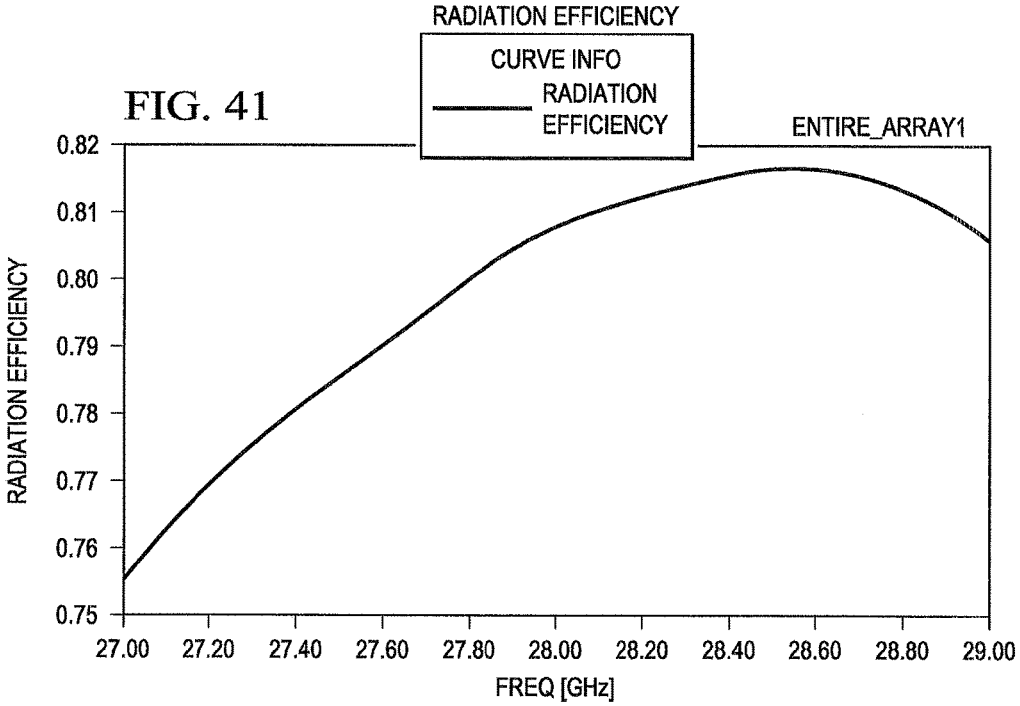

In this example, sixteen sub-arrays are used (the seventeenth sub-array 3802 being unused). In particular embodiments, mutual port coupling can be below −25 dB, and a 4.3% S11 bandwidth can be obtained as shown in FIG. 39. FIGS. 40A-401 illustrate the radiation patterns of the antenna array 3800 at 27.7 GHz, 28 GHz, and 28.3 GHz for the mean beam at broadside, at azimuth 30°/elevation 0°, and at azimuth 0°/elevation −10°. As shown in FIG. 41, the efficiency of one embodiment of the antenna array 3800 can be around 80%.

Compared with conventional designs, the antenna arrays 3600-3800 exhibit higher antenna efficiencies, smaller achievable element spacing, and improved sub-array shaping flexibility. Moreover, various embodiments of the antenna arrays use only a single-layer configuration, which reduces production costs significantly while providing dramatically improved antenna bandwidths.

In all of the antenna embodiments shown in FIGS. 4 through 41, one, some, or all of the microstrip lines feeding patch elements in an antenna or antenna array can be tilted at an angle of substantially or exactly 45°. The 45° angle helps to ensure that none of the edges of a patch element is predominant for an incoming electric-field from its feed line. This induces a more natural circular polarization operation and thus more bandwidth. Each patch element and microstrip line in FIGS. 4 through 41 could be formed from any suitable material(s) and in any suitable manner. For example, conductive material(s) can be deposited on a substrate (such as a PCB) and etched to form the various conductive structures of an antenna. Particular fabrication techniques include standard PCB processing techniques, complementary metal oxide semiconductor (CMOS) fabrication techniques, and low temperature cofired ceramic (LTCC) fabrication techniques. Moreover, in antennas with multiple patch elements and feed lines, there is no requirement that the patch elements or microstrip lines share common shapes or sizes. Antennas with differently sized or shaped patch elements or microstrip lines could be used. The antennas and antenna arrays described above could be used in any suitable devices or systems, including the eNBs 101-103 and UEs 111-116 of FIG. 1.

Although FIGS. 4 through 41 illustrate examples of circularly polarized patch antennas and antenna arrays using angled feed lines, various changes may be made to FIGS. 4 through 41. For example, while FIGS. 4 through 41 illustrate various patch antennas and antenna arrays, the number and arrangement of patch elements in the antennas and arrays are for illustration only. Any number of patch elements can be arranged in any suitable manner to support desired operation of an antenna or array, and the patch elements may or may not be arranged in sub-arrays. Moreover, figures showing radiation patterns, bandwidth diagrams, boresight diagrams, and other diagrams that illustrate potential operations of the antennas and antenna arrays are non-limiting. These figures are merely meant to illustrate possible functional aspects of specific embodiments of this disclosure, possibly compared to some conventional devices. These figures are not meant to imply that all conventional or inventive devices operate in the specific manner shown in those figures.

FIGS. 42A through 56 illustrate example circularly polarized patch antennas and antenna arrays using series feed lines according to this disclosure. In the circularly polarized patch antennas and antenna arrays described above, one patch element is routinely fed a signal through another patch element. It is also possible to serial-feed multiple patch elements from a common signal line connected to all of those patch elements. This can be done using single-layer CP patch elements and a non-rotated feed approach.

One use for CP or dual LP antennas is in millimeter-wave (MMW) communication systems, which use radio frequency (RF) signals from about 30 GHz to about 300 GHz. An example system is shown in FIG. 1. To establish a stable signal path between a UE and an eNB, high-gain antenna arrays in both devices can compensate for link losses and reduce power consumption. Also, CP or dual LP antennas can be used in the eNB's antenna array 255 to reduce or minimize losses due to polarization mismatches between the UE and the eNB.

In size- and cost-constrained platforms such as consumer electronic devices, planar antenna arrays are often used since they are compatible with standard PCB fabrication techniques and can be easily integrated with other components.

Arrays using multiple patch antennas are often inexpensive and have favorable radiation patterns.

Unfortunately, a single standard patch antenna has an inherent linear polarization, which imposes difficulties in designing a CP or dual LP antenna array. One conventional approach to solving that problem involves providing a signal to sequentially-rotated feeds of multiple patch antennas, which could be done serially or in parallel. However, this approach often involves the use of two substrates, which increases the size and cost of the antenna array. Moreover, when a signal is fed in series to multiple patch antennas, this often involves complex designs to ensure that the impedance of each transmission line section simultaneously matches the phase and amplitude of the signal delivered to each patch antenna. In addition, antenna arrays that use sequentially-rotated feeds typically lack scanning capabilities, have low efficiencies, and suffer from mutual coupling between antenna elements (which can detune the amplitude and phase match of the feeding network). The various patch antennas and antenna arrays shown in FIGS. 42A through 56 help to overcome these or other problems with conventional patch antennas.

Figure 42A:
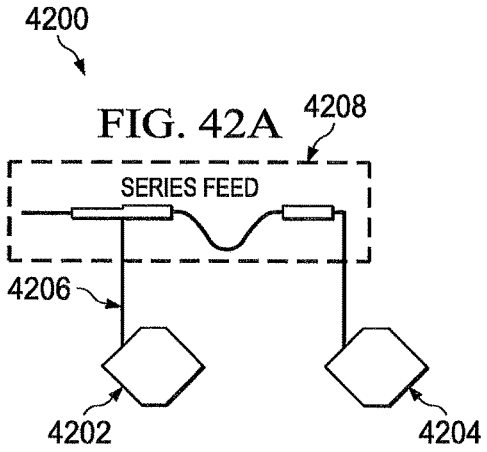
FIGS. 42A through 56 illustrate example circularly polarized patch antennas and antenna arrays using series feed lines according to this disclosure.

As shown in FIG. 42A, a patch antenna 4200 includes two patch elements 4202-4204, which represent corner truncated patch elements. The patch elements 4202-4204 are fed by microstrip lines 4206, which are tilted at substantially or exactly 45° with respect to the patch elements 4202-4204 (although other feed angles can also be used). The microstrip lines 4206 can be half- or quarter-wavelength lines or even lines of arbitrary length(s) for impedance matching. The microstrip lines 4206 can also be straight or curved.

Each microstrip line 4206 is coupled to a series feed line 4208, which includes multiple impedance transformers (having the forming of varying widths across the feed line 4208). The series feed line 4208 can also be formed without any impedance transformers, such as when the line length between each feed point is an integer number of the half-wavelength. The impedance transformer is used here to rebalance the signal amplitudes fed into each patch element, which may be slightly different due to ohmic loss from the feed line 4208. The curved line in the middle of the feed line 4208 is used to reduce the space between the feed points of the patch elements 4202-4204 and thereby reduce the space between the patch elements 4202-4204. A straight line portion in the middle of the feed line 4208 can also be used.

Figure 42B:
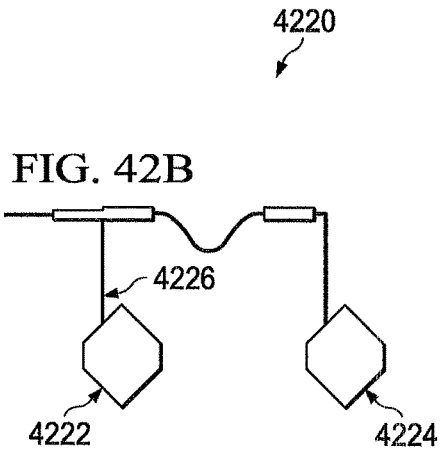
Figure 42C:
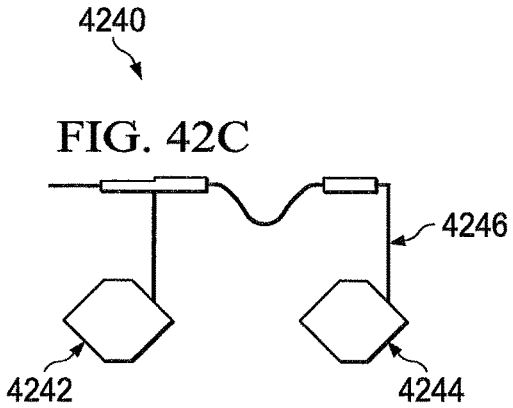
Figure 42D:
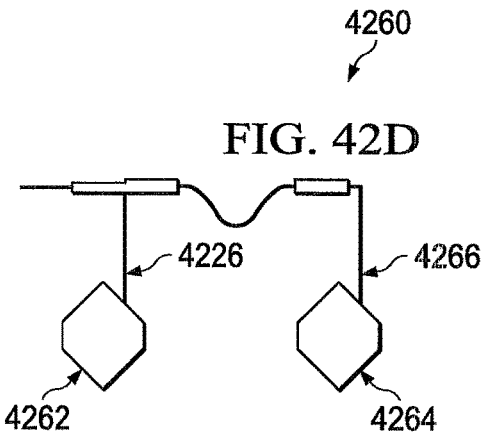

In FIG. 42A, the top and bottom corners of each patch element 4202-4204 are truncated, and the microstrip lines 4206 excite the patch elements 4202-4204 from the left side. This excites RHCP in the antenna 4200. In FIG. 42B, a patch antenna 4220 has a similar structure, except patch elements 4222-4224 have left and right corners that are truncated, and microstrip lines 4226 excite the patch elements 4222-4224 from the left side. This excites LHCP in the antenna 4220. In FIG. 42C, a patch antenna 4240 has a similar structure as the antenna 4200, but microstrip lines 4246 excite patch elements 4242-4244 from the right side. This excites LHCP in the antenna 4240. In FIG. 42D, a patch antenna 4260 has a similar structure as the antenna 4220, but microstrip lines 4266 excite patch elements 4262-4264 from the right side. This excites RHCP in the antenna 4260. Any of these antennas 4200, 4220, 4240, 4260 can be used as a sub-array in a larger antenna, such as a phase-scanning array. These antennas use the series feed line 4208 as a "bus" for all of the patch elements coupled to the feed line 4208. The feed line 4208 feeds the patch elements in phase.

Figure 43:
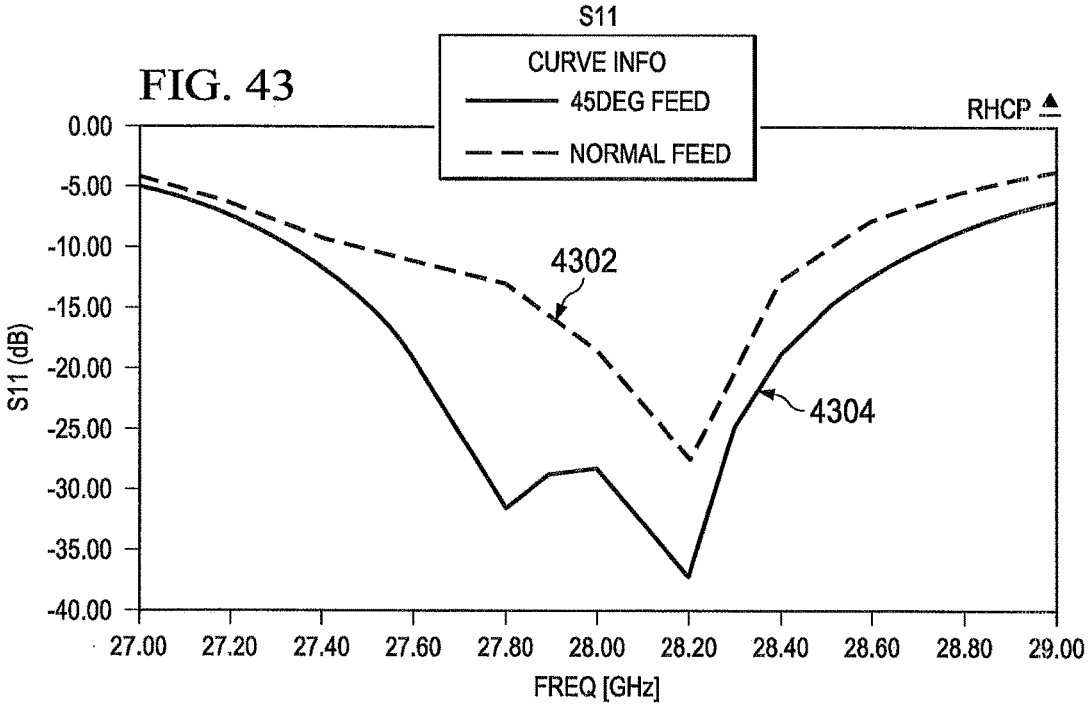

FIG. 43 illustrates an S11 comparison between corner-truncated patch elements with a 90° feed line at a 220Ω impedance (line 4302) and corner-truncated patch elements with a 45° feed line at a 140Ω impedance (line 4304). Both antennas are optimized to provide their best impedance and AR bandwidths. Clearly, the feeding technique shown in FIGS. 42A through 42D provides better bandwidth and more reasonable impedance.

Figure 44A:
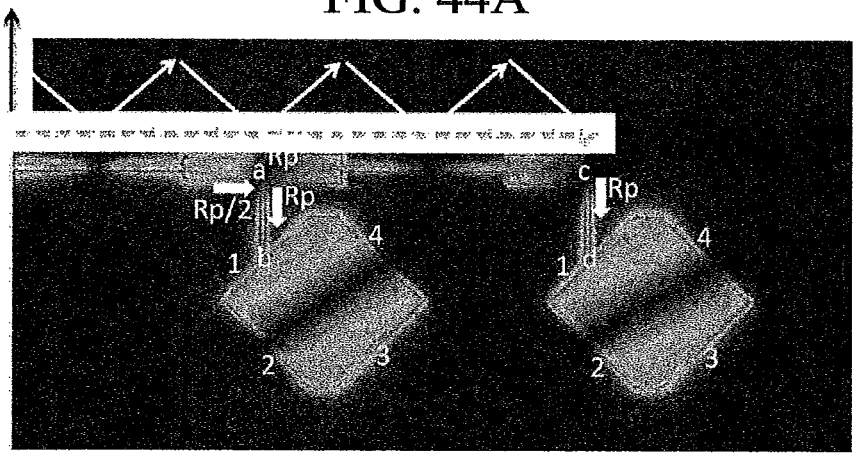
Figure 44B:
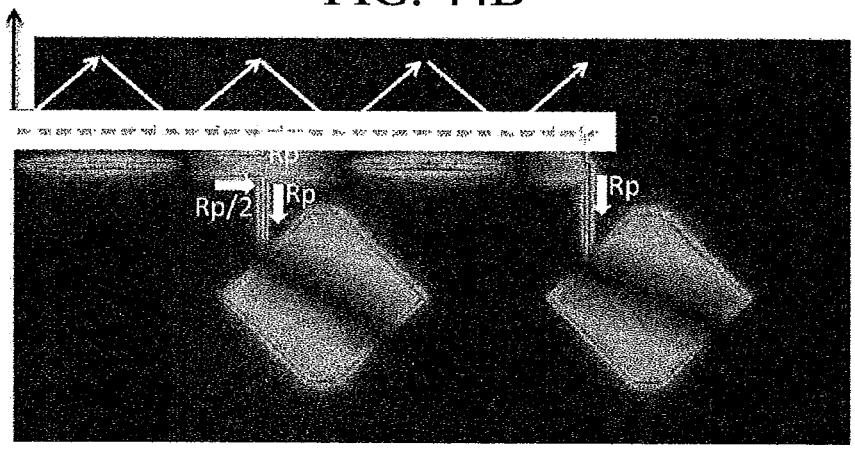

FIGS. 44A and 44B illustrate two radiating states of the patch antenna 4200. The two radiating states are at input phases of 0° (FIG. 44A) and 90° (FIG. 44B). For the state with the 0° phase, patch edges "1" and "3" have the strongest radiation, while nulls occur at patch edges "2" and "4." For the state with the 90° phase, patch edges "2" and "4" have the strongest radiation, while nulls occur at patch edges "1" and "3." In these figures, the total line length between points "a" and "c" in the series feed line 4208 is λ, so the impedance seen from point "a" to the bottom is the same as the impedance seen from point "c" to the bottom (Rp). In this case, the two patch elements at points "a" and "c" receive substantially the same amount of energy, and the impedance seen at the left side of point "a" is the parallel impedance of the two patch elements (Rp/2).

In this example, the section of the microstrip line 4206 between points "a" and "b" or between points "c" and "d" is λ/4. The impedance seen from point "a" or point "c" to the bottom of its associated patch element is $Rp=Ro^2/Re$, where Ro represents the impedance of the microstrip line 4206 between points "a" and "b" or points "c" and "d," and Re represents the patch impedance right at edge "1." A λ/2 microstrip line 4206 can also be used between points "a" and "b" or points "c" and "d," in which case Rp=Re. For a 90°-fed corner truncated patch, Re is a complex number at its resonant frequency, and the line length between points "a" and "b" or points "c" and "d" would need to be tuned in order to tune out the imaginary part of Re.

Another advantage of the approach shown here is that a series-fed configuration does not require a fixed number of patch elements to create a building block as some conventional approaches require (such as where a 2×2 array configuration is mandatory). The embodiments shown in FIGS. 42A through 42D use two patch elements to obtain a building block. When more patch elements are needed in series, simple duplication of the series feed line 4208 from point "a" to point "c" is adequate to ensure substantially equal energy balance between the patch elements. However, the impedance seen from the left of point "a" changes to Rp/n, where n is the number of patch elements excited by the series feed line 4208.

Figure 45A:
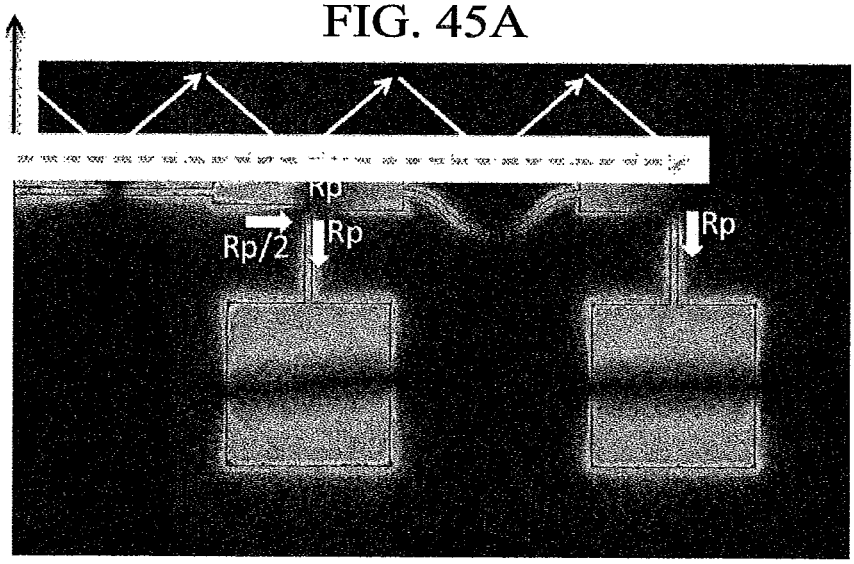
Figure 45B:
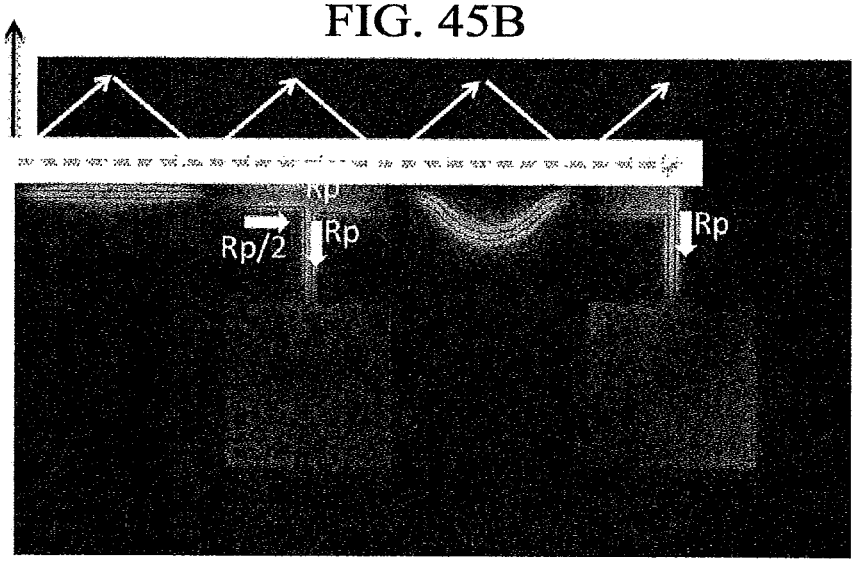
Figure 45C:
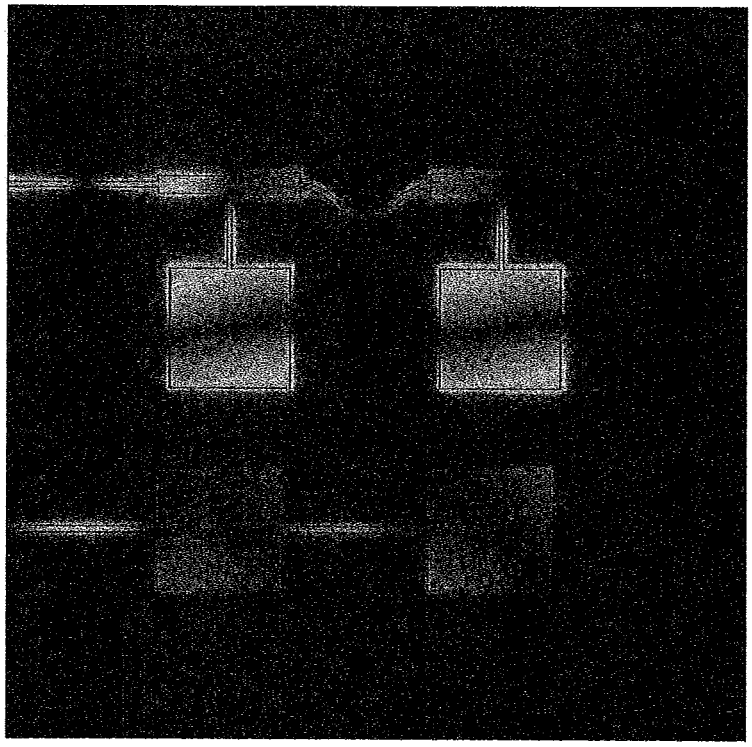
Figure 45D:
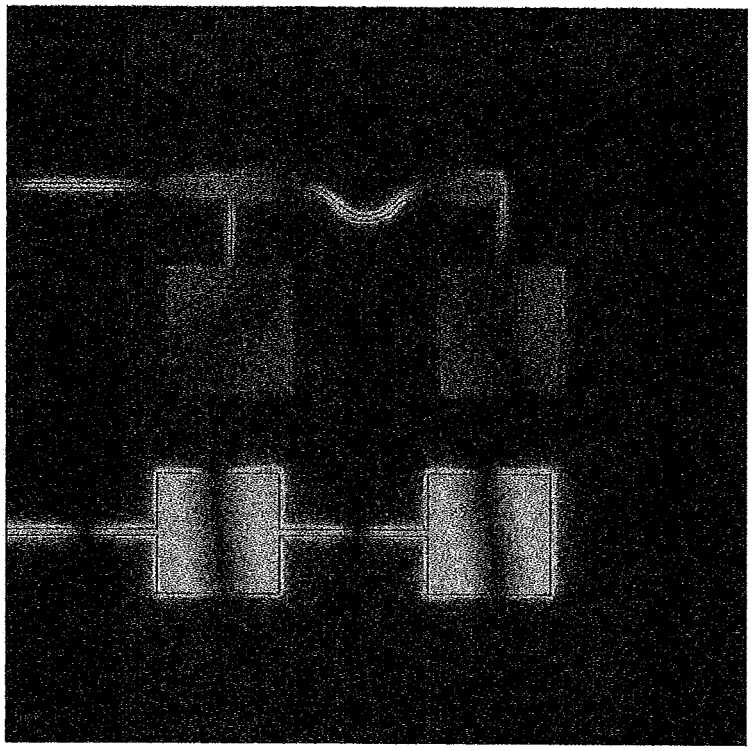

As shown in FIGS. 45A through 45D, a structure with two linearly polarized patch elements can also be fed from a series feed line at 90°. As can be seen in FIGS. 45A and 45B, the electric field distributions of two radiating states are depicted. When the input phase is 90°, almost no energy gets into the patch elements. Radiation only happens at an input phase of 0° from patch edges "1" and "3" (the top and bottom edges). However, as shown in FIGS. 45C and 45D, the structure with two linearly polarized patch elements can be paired with an antenna having two series-fed patch elements to achieve CP radiation.

Figure 46:
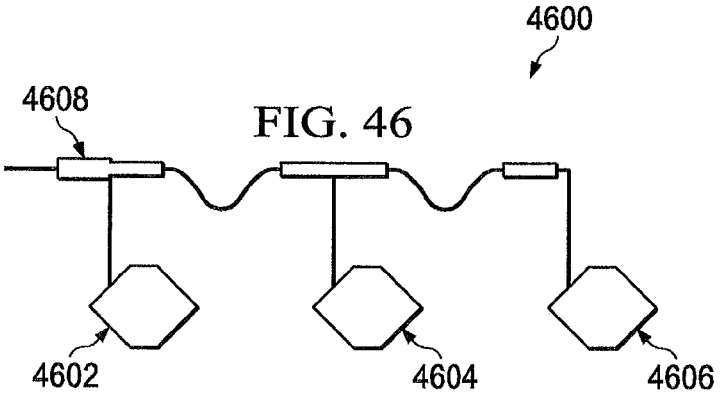

The number of patch elements coupled to a series feed line can vary to create various building blocks. For example, FIG. 46 illustrates a patch antenna 4600 having three patch elements 4602-4606 coupled to a series feed line 4608. Since the feed line 4608 has substantially the same impedance characteristic at each feed point to the patch elements 4602-4606, the series feed line 4608 can simply repeat itself to feed more patch elements simultaneously. Building blocks with more than three patch elements can be implemented, and virtually any combination of patch elements can be fed using the series feed line. Note that the different corner truncations and left/right feeding sides shown in FIGS. 42A through 42D could be used in FIG. 46 or any other building block having more than two patch elements.

Figure 47:
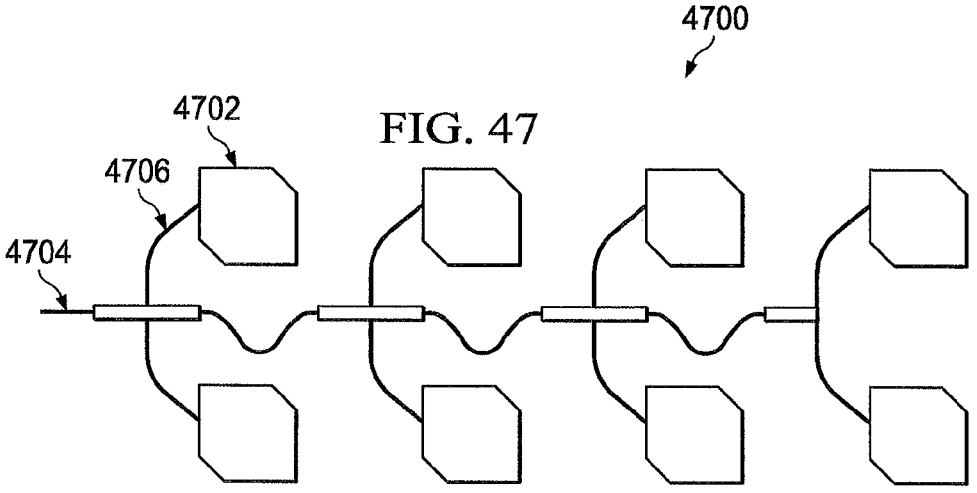
Figure 48:
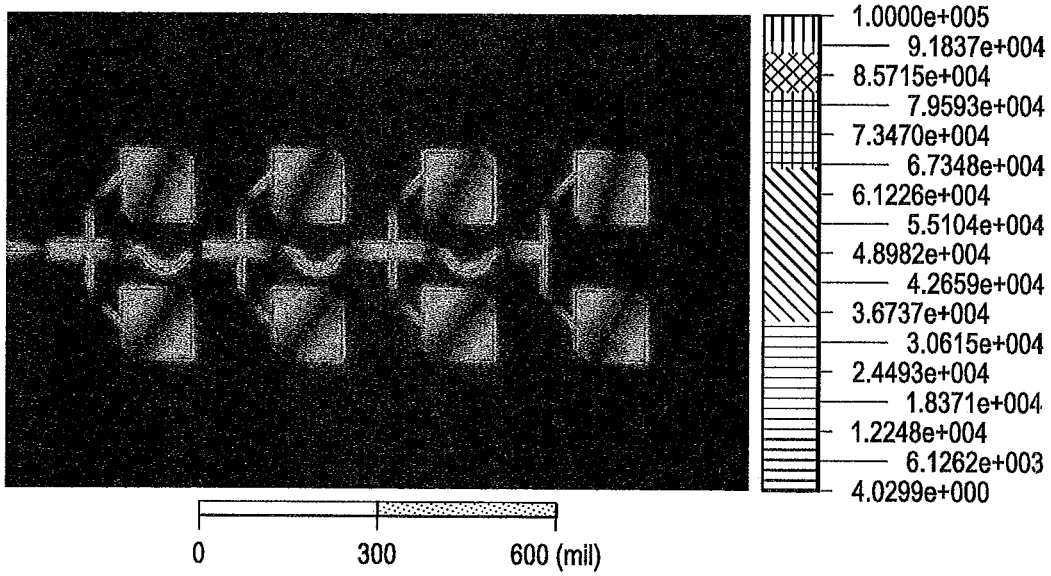

Patch elements can also be coupled to a series feed line on multiple sides of the series feed line. An example of this is shown in FIG. 47, where an antenna 4700 includes eight patch elements 4702 coupled to a series feed line 4704 (four on each side of the series feed line 4704). In this embodiment, microstrip lines 4706 connected to the patch elements 4702 have been curved, although straight microstrip lines could be used. Also, the different corner truncations and feed directions from FIGS. 42A through 42D could be used in FIG. 47, and more or less than eight patch elements 4702 could be used. FIG. 48 shows a radiating state of the antenna 4700.

Figure 49:
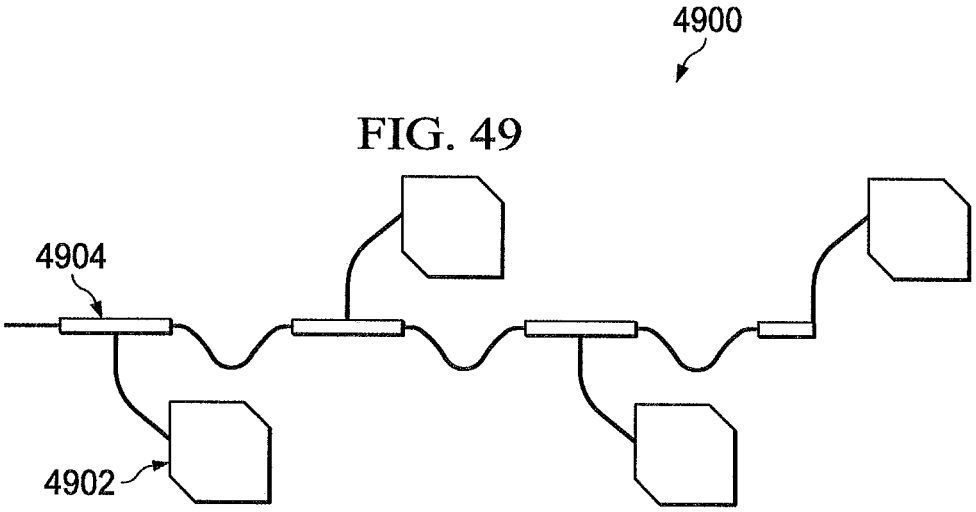

In FIG. 47, two patch elements are connected to the series feed line at each of multiple locations along the series feed line. However, as shown in FIG. 49, patch elements 4902 of an antenna 4900 can also be fed in a criss-crossed manner. In this technique, the patch elements 4902 connect to a series feed line 4904 on alternate sides of the feed line 4904 along the length of the feed line 4904. Other embodiments having a different number of patch elements can also be used.

Figure 50:
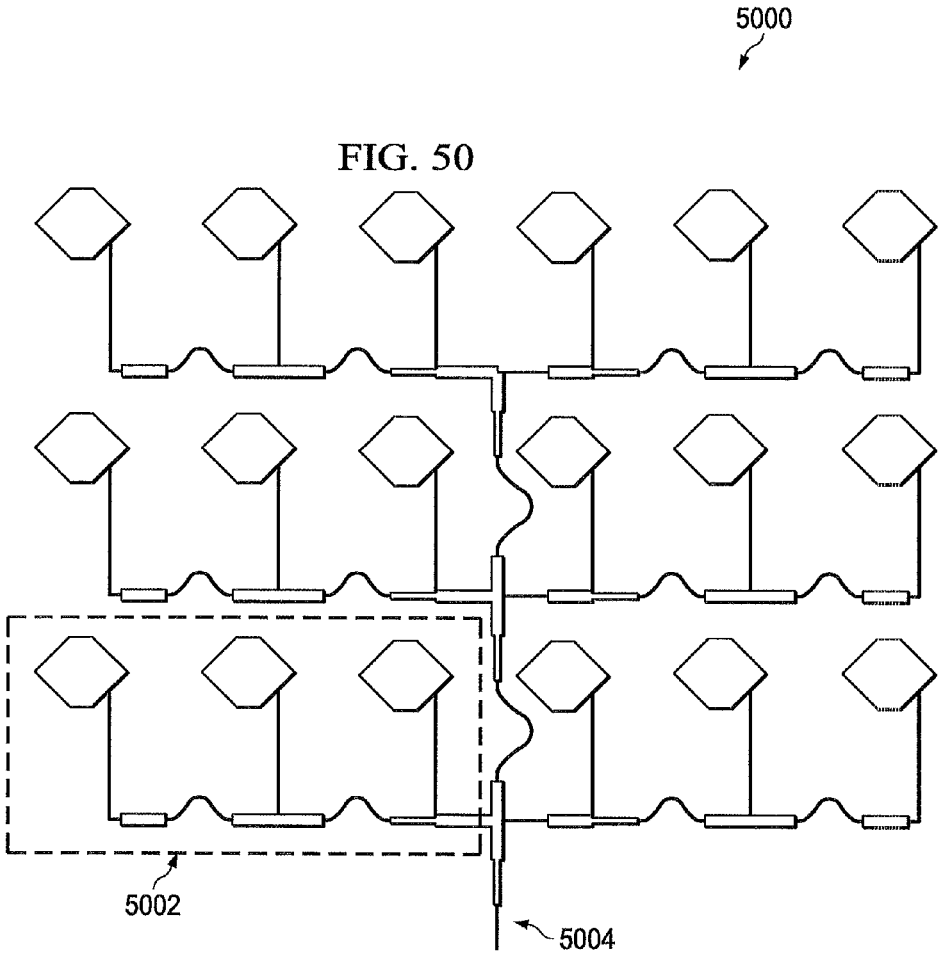

Multiple building blocks of patch elements can also be coupled to a series feed line to create more complex patch element patterns. For example, a number of series-fed building blocks can connected to a series feed line in a cascaded configuration. An example of this is shown in FIG. 50, where a patch antenna 5000 includes six building blocks 5002 coupled to a center series feed line 5004. Each building block 5002 includes three series-fed patch elements connected to a local series feed line. Other embodiments may use a cascade of any number of the various building blocks discussed above. Also, other embodiments with building blocks cascaded in different configurations can be used. In addition, a cascade of cascades could also be used.

Figure 51:
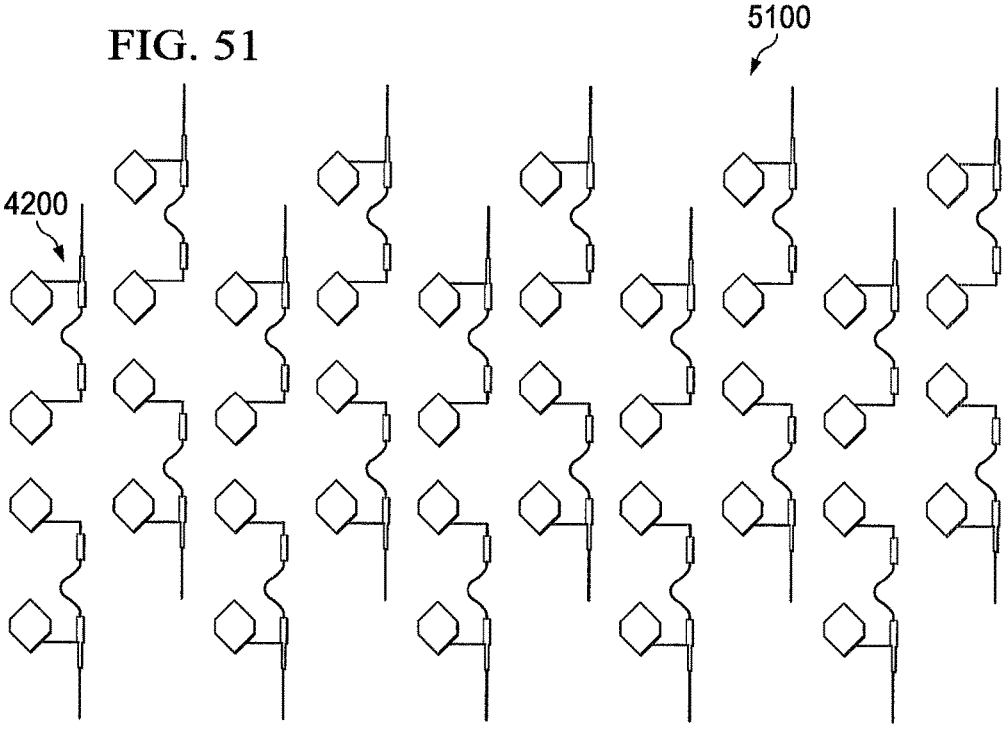
Figure 52A:
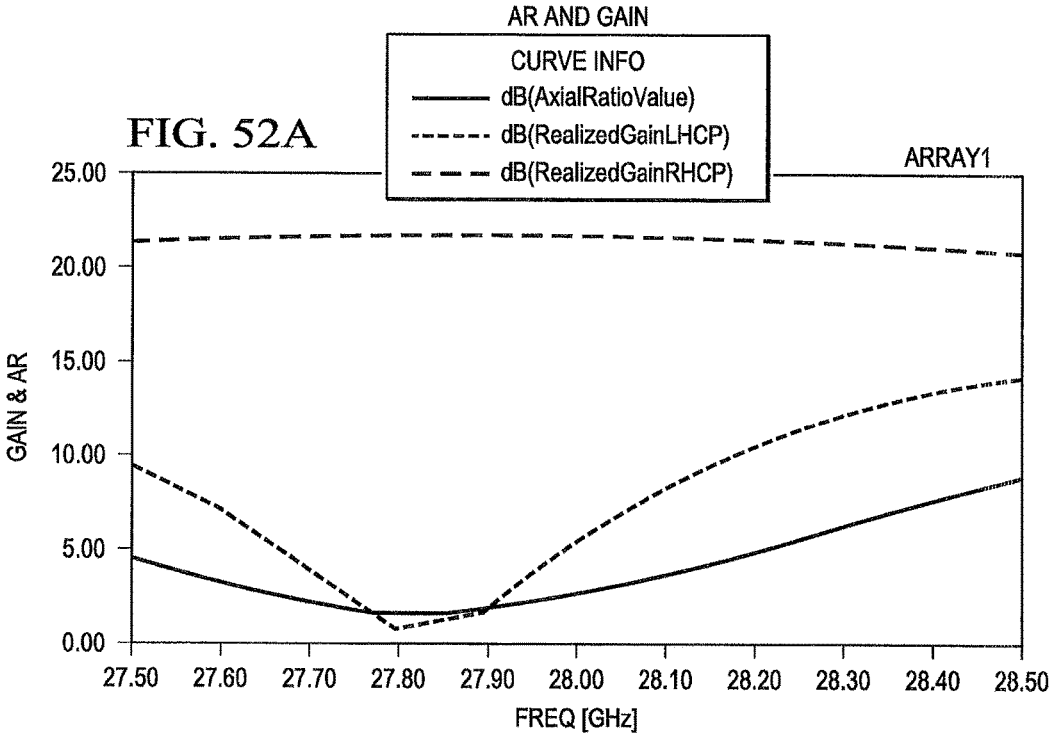
Figure 52B:
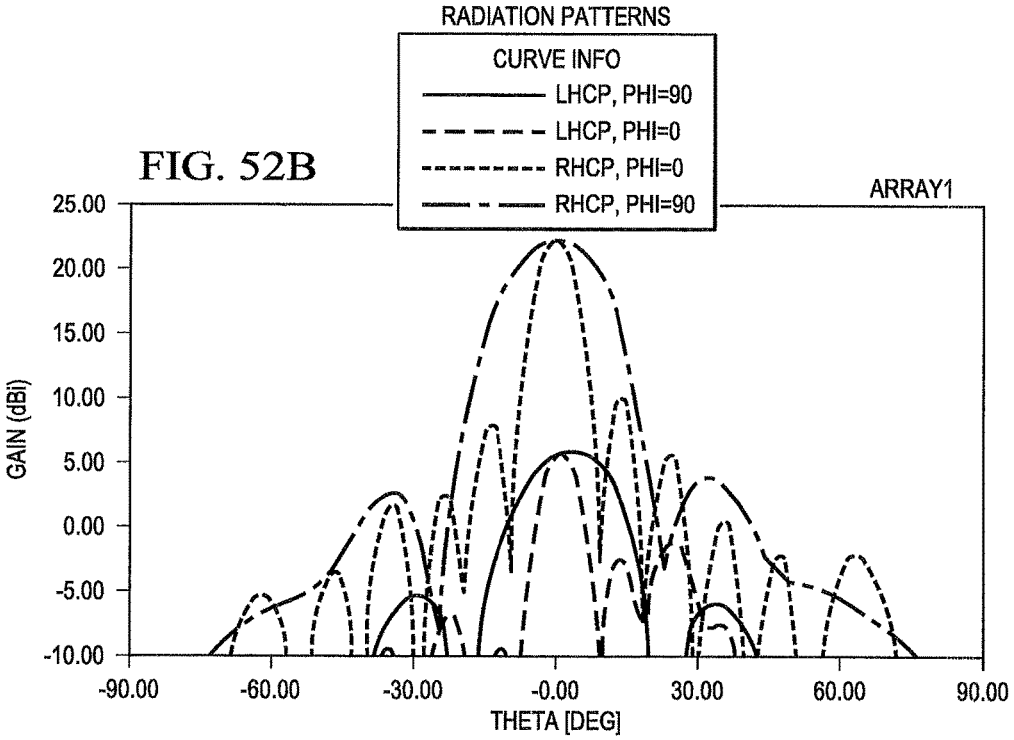
Figure 52C:
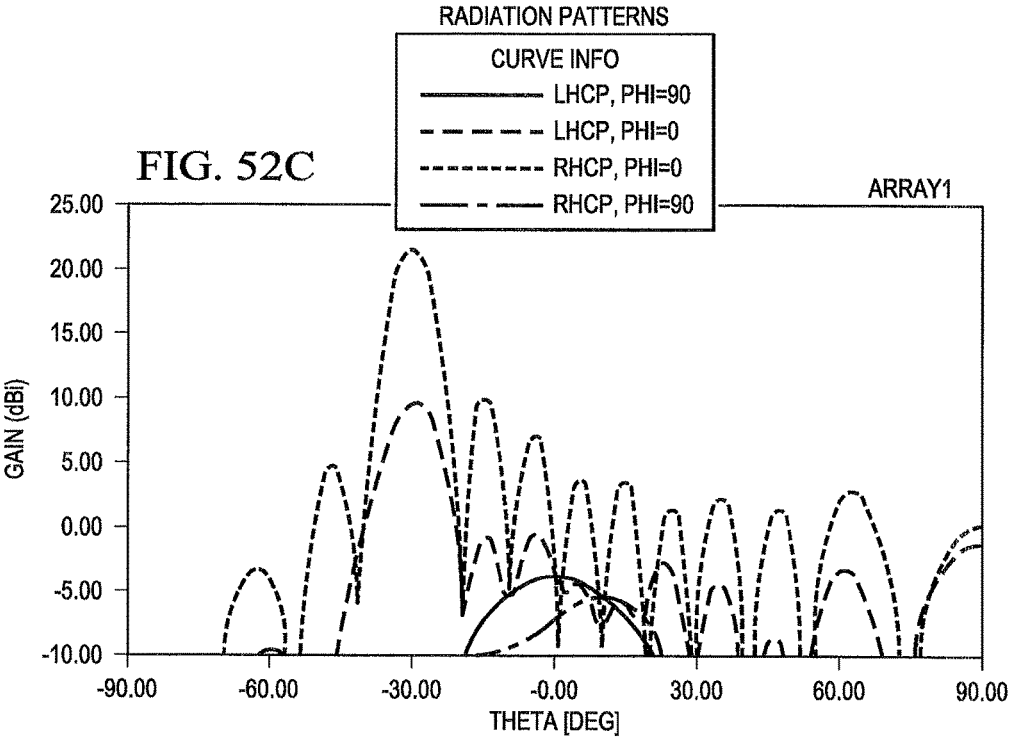
Figure 52D:
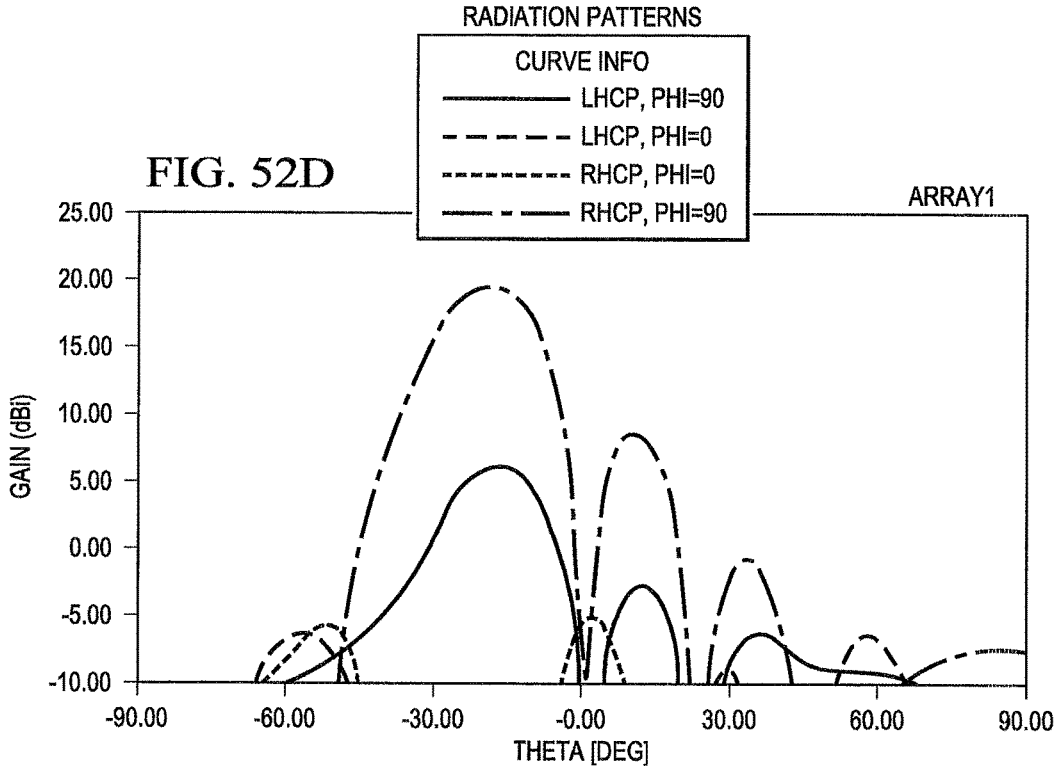

All of these embodiments can be used as sub-arrays for a larger antenna, such as a phase-scanning array. Due to the geometrical flexibility of the building blocks, different phase-scanning arrays can be implemented. For example, FIG. 51 illustrates a patch antenna array 5100, which includes sub-arrays formed using patch antennas 4200. Here, each sub-array includes two patch elements fed from the same side of a series feed line. Also, the sub-arrays are arranged so the patch elements have a diagonal array lattice, although other lattices (such as triangular, rectangular, circular, or hexagonal lattices) could also be used. Simulated array boresight gain and axial ratio versus frequency of the antenna array 5100 are shown in FIG. 52A, and radiation patterns of the antenna array 5100 at 28 GHz with a scanning beam at azimuth 0°/elevation 0°, at azimuth −30°/elevation 0°, and at azimuth 0°/elevation −20° are shown in FIGS. 52B through 52D, respectively.

Figure 54A:
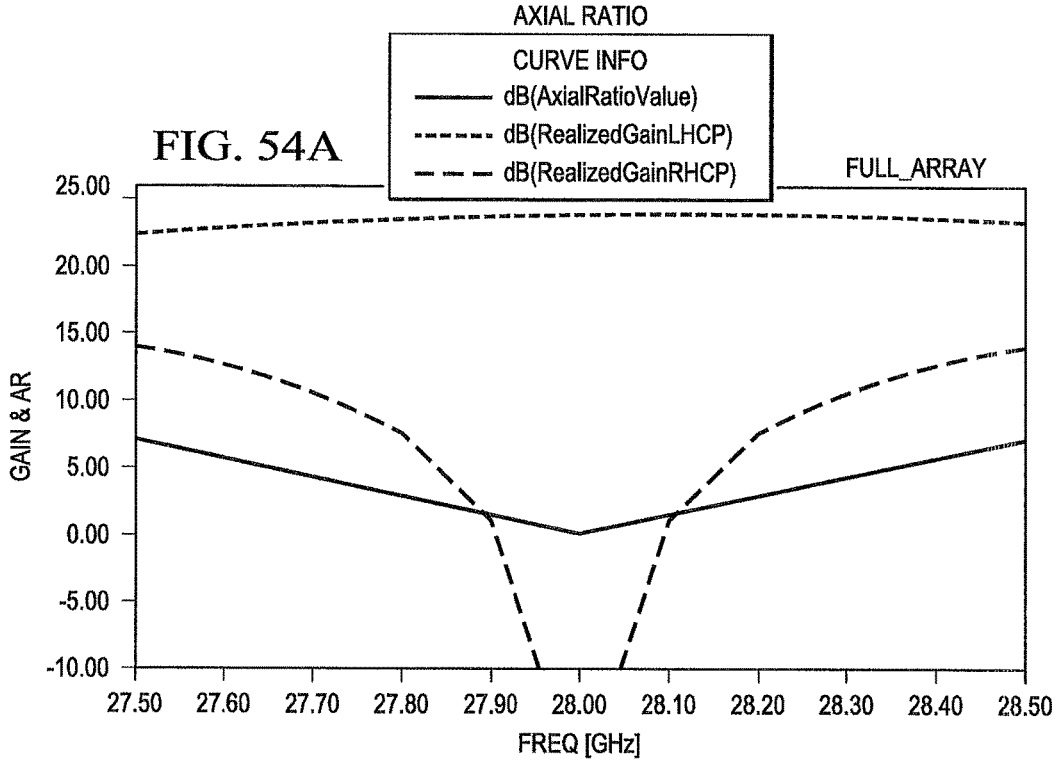
Figure 53:
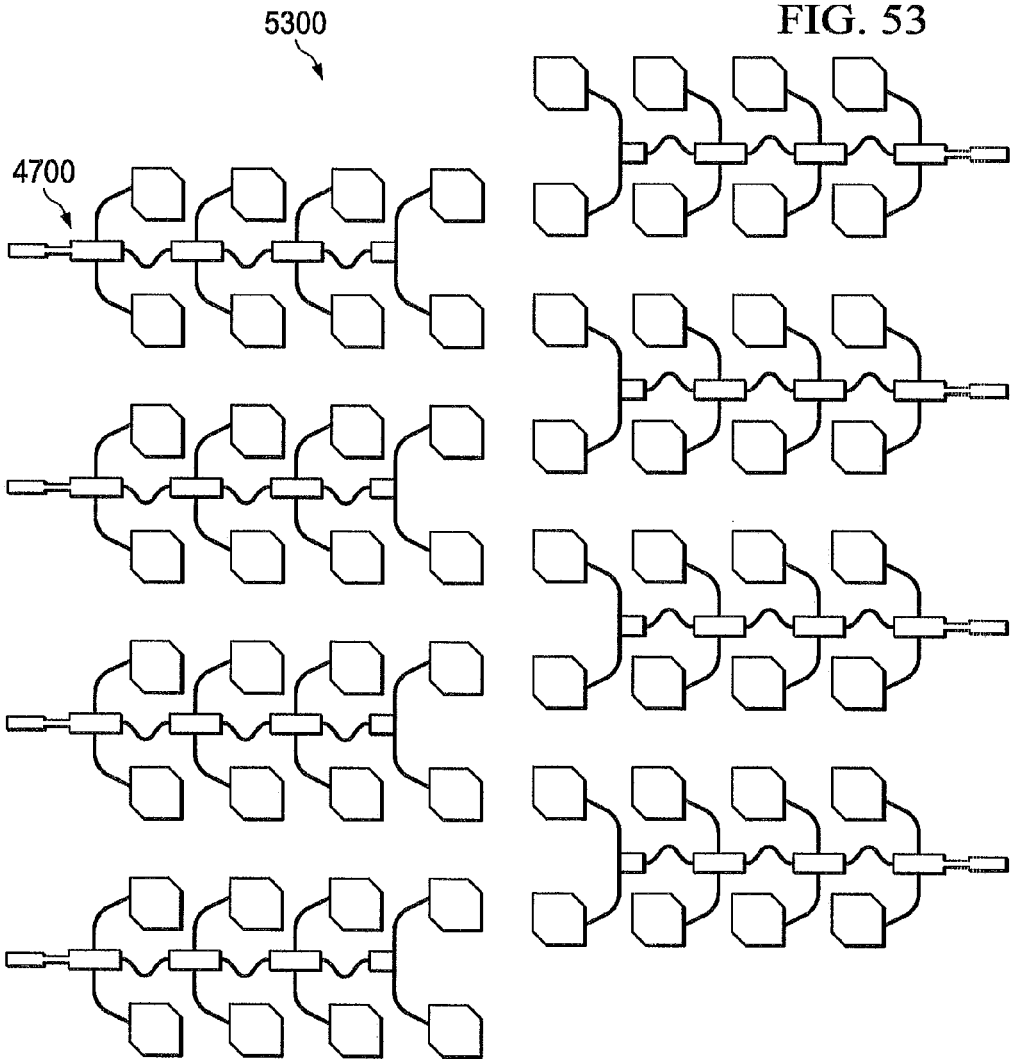
Figure 54B:
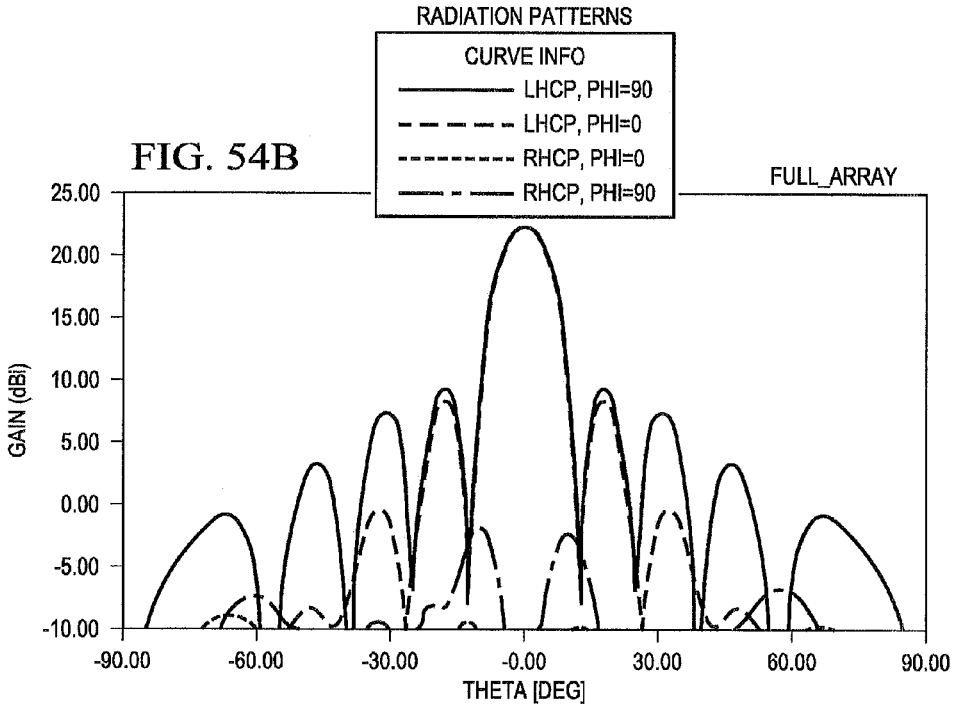
Figure 54C:
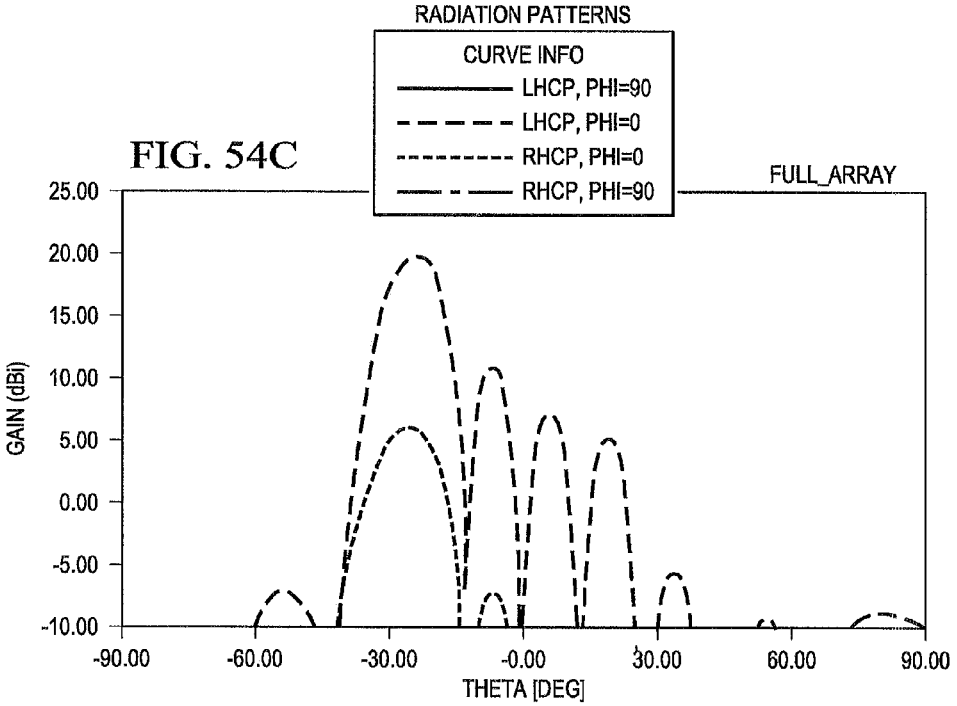
Figure 54D:
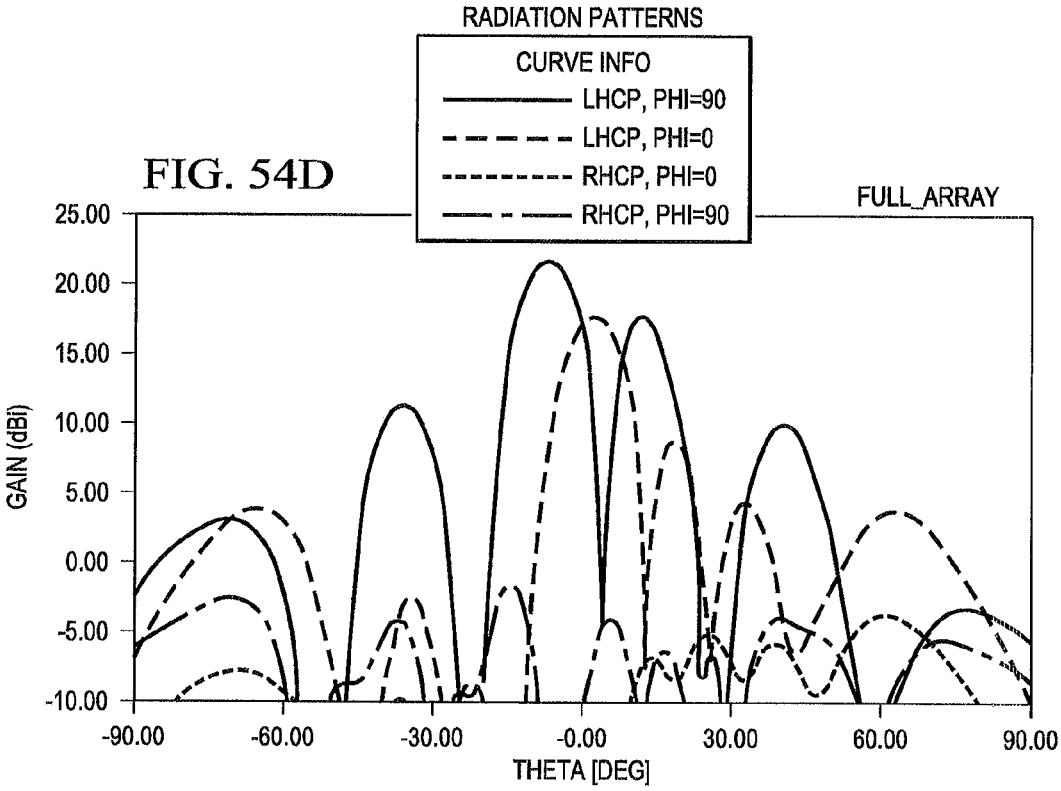

As another example, FIG. 53 illustrates a patch antenna array 5300, which includes sub-arrays formed using patch antennas 4700. Here, each sub-array includes eight patch elements, four fed from each side of a series feed line. Also, the sub-arrays are arranged so the patch elements have a triangular array lattice, although other lattices (such as diagonal, rectangular, circular, or hexagonal lattices) could also be used. Simulated array boresight gain and axial ratio versus frequency of the antenna array 5300 are shown in FIG. 54A, and radiation patterns of the antenna array 5300 at 28 GHz with a scanning beam at azimuth 0°/elevation 0°, at azimuth −25°/elevation 0°, and at azimuth 0°/elevation −7° are shown in FIGS. 54B through 54D, respectively.

Figure 55:
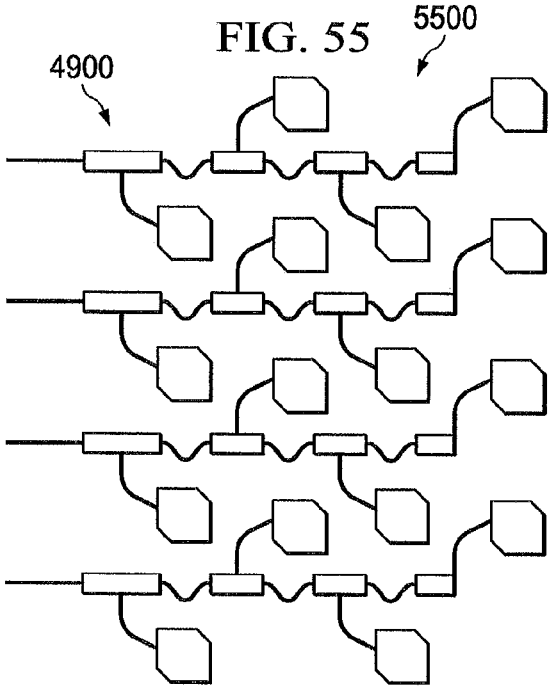

FIG. 55 illustrates a patch antenna array 5500, which includes sub-arrays formed using patch antennas 4900. Here, each sub-array includes four criss-crossed patch elements. This is a one-dimensional four-element linear array since there are four sub-arrays aligned in a row. One advantage of this configuration is that part of the aperture of one sub-array is reused by two nearby sub-arrays, and the elevation scanning range can be increased.

FIG. 56 illustrates a patch antenna array 5600, which includes sub-arrays formed using patch antennas 4900. Here, each sub-array includes four criss-crossed patch elements. The sub-arrays are offset from one another, and the patch elements form a triangular lattice with overlapped sub-array apertures. The phase center distance between two adjacent sub-arrays is reduced by a factor of two compared with a traditional rectangular lattice configuration of rectangular-shaped sub-array elements.

In all of the antenna embodiments shown in FIGS. 42A through 56, two or more of the patch elements in an antenna or antenna array are serial-fed through a common series feed line. This helps to ensure that substantially equal energy is radiated by the patch elements. Each patch element, microstrip line, and series feed line in FIGS. 42A through 56 could be formed from any suitable material(s) and in any suitable manner. For example, conductive material(s) can be deposited on a substrate (such as a PCB) and etched to form the various conductive structures of an antenna. Particular fabrication techniques include standard PCB processing techniques, CMOS fabrication techniques, and LTCC fabrication techniques. Moreover, in antennas with multiple patch elements, microstrip lines, and serial feed lines, there is no requirement that the patch elements, microstrip lines, or serial feed lines share common shapes or sizes. Antennas with differently sized or shaped patch elements, microstrip lines, or serial feed lines could be used. The antennas and antenna arrays described above could be used in any suitable devices or systems, including the eNBs 101-103 and UEs 111-116 of FIG. 1.

Although FIGS. 42A through 56 illustrate examples of circularly polarized patch antennas and antenna arrays using series feed lines, various changes may be made to FIGS. 42A through 56. For example, while FIGS. 42A through 56 illustrate various patch antennas and antenna arrays, the number and arrangement of patch elements in the antennas and arrays are for illustration only. Any number of patch elements can be arranged in any suitable manner to support desired operation of an antenna or array, and the patch elements may or may not be arranged in sub-arrays. Also, any other suitable single-layer CP patch elements could be serially connected to a series feed line, such as those having cross slots or E-slots. In addition, figures showing radiation patterns, bandwidth diagrams, boresight diagrams, and other diagrams that illustrate potential operations of the antennas and antenna arrays are non-limiting. These figures are merely meant to illustrate possible functional aspects of specific embodiments of this disclosure, possibly compared to some conventional devices. These figures are not meant to imply that all conventional or inventive devices operate in the specific manner shown in those figures.

Although this disclosure has described numerous embodiments, various changes and modifications may be suggested to one skilled in the art. For example, note that various values given in the above descriptions (such as angle values, impedance bandwidths, AR bandwidths, and component dimensions) are approximate values only. Additionally, it is within the scope of this disclosure for elements from one or more embodiments to be combined with elements from one or more other embodiments. It is intended that this disclosure encompass such changes and modifications as fall within the scope of the appended claims.

What is claimed is:

1. For use in a wireless network, an apparatus comprising: an antenna comprising:

(i) a first host patch element with two opposite corners truncated, (ii) a first microstrip line connected to a first side of the first host patch element and configured to feed the first host patch element, (iii) a second microstrip line having a first end directly connected to a second side of the first host patch element opposite the first side of the first host patch element, and (iv) a second host patch element with two opposite corners truncated, the second host patch element having shape in an orientation that is not flipped in an X plane or a Y plane compared to the first host patch element, a side of the second host patch element directly connected to a second end of the second microstrip line, (v) a third microstrip line having a first end directly connected to a third side of the first host patch element adjacent to the first side of the first host patch element and (vi) a first parasitic patch element with two opposite corners truncated, the first parasitic patch element having a shape in an orientation that is flipped in one of an X plane or a Y plane compared to the first and second host patch elements, a side of the first parasitic patch element directly connected to a second end of the third microstrip line.

2. The apparatus of claim 1, wherein the second microstrip forms an angle of substantially 45° with the side of the second host patch element.

3. The apparatus of claim 2, wherein the first and second host patch elements are cascaded to form a series-coupled antenna array.

4. The apparatus of claim 1, wherein:

the first parasitic patch element that is connected to both the first host patch element and a third host patch element, the antenna further comprises a second parasitic patch element with two opposite corners truncated, the second parasitic patch element connected to one of the first host patch element or the second host patch element, the third host patch element has a shape in an orientation that is not flipped in an X plane or Y plane compared to the first host patch element, and the second parasitic patch element has a shape in an orientation that is flipped in an X plane or a Y plane compared to the first host patch element.

5. The apparatus of claim 1, wherein:

the antenna comprises at least a plurality of patch elements that includes the first and second host patch elements and the first parasitic patch element and a plurality of microstrip lines that includes the first second, and third microstrip lines, and each of the plurality of patch elements is connected to at least two of the microstrip lines on opposing sides of the each patch element.

6. The apparatus of claim 1, wherein:

the antenna comprises at least a plurality of host patch elements that includes the first and second host patch elements and a plurality of microstrip lines that includes the first, second, and third microstrip lines; and each of the plurality of host patch elements is connected to at least two of the microstrip lines on adjacent sides of the each patch element.

7. The apparatus of claim 1, wherein the antenna comprises an antenna array having multiple sub-arrays, the first host patch element and the first microstrip line forming at least a portion of one of the sub-arrays.

8. The apparatus of claim 7, wherein:

each sub-array in a first subset of the sub-arrays comprises series-coupled patch elements; and each sub-array in a second subset of the sub-arrays comprises one or more host patch elements and one or more parasitic patch elements.

9. The apparatus of claim 8, wherein:

each of the patch elements have two opposite corners that are truncated.

10. The apparatus of claim 9, wherein the host patch elements have a shape in an orientation that is not flipped in an X plane or a Y plane compared to the first host patch element.

11. The apparatus of claim 9, wherein the parasitic patch elements have a shape in an orientation that is flipped in an X plane or a Y plane compared to the first host patch element.

12. The apparatus of claim 11, wherein the second subset includes the first and second host patch elements that are included in the one or more host patch elements.

13. A system comprising: an antenna comprising:

(i) a first host patch element with two opposite corners truncated and (ii) a first microstrip line connected to a first side of the first host patch element and configured to feed the first host patch element, (iii) a second microstrip line having a first end directly connected to a second side of the first host patch element opposite the first side of the first host patch element, and (iv) a second host patch element with two opposite corners truncated, the second host patch element having a shape in an orientation that is not flipped in an X plane or a Y plane compared to the first host patch element, the second microstrip line connected to a side of the second host patch element a side of the second host patch element directly connected to a second end of the second microstrip line, (v) a third microstrip line having a first end directly connected to a third side of the first host patch element adjacent to the first side of the first host patch element and (vi) a first parasitic patch element with two opposite corners truncated, the first parasitic patch element having a shape in an orientation that is flipped in one of an X plane or a Y plane compared to the first and second host patch elements, a side of the first parasitic patch element directly connected to a second end of the third microstrip line: and a transceiver configured to communicate wirelessly via the antenna.

14. The system of claim 13, wherein the first and second host patch elements are cascaded to form a series-coupled antenna array.

15. The system of claim 13, wherein:

the system comprises a portion of a user equipment; and the user equipment further comprises:

a processor configured to execute one or more applications; and transmit processing circuitry and receive processing circuitry coupled to the transceiver.

16. The system of claim 13, wherein:

the system comprises a portion of an eNodeB; and the eNodeB further comprises a controller configured to control communications between the eNodeB and remote terminals.

17. The system of claim 13, wherein:

the first parasitic patch element is connected to both the first host patch element and a third host patch element, the antenna further comprises a second parasitic patch element with two opposite corners truncated, the second parasitic patch element connected to one of the first host patch element or the second host patch element the third host patch element has a shape in an orientation that is not flipped in an X plane or a Y plane compared to the first host patch element, and the second parasitic patch element has a shape in an orientation that is flipped in an X plane or a Y plane compared to the first host patch element.

18. A method comprising:

at least one of: transmitting outgoing wireless signals and receiving incoming wireless signals using an antenna;

wherein the antenna comprises;

(i) a first host patch element with two opposite corners truncated and (ii) a first microstrip line connected to a first side of the first host patch element and configured to feed the first host patch element, (iii) a second microstrip having a first end directly connected to a second side of the first host patch element opposite the first side of the first host patch element, and (iv) a second host patch element with two opposite corners truncated, the second host patch element having a shape in an orientation that is not flipped in an X plane or a Y plane compared to the first host patch element, the second microstrip line connected to a side of the second host patch element a side of the second host patch element directly connected to a second end of the second microstrip line, (v) a third microstrip line having a first end directly connected to a third side of the first host patch element adjacent to the first side of the first host patch element and (vi) a first parasitic patch element with two opposite corners truncated, the first parasitic patch element having a shape in an orientation that is flipped in one of an X plane or a Y plane compared to the first and second host patch elements, a side of the first parasitic patch element directly connected to a second end of the third microstrip line.

* * * * *